US012522779B2

(12) United States Patent
Ritchie et al.

(10) Patent No.: US 12,522,779 B2
(45) Date of Patent: Jan. 13, 2026

(54) METHOD FOR REDUCTION OF ABNORMAL COMBUSTION EVENTS

(71) Applicant: Infineum International Limited, Abingdon (GB)

(72) Inventors: Andrew J. D. Ritchie, Chatham, NJ (US); Maria C. Chiappelli, Eastchester, NY (US)

(73) Assignee: Infineum International Limited, Linden, NJ (US)

( * ) Notice: Subject to any disclaimer, the term of this patent is extended or adjusted under 35 U.S.C. 154(b) by 0 days.

(21) Appl. No.: 18/475,174

(22) Filed: Sep. 26, 2023

(65) Prior Publication Data

US 2024/0218284 A1 Jul. 4, 2024

Related U.S. Application Data

(60) Provisional application No. 63/478,271, filed on Jan. 3, 2023.

(51) Int. Cl.
*C10M 169/04* (2006.01)
*C10M 127/02* (2006.01)
(Continued)

(52) U.S. Cl.
CPC ..... *C10M 169/044* (2013.01); *C10M 127/02* (2013.01); *C10M 127/04* (2013.01);
(Continued)

(58) Field of Classification Search
CPC ..... C10M 169/044; C10M 127/02; C10M 127/04; C10M 129/06; C10M 135/10;
(Continued)

(56) References Cited

U.S. PATENT DOCUMENTS 4,426,305 A 1/1984 Malec
7,407,919 B2 8/2008 Wilk et al.
(Continued)

FOREIGN PATENT DOCUMENTS

EP 2940110 B1 12/2018
WO 2017011633 A1 1/2017

OTHER PUBLICATIONS

Ritchie, Andrew et al., "Controlling Low-Speed Pre-Ignition in Modern Automotive Equipment Part 3: Identification of Key Additive Component Types and Other Lubricant Composition Effects on Low-Speed Pre-Ignition", SAE International Journal of Engines, 2016, vol. 9, issue 2.
(Continued)

*Primary Examiner* — Ellen M McAvoy
(74) *Attorney, Agent, or Firm* — Robert A. Migliorini; Catherine L. Bell

(57) ABSTRACT

This invention relates to methods to reduce abnormal combustion events in the operation of an internal combustion engine comprising using a lubricating oil composition comprising/resulting from the admixing of: (i) base oil, (ii) detergent, preferably providing at least 800 ppm Mg and less than 500 ppm Ca; and (iii) abnormal combustion event inhibitor compound(s), preferably comprising at least one phosphorus containing compound providing greater than 0.12 mass % phosphorus; wherein: 1) the lubricating oil composition is a SAE 10W-X, SAE 5W-X or SAE 0W-X blend, where X is 8, 12, 16, 20, or 30; and 2) when the lubricating oil composition is combined with an 88 octane reference fuel, the combination completes at least 1 iteration of 175,000 cycles per iteration, as determined by Sequence IX Test, ASTM D829.

38 Claims, 3 Drawing Sheets

(51) Int. Cl.

| | |
|---|---|
| ***C10M 127/04*** | (2006.01) |
| ***C10M 129/06*** | (2006.01) |
| ***C10M 135/10*** | (2006.01) |
| ***C10M 137/10*** | (2006.01) |
| ***C10M 141/10*** | (2006.01) |
| ***C10M 149/06*** | (2006.01) |
| ***C10M 161/00*** | (2006.01) |
| *C10N 30/04* | (2006.01) |
| *C10N 30/06* | (2006.01) |
| *C10N 30/10* | (2006.01) |
| *C10N 30/18* | (2006.01) |
| *C10N 40/04* | (2006.01) |

(52) U.S. Cl.

CPC ..... *C10M 129/06* (2013.01); *C10M 135/10* (2013.01); *C10M 137/10* (2013.01); *C10M 141/10* (2013.01); *C10M 149/06* (2013.01); *C10M 161/00* (2013.01); *C10M 2203/003* (2013.01); *C10M 2203/024* (2013.01); *C10M 2203/06* (2013.01); *C10M 2207/021* (2013.01); *C10M 2217/024* (2013.01); *C10M 2219/044* (2013.01); *C10M 2223/045* (2013.01); *C10N 2030/04* (2013.01); *C10N 2030/06* (2013.01); *C10N 2030/10* (2013.01); *C10N 2030/18* (2013.01); *C10N 2040/04* (2013.01)

(58) Field of Classification Search

CPC ..... C10M 137/10; C10M 141/10; C10M 149/06; C10M 161/00; C10M 2219/044; C10M 2223/045; C10N 2030/04; C10N 2030/06; C10N 2030/10

See application file for complete search history.

(56) References Cited

U.S. PATENT DOCUMENTS

| | | | | |
|---|---|---|---|---|
| 10,214,703 | B2 | 2/2019 | Fletcher et al. | |
| 10,519,394 | B2 | 12/2019 | Dance et al. | |
| 10,584,300 | B2 | 3/2020 | Hartley et al. | |
| 10,604,720 | B2 | 3/2020 | Gao et al. | |
| 10,669,505 | B2 | 6/2020 | Mosier et al. | |
| 11,034,910 | B2 | 6/2021 | Mosier et al. | |
| 11,034,912 | B2 | 6/2021 | Ritchie et al. | |
| 11,142,719 | B2 | 10/2021 | Cant et al. | |
| 11,155,764 | B2 | 10/2021 | Yang et al. | |
| 11,214,756 | B2 | 1/2022 | Mosier et al. | |
| 2005/0065045 | A1 | 3/2005 | Wilk et al. | |
| 2008/0277203 | A1 | 11/2008 | Guinther | |
| 2015/0322367 | A1* | 11/2015 | Patel | C10M 137/02 508/306 |
| 2015/0322369 | A1* | 11/2015 | Patel | C10M 129/68 508/192 |
| 2017/0204348 | A1* | 7/2017 | Tamura | C10M 165/00 |
| 2018/0066203 | A1* | 3/2018 | Dance | C10M 169/04 |
| 2018/0201860 | A1* | 7/2018 | Ransom | F02P 5/02 |
| 2019/0225911 | A1* | 7/2019 | Sutton | C10M 161/00 |
| 2024/0240104 | A1* | 7/2024 | Muramoto | C10M 145/14 |

OTHER PUBLICATIONS

Chapman, Elana et al., "A Literature Review of Abnormal Ignition by Fuel and Lubricant Derivatives", SAE International Journal of Engines, 2016, vol. 9, issue 1, pp. 107-142.

Farrell, John et al., "Fuel Blendstocks with the Potential to Optimize Future Gasoline Engine Performance: Identification of Five Chemical Families for Detailed Evaluation", Technical Report, U.S. Department of Energy, 2018.

Gaspar, Daniel, "Top Ten Blendstocks for Turbocharged Gasoline Engines: Bio-blendstocks with Potential to Deliver the Highest Engine Efficiency", Pacific Northwest National Laboratory, 2019.

Givens, W.A. et al., "Lube Formulation Effects on Transfer of Elements to Exhaust After-Treatment System Components", SAE International Powertrain and Fluid Systems Conference and Exhibition, 2003, Pittsburgh, Pennsylvania.

Leach, Felix et al., "A Review and Perspective on Particulate Matter Indices Linking Fuel Composition to Particulate Emissions from Gasoline Engines", SAE International Journal of Fuels and Lubricants, 2022, vol. 15, issue 1,.

Mounce, F., "Development of a Standardized Test to Evaluate the Effect of Gasoline Engine Oil on the Occurrence of Low Speed Pre-Ignition—The Sequence IX Test", SAE Technical Paper 2018-01-1808, Sep. 10, 2018.

Boese, Doyle et al., "Controlling Low-Speed Pre-Ignition in Modern Automotive Equipment: Defining Approaches to and Methods for Analyzing Data in New Studies of Lubricant and Fuel-Related Effects (Part 2)", SAE International Journal of Engines, 2016.

Costanzo, Vincent S. et al., "Fuel & Lubricant Effects on Stochastic Preignition", SAE International Journal of Advances and Current Practices in Mobility, 2019, vol. 1, issue 1, pp. 259-277.

* cited by examiner

METHOD FOR REDUCTION OF ABNORMAL COMBUSTION EVENTS

PRIORITY STATEMENT

This application claims priority to and the benefit of U.S. Application Ser. No. 63/478,271, filed Jan. 3, 2023 in the United States Patent and Trademark Office Patent Office.

FIELD OF THE INVENTION

This invention relates to methods of lubricating an engine using lubricating oil components, such as phosphorus, boron, molybdenum, or silicon containing compounds, as additives in lubricant compositions having excellent suppression of abnormal combustion events in engine systems using petroleum, co-blended, or alternative e-fuels.

BACKGROUND

The present invention relates to automotive lubricating oil compositions for use in internal combustion engines (such as gasoline or diesel engine using spark, compression or spark assisted compression ignition) which exhibit improved abnormal combustion event ("ACE") characteristics (i.e., backfire, various types of knock, including super knock and heavy knock type events, as well as pre-ignition (including low speed pre-ignition) type events). The present invention further relates to automotive crankcase lubricating oil compositions for use in (spark-ignited) internal combustion engines (such as direct injected turbo charged spark-ignited internal combustion engines) or compression ignited engines (such as diesel engines), such compositions often referred to as crankcase lubricants; and to the use of additives in such lubricating oil compositions for reducing abnormal combustion events in use of such engines and/or improving the performance of an engine lubricated with the lubricating oil composition by facilitating, inter alia, use of higher compression ratios in some engines as well as facilitating the use of hydrogen internal combustion engines where pre-ignition is a common concern.

This invention further relates to automotive lubricating oil compositions for use in internal combustion engines which exhibit improved abnormal combustion event characteristics (i.e., reduced low speed pre-ignition event and/or reduced knock, heavy knock type events) by use of lubricating oil components, such as phosphorus, boron, molybdenum, or silicon containing compounds, as additives in lubricant compositions in systems containing co-blended or alternative e-fuels.

Several terms exist for various forms of abnormal combustion in internal combustion engines including knock, extreme knock (sometimes referred to as super-knock, mega-knock, or heavy knock), surface ignition, and pre-ignition (ignition occurring prior to spark ignition). Extreme knock occurs in the same manner as traditional knock, but with increased knock amplitude, and typically can be mitigated using traditional knock control methods. Pre-ignition typically occurs at high speeds or low speeds under high loads, and is a notable characteristic of hydrogen internal combustion engines.

Pre-ignition is a form of abnormal combustion event where the air/fuel mixture ignites prior to the desired ignition by the spark plug, e.g., before the spark plug fires. There are many kinds of pre-ignition and methods used to address one kind of pre-ignition, do not necessarily treat another. Likewise, many elements combine to influence pre-ignition, therefore is it a complex problem. Historically, pre-ignition has generally been a problem during high speed operation of spark-ignited internal combustion engines, as heat from operation of the engine may heat a part of the combustion chamber (i.e. generate hot-spots in the combustion chamber, such as on the piston and cylinder wall) to ignite a pocket of the air-fuel mixture upon contact. This is known as hot-spot pre-ignition (see WO 2017/011633, paragraph 0003).

The recent trend in spark ignited engines has been to directly inject components into specific areas of the engines to achieve a "booster" effect. Further, direct injection-spark ignition engines have been trending towards smaller engines providing higher power densities, increasing boost pressure, by using turbochargers or superchargers to increase specific output, and down-speed the engine allowed by the higher torque generation at lower engine speeds. However, the higher torque generation at lower engine speeds has been found to cause random pre-ignition of the air/fuel mixture, a phenomenon known as low speed pre-ignition. In low speed pre-ignition, initial combustion is relatively slow and similar to normal combustion, followed by a sudden increase in combustion speed. low speed pre-ignition is typically not a runaway phenomenon, unlike some other types of abnormal combustion. Low speed pre-ignition ("LSPI") as a problem with direct injected spark ignited engines operating at low speeds is poorly understood. WO 2017/011633 discloses that "[m]ore recently, intermittent abnormal combustion has been observed in boosted [i.e., direct injected] internal combustion engines at low speeds and medium-to-high loads. For example, during operation of the engine at 3,000 rpm or less, under load, with a brake mean effective pressure (BMEP) of at least 10 bar, low-speed pre-ignition (LSPI) may occur in a random and stochastic fashion. During low speed engine operation, the compression stroke time is longest. Several published studies have demonstrated that turbocharger use, engine design, engine coatings, piston shape, fuel choice, and/or engine oil additives may contribute to an increase in LSPI events. One theory suggests that auto-ignition of engine oil droplets that enter the engine combustion chamber from the piston crevice (the space between the piston ring pack and cylinder liner) may be one cause of LSPI events." (see WO 2017/011633, paragraphs [0005]-[0006]). Alternately, LSPI is theorized to occur in the combustion chamber due to compression of the air/fuel mixture, and engine oil droplets, under the high pressures associated with such engines when the compression stroke is longest.

It is also recognised in the art that the various components in lubricating oils have an varying impacts on increasing or decreasing abnormal combustion, such as pre-ignition, such as LSPI, and more difficultly have impacts on other components as they impact LSPI. (see, for example, Boese, D. and Ritchie, A., "*Controlling Low-Speed Pre-Ignition in Modern Automotive Equipment: Defining Approaches to and Methods for Analyzing Data in New Studies of Lubricant and Fuel-Related Effects* (*Part* 1)" SAE Technical Paper 2016-01-0715, 2016, doi:10.4271/2016-01-0715, (http://papers.sae.org/2016-01-0715); Boese, D., Ritchie, A., and Young, A., "*Controlling Low-Speed Pre-Ignition in Modern Automotive Equipment: Defining Approaches to and Methods for Analyzing Data in New Studies of Lubricant and Fuel-Related Effects* (*Part* 2)," SAE Technical Paper 2016-01-0716, 2016, doi:10.4271/2016-01-0716 (http://papers.sae.org/2016-01-0716); Ritchie, A., Boese, D., and Young, A., "*Controlling Low-Speed Pre-Ignition in Modern Automotive Equipment: Identification of Key Additive Component Types and other Lubricant Composition*

*Effects on Low-Speed-Pre-Ignition* (*Part* 3)". SAE Technical Paper 2016-01-0717, 2016, doi:10.4271/2016-01-0717, (http://papers.sae.org/2016-01-0717). For example, the presence of calcium in the lubricant, for example from calcium detergents, typically promotes low speed pre-ignition events in direct injection-spark ignited internal combustion engines (see page 2, lines 20 to 30 of EP 3 366 755 and EP 2940110). Hence it has been thought that reducing the calcium content of a lubricating oil formulation can lead to a reduction in low speed pre-ignition events. However, detergents are often considered to be necessary additives for maintaining basic engine oils performance and calcium based detergents are particularly useful. Thus, recent efforts in providing lubricating oil formulations that reduce low speed pre-ignition events have focused on replacing calcium detergents with alternative detergents. However, alternative detergents capable of providing appropriate detergent activity and adequate total base number (TBN) can be challenging to develop.

Many different lubricant additive chemistries have been proposed to control or influence the occurrence of abnormal combustion events (i.e., low speed pre-ignition, knock, heavy knock type events) in modern internal combustion engines, such as turbocharged, gasoline direct injected engines.

For example, U.S. Pat. No. 11,214,756 discloses a method for reducing, inhibiting, or even eliminating low speed pre-ignition events in direct injection engines by operating the engines with a lubricant that contains a boron-containing ashless dispersant (i.e., dispersants that are free of metal other than incidental amounts that may be incorporated from production or synthesis).

U.S. Pat. No. 11,034,910 discloses a method for reducing low speed pre-ignition events in a spark-ignited direct injection internal combustion engine by supplying to the sump a lubricant composition which contains specific ashless antioxidant (phenolic compounds, aryl amine compounds, and sulfurized olefins, especially 2,6-hindered phenols and diarylamine compounds).

U.S. Pat. No. 11,142,719 discloses a method for reducing low-speed pre-ignition events and/or improving oxidation performance in a spark-ignited direct injection internal combustion engine, the method comprising lubricating the crankcase of the engine, with a lubricating oil composition comprising a detergent additive comprising an oil-soluble basic organic acid salt including at least magnesium and calcium as cations, wherein the weight ratio of calcium to magnesium is 1:1 to 1:3, and the organic acid is an alkyl-substituted hydroxy-benzoic acid or a sulfonic acid.

U.S. Pat. No. 11,034,912 discloses a method of preventing or reducing the occurrence of low speed pre-ignition in a direct-injected, boosted, spark-ignited internal combustion engine by lubricating the crankcase with a lubricating oil composition having a total sulfated ash content of no greater than about 1.2 mass %, a zinc-phosphorus compound providing said composition with a phosphorus content of from about 0.05 to about 0.08 mass %, a magnesium detergent in an amount providing said composition with at least about 0.3 mass % of magnesium sulfated ash, and an amount of calcium detergent, or calcium and sodium detergent providing said composition with from about 0.3 to about 0.4 mass % of calcium sulfated ash, or calcium and sodium sulfated ash, wherein the total amount of sulfated ash provided to said composition from detergent is no greater than 1.0 mass %, and at least 40 mass % of the total amount of metal introduced into said lubricating oil composition by metal detergent is magnesium, and wherein said zinc phosphorus compound is zinc dihydrocarbyl dithiophosphate derived from secondary alcohol, or primary and secondary alcohol.

U.S. Pat. No. 10,604,720 discloses a method for preventing or reducing engine knock or pre-ignition in a high compression spark ignition engine lubricated with a lubricating oil by introducing to the combustion chamber of the engine a minor volume % of a lubricating oil with the gasoline. The lubricating oil includes (i) a lubricating oil base stock comprising at least 80% by weight of one branched ester having at least 15% of the total carbons in the form of methyl groups, and (ii) at least one ashless amine phosphate anti-wear additive. The lubricating oils of this disclosure are described as useful in passenger vehicle engine oil (PVEO) products.

U.S. Pat. No. 10,214,703 discloses a method to reduce pre-ignition (low speed pre-ignition) using a lubricating oil composition including greater than 50 wt % of a base oil of lubricating viscosity, and an additive composition that includes an overbased calcium-containing detergent having a TBN greater than 225 mg KOH/g, and one or more zinc dialkyl dithiophosphate compounds that are derived from a molar ratio of secondary alcohol to primary alcohol of 20:100 to about 100:0 and have an average total carbon content of greater than 10 carbon atoms per mole of phosphorous. The lubricating oil compositions contains the overbased calcium-containing detergent in an amount to provide greater than 900 ppm to less than 2400 ppm by weight calcium, and at least 0.01 wt. % of the zinc dialkyl dithiophosphate, both amounts based on the total weight of the lubricating oil composition.

September 2019, the US Department of Energy published a study entitled "Top Ten Blendstocks for Turocharged gasoline Engines, Bio-blendstocks with the Potential to Deliver the Highest Engine Efficiency" as part of the Co-Optima Project (Gaspar, Daniel et al. 2019. *Top Ten Blendstocks For Turbocharged Gasoline Engines: Bioblendstocks With Potential to Deliver the for Highest Engine Efficiency*. PNNL-28713, Pacific Northwest National Laboratory, Technical Report. U.S. Department of Energy, Washington, DC. 2018. https://doi.org/10.2172/1567705 "Gaspar et al."). This study discusses blendstocks that can be derived from biomass and identifies blendstocks suited for light duty, boosted spark ignited vehicles. According to Gaspar et al., maximizing boosted spark ignited engine efficiency requires fuels with higher research octane number, higher octane sensitivity, and increased heat of vaporization, along with low particulate matter index (PMI<2 leads to no merit function score decrease). While some properties blend in a linear fashion (heat of vaporization, PMI), autoignition properties blend in a complex manner that depend on the base fuel as well as the blendstock. Hence, synergistic blending for octane and octane sensitivity that increases the relative merit function impact of some blendstocks at a given blending level (compared to that expected for linear blending) is desirable.

Gaspar et al. identify a set of top ten biomass based blendstocks with the highest increase in merit function (di-isobutylene, a furan mixture, cyclopentanone, ethanol, methanol, a fusel alcohol blend, prenol, isobutanol, n-propanol, and isopropanol) and identified a set of six biomass based blendstocks that also have the fewest significant practical barriers to adoption and use (di-isobutylene, ethanol, a fusel alcohol blend, isobutanol, n-propanol, and isopropanol).

The biomass based blendstocks (including the top 10 and top 6), however, increase abnormal combustion events (such as pre-ignition and knock) in combustion engines, particularly boosted direct injected engines. Therefore, there is a need for a means to reduce or eliminate abnormal combustion events related to use of biomass based blend stocks and fuels.

Additionally, US 2008/0277203 describes a method of increasing phosphorus retention in engine lubricant compositions during operation of an engine, wherein the phosphorus retention is sufficient to reduce catalyst poisoning.

Further, September 2018, the Southwest Research Institute published a study entitled "*Development of a Standardized Test to Evaluate the Effect of Gasoline Engine Oil on the Occurrence of Low Speed Pre-Ignition—The Sequence IX Test* (Mounce, Felt, SAE Technical Paper 2018-01-1808, 2018, doi:10.4271/2018-01-1808.)

Other references of interest include: U.S. Pat. Nos. 10,519,394; 10,584,300; 10,669,505; 11,155,764; 10,604,720; WO 2018/036285; Leach et al. SAE Int. J. Fuels Lubr./Volume 15, Issue 1, 2022, SAE 04-15-01-001; Costanzo et al. SAE Int. J. Advances & Curr. Prac. in Mobility, Volume 1, Issue 1, 2019, SAE 2019-01-0038; Chapman et al. SAE Int. J. Engines/Volume 9, Issue 1 (April 2016), SAE 215-01-1869; John Farrell, John Holladay, and Robert Wagner. "*Fuel Blendstocks with the Potential to Optimize Future Gasoline Engine Performance: Identification of Five Chemical Families for Detailed Evaluation*." Technical Report. U.S. Department of Energy, Washington, DC. 2018. DOE/GO-102018-4970, https://dx.doi.org/10.2172/1434413; and W. A. Givens et al., *Lube Formulation Effects on Transfer of Elements to Exhaust After-treatment System Components*, SAE Technical Paper series, 2003-01-3109.

The inventors show herein that the use of lubricants which contain and have high levels of abnormal combustion event inhibitors (such as B, P, Si, and/or Mo containing compounds, such as phosphorus containing compounds) and, optionally, low or no amounts of abnormal combustion event promoters (such as Ca and/or Na containing compounds) can significantly reduce the propensity for abnormal combustion events (such as conventional knock events, pre-ignition events including low speed pre-ignition, etc.) which control critical engine design and use parameters like compression ratio and fuel octane requirements as well as enabling the use of fuels containing known abnormal combustion event promoters [such as ethanol, and/or tetralin, and/or di-isobutylene] which includes e-fuels (such as hydrogen). This allows the benefits of such lubricants to be expanded beyond the current engine design and or fuel limitations.

It has now surprisingly been found by the present inventors that high levels of abnormal combustion event inhibitors, such as phosphorus, and low levels of calcium can be used in a lubricant composition, such as in internal combustion engines, to provide reduced knock events in co-blended fuels and or e-fuels.

It has now also surprisingly been found by the present inventors that high levels of abnormal combustion event inhibitors, such as phosphorus, and low levels of calcium can be used in a lubricant composition, such as in internal combustion engines, to provide reduced knock events in lower octane fuels than the engine was designed to run on, fuels containing ACE promoters (ethanol) and in co-blended fuels and or in e-fuels.

Further, it has now surprisingly been found by the present inventors that high levels of phosphorus and low levels of calcium can be used in a lubricant composition, such as in internal combustion engines, to provide higher compression ratios in gasoline internal combustion engines (such as turbocharged, Gasoline Direct Injection (GDI) engines), as compared to the same compositions containing 0.8 mass % phosphorus.

It has also surprisingly been found by the present inventors that high levels of phosphorus and low levels of calcium can be used in a lubricant composition, such as in internal combustion engines, to provide reduced knock events in low octane gasoline fuels, such as below 90, or below 89.

It has now also surprisingly been found by the present inventors that high levels of abnormal combustion event inhibitors, such as phosphorus, and low levels of calcium can be used in a lubricant composition, such as in internal combustion hydrogen engines, to provide reduced abnormal combustion events, such as backfire, knock, super knock and the like.

The claimed invention of the present application solves the objective technical problem of providing a lubricating oil composition for reducing the occurrence of abnormal combustion events (such as knock/heavyknock/pre-ignition/abnormal combustion events) in internal combustion engines, specifically (direct injected) spark ignited internal combustion engines, and or hydrogen engines especially such being used in combination with fuels containing abnormal combustion event promoters (ethanol) and/or co-blended and/or e-fuels.

SUMMARY OF THE INVENTION

This invention relates to methods to reduce abnormal combustion events in the operation of an internal combustion engine using lubricants formulated with low levels of abnormal combustion event promoting compound(s) (such as compounds containing Ca and or Na) and high levels of abnormal combustion event inhibiting compound(s) (compounds containing P, B, Mo, and or Si) that can significantly reduce or eliminate abnormal combustion events, offering the opportunity to increase internal combustion engine power density and use a wider range of fuels, such as e-fuels, co-blended fuels, fuels containing abnormal combustion event promoters (e.g., ethanol), and or lower octane/cetane fuels.

The lubricating oil compositions described herein are used in the operation of internal combustion engines with petroleum fuel, e-fuel, hydrogen fuel, co-blended fuel, or any combination thereof.

This invention further relates to a method to reduce abnormal combustion events in the operation of an internal combustion engine comprising:

(i) providing a lubricating oil composition to the crankcase of an internal combustion engine;
(ii) providing fuel to the internal combustion engine; and
(iii) combusting the fuel in the internal combustion engine;

wherein:

1) the lubricating oil composition comprises or results from the admixing of:
   (i) 50 mass % or more of base oil,
   (ii) optionally one or more abnormal combustion event promotors (optionally selected from magnesium containing compounds, calcium containing compounds);
   (iii) one or more abnormal combustion event inhibitors comprising a phosphorus containing compound providing at least 1200 ppm phosphorus to the lubricating oil composition;

2) said lubricating oil composition is identified by the viscometric descriptor SAE 10W-X, SAE 5W-X or SAE 0W-X, where X is 8, 12, 16, 20, or 30;

3) where the lubricating oil comprises one or more abnormal combustion event promotors, the fuel comprises or more abnormal combustion event promotors, or both.

This invention further relates to a method to reduce abnormal combustion events in the operation of an internal combustion engine comprising:

(i) providing a lubricating oil composition to the crankcase of an internal combustion engine;

(ii) providing fuel to the internal combustion engine; and (iii) combusting the fuel in the internal combustion engine; wherein:

1) the lubricating oil composition comprises or results from the admixing of:

(i) 50 mass % or more of base oil, (ii) detergent providing at least 800 ppm Mg (such as at least 1200 ppm Mg) and preferably less than 500 ppm Ca; and (iii) abnormal combustion event inhibitor compound(s) comprising at least one phosphorus containing compound providing greater than 0.12 mass % phosphorus, based upon the weight of the lubricating oil composition;

2) said lubricating oil composition is identified by the viscometric descriptor SAE 0W-X, SAE 5W-X, or SAE 10W-X, where X is 8, 12, 16, 20, or 30; and 3) when said lubricating oil composition is used with fuel having an octane number of 88, the combination completes at least 1 iteration of 175,000 cycles per iteration, as determined by Sequence IX Test, ASTM D829.

This invention further relates to a method to reduce abnormal combustion events in the operation of an internal combustion engine comprising:

(i) providing a lubricating oil composition to the crankcase of an internal combustion engine;

(ii) providing fuel to the internal combustion engine; and (iii) combusting the fuel in the internal combustion engine;

wherein:

1) the lubricating oil composition comprises or results from the admixing of:

(i) 50 mass % or more of base oil, (ii) detergent (such as detergent providing at least 800 ppm (such as at least 1500 ppm) Mg);

(iii) one or more abnormal combustion event inhibitors comprising a phosphorus containing compound, optionally one or more of B, Si, and or Mo containing compounds, where abnormal combustion event inhibitors provide at least 1200 ppm P;

2) said lubricating oil composition is identified by the viscometric descriptor SAE 10W-X, SAE 5W-X or SAE 0W-X, where X is 8, 12, 16, 20, or 30;

3) the fuel comprises co-blended fuel, preferably the co-blended fuel comprises hydrocarbon or hydrogen fuel blended with one or more of ethanol, methanol, isopropanol, isobutanol, n-propanol, prenol, dimethyl furan, methyl furan, cyclopentanone, 2-methyl-1-butanol, ethanol benzene, and 3-methyl-1-butanol.

This invention further relates to a method to reduce abnormal combustion events in the operation of an internal combustion engine comprising:

(i) providing a lubricating oil composition to the crankcase of an internal combustion engine;

(ii) providing fuel to the internal combustion engine; and (iii) combusting the fuel in the internal combustion engine;

wherein:

1) the lubricating oil composition comprises or results from the admixing of:

(i) 50 mass % or more of base oil, (ii) detergent (such as detergent providing at least 800 ppm (such as at least 1500 ppm) Mg);

(iii) one or more abnormal combustion event inhibitors comprising a phosphorus containing compound, optionally one or more of B, Si, and or Mo containing compounds, where abnormal combustion event inhibitors provide at least 1200 ppm P;

2) said lubricating oil composition is identified by the viscometric descriptor SAE 10W-X, SAE 5W-X or SAE 0W-X, where X is 8, 12, 16, 20, or 30;

3) the internal combustion engine is a spark ignited internal combustion engine;

4) the fuel has an octane number that is at least 1 (such as at least 2, such as at least 3, such as at least 4, such as at least 5) octane number less than the internal combustion engine's minimum fuel octane rating.

This invention further relates to a method to reduce abnormal combustion events in the operation of an internal combustion engine comprising:

(i) providing a lubricating oil composition to the crankcase of an internal combustion engine;

(ii) providing fuel to the internal combustion engine; and (iii) combusting the fuel in the internal combustion engine;

wherein:

1) the lubricating oil composition comprises or results from the admixing of:

(i) 50 mass % or more of base oil, (ii) detergent containing Mg compounds, said detergent providing at least 800 ppm (such as at least 1500 ppm) Mg (preferably having reduced or absent (such as 500 ppm or less) Ca and Na compounds);

(iii) one or more abnormal combustion event inhibitors comprising one or more of B, P, Si, and or Mo containing compounds (such as one or more phosphorus compounds, such as one or more phosphorus compounds providing greater than 0.12 mass % (such as greater than 0.24 mass %) phosphorus, based upon the weight of the lubricating oil composition);

2) said lubricating oil composition is identified by the viscometric descriptor SAE 10W-X, SAE 5W-X or SAE 0W-X, where X is 8, 12, 16, 20, or 30; and 3) the fuel comprises hydrogen fuel, e-fuel, co-blended fuel, or any combination thereof.

This invention further relates to use of a lubricating oil composition comprising or resulting from the admixing of:

(i) 50 mass % or more of base oil, (ii) detergent (such as detergent providing at least 800 ppm (such as at least 1500 ppm) Mg);

(iii) one or more abnormal combustion event inhibitors comprising a phosphorus containing compound, optionally one or more of B, Si, and or Mo containing compounds, where abnormal combustion event inhibitors provide at least 1200 ppm P;

wherein said lubricating oil composition is identified by the viscometric descriptor SAE 10W-X, SAE 5W-X or SAE 0W-X, where X is 8, 12, 16, 20, or 30; and said lubricating oil composition is used in an internal combustion engine with a co-blended fuel without abnormal combustion events, preferably the co-blended fuel comprises hydrocarbon or hydrogen fuel blended with one or more of ethanol, methanol, isopropanol, isobutanol, n-propanol, prenol, dimethyl furan, methyl furan, cyclopentanone, 2-methyl-1-butanol, ethanol benzene, and 3-methyl-1-butanol.

This invention further relates to use of a lubricating oil composition comprising or resulting from the admixing of:

(i) 50 mass % or more of base oil, (ii) detergent;

(iii) one or more abnormal combustion event inhibitors comprising a phosphorus containing compound, optionally one or more of B, Si, and or Mo containing compounds, where abnormal combustion event inhibitors provide at least 1200 ppm P;

wherein said lubricating oil composition is identified by the viscometric descriptor SAE 10W-X, SAE 5W-X or SAE 0W-X, where X is 8, 12, 16, 20, or 30; and said lubricating oil composition is used in a spark ignited internal combustion engine with fuel having an octane number that is at least 1 (such as at least 2, such as at least 3, such as at least 4, such as at least 5) octane number less than the internal combustion engine's minimum fuel octane rating without abnormal combustion events.

This invention further relates to use of a lubricating oil composition comprising or resulting from the admixing of:

(i) 50 mass % or more of base oil, (ii) detergent (preferably detergent providing at least 800 ppm (such as at least 1500 ppm) Mg);

(iii) one or more abnormal combustion event inhibitors comprising one or more of B, P, Si, and or Mo containing compounds (such as P containing compounds providing at least 1200 ppm P);

wherein said lubricating oil composition is identified by the viscometric descriptor SAE 10W-X, SAE 5W-X or SAE 0W-X, where X is 8, 12, 16, 20, or 30; and when said lubricating oil composition, when used with fuel comprising an 88 octane petroleum fuel (Haltermann 88 octane reference fuel), completes at least 1 (such as at least 2, such as at least 3, such as at least 4, such as 4) iterations of 175,000 cycles per iteration, as determined by Sequence IX Test, ASTM D829.

This invention further relates to use of a lubricating oil composition comprising or resulting from the admixing of:

(i) 50 mass % or more of base oil, (ii) detergent consisting essentially of Mg compounds, said detergent providing at least 800 ppm (such as at least 1500 ppm) Mg and preferably containing less than 500 ppm Ca and or Na;

(iii) one or more abnormal combustion event inhibitors comprising one or more of B, P, Si, and or Mo containing compounds (such as one or more phosphorus compounds, such as one or more phosphorus compounds providing greater than 0.24 mass % phosphorus, based upon the weight of the lubricating oil composition);

wherein said lubricating oil composition is identified by the viscometric descriptor SAE 10W-X, SAE 5W-X or SAE 0W-X, where X is 8, 12, 16, 20, or 30; and when said lubricating oil composition, when used with fuel comprising an 88 octane petroleum fuel (Haltermann 88 octane reference fuel), completes at least 1 (such as at least 2, such as at least 3, such as at least 4, such as 4) iterations of 175,000 cycles per iteration, as determined by Sequence IX Test, ASTM D829.

This invention further relates to use of a lubricating oil composition comprising or resulting from the admixing of:

(i) 50 mass % or more of base oil, (ii) detergent providing at least 800 ppm (such as at least 1500 ppm) Mg and from 10 to 500 ppm Ca;

(iii) one or more abnormal combustion event inhibitors comprising one or more of B, P, Si, and or Mo containing compounds (such as one or more phosphorus compounds, such as one or more phosphorus compound providing greater than 0.20 mass % phosphorus, based upon the weight of the lubricating oil composition);

wherein said lubricating oil composition is identified by the viscometric descriptor SAE 10W-X, SAE 5W-X or SAE 0W-X, where X is 8, 12, 16, 20, or 30; and when said lubricating oil composition, when used with fuel comprising an 88 octane petroleum fuel (Haltermann 88 octane reference fuel), completes at least 1 (such as at least 2, such as at least 3, such as at least 4, such as 4) iterations of 175,000 cycles per iteration, as determined by Sequence IX Test, ASTM D829.

Preferably at least 80% of the phosphorus comes from metal alkylthiophosphate(s).

This invention further relates to use of a lubricating oil composition comprising or resulting from the admixing of:

(i) 50 mass % or more of base oil, (ii) detergent containing Mg compounds, said detergent providing at least 800 ppm (such as at least 1500 ppm) Mg (preferably having reduced or absent (such as 500 ppm or less) Ca and Na compounds);

(iii) one or more abnormal combustion event inhibitors comprising one or more of B, P, Si, and or Mo containing compounds (such as one or more phosphorus compounds, such as one or more phosphorus compounds providing greater than 0.12 mass % (such as greater than 0.24 mass %) phosphorus, based upon the weight of the lubricating oil composition);

wherein said lubricating oil composition is identified by the viscometric descriptor SAE 10W-X, SAE 5W-X or SAE 0W-X, where X is 8, 12, 16, 20, or 30; and where said lubricating oil composition is combined in an internal combustion engine, with diesel fuel, preferably having a cetane number of 40 to 60.

This invention further relates use of to a lubricating oil composition comprising or resulting from the admixing of:

(i) 50 mass % or more of base oil, (ii) detergent containing Mg compounds, said detergent providing at least 800 ppm (such as at least 1500 ppm) Mg (preferably having reduced or absent (such as 500 ppm or less) Ca and Na compounds);

(iii) one or more abnormal combustion event inhibitors comprising one or more of B, P, Si, and or Mo containing compounds (such as one or more phosphorus compounds, such as one or more phosphorus compounds providing greater than 0.12 mass % (such as greater than 0.24 mass %) phosphorus, based upon the weight of the lubricating oil composition);

wherein said lubricating oil composition is identified by the viscometric descriptor SAE 10W-X, SAE 5W-X or SAE 0W-X, where X is 8, 12, 16, 20, or 30; and where said lubricating oil composition is combined in an internal combustion engine, with hydrogen fuel, e-fuel, co-blended fuel, or any combination thereof.

This invention further relates to a method to reduce abnormal combustion events comprising lubricating crankcase of an internal combustion engine with the lubricating oil composition described herein, preferably where co-blended fuels are used in the internal combustion engine.

This invention further relates to a method to reduce abnormal combustion events comprising lubricating crankcase of an internal combustion engine with the lubricating oil composition described herein, preferably where hydrogen fuel(s) are used in the internal combustion engine.

This invention further relates to a method to reduce abnormal combustion events comprising lubricating crankcase of an internal combustion engine with the lubricating oil composition described herein, preferably where e-fuel(s) are used in the internal combustion engine.

This invention relates to compositions comprising the lubricating oil compositions described herein for use with co-blended fuels to reduce abnormal combustion events, said co-blended fuel containing petroleum fuel and at least 10 wt % of fuel blending product (based upon the weight of the petroleum fuel and the fuel blending product based), and having an octane number of 84 or above or a cetane number of 40 or more.

The lubricating oil compositions described herein act to provide an "octane lift" in any octane number fuel, thus having the benefit of, among other things, making a lower octane fuel (such as an 88 octane fuel) usable in an engine designed for a higher octane fuel (such as a 93 octane fuel), and making a higher octane fuel (such as a 93 octane fuel) function like an even higher octane fuel (such as a 98 octane fuel), thus opening up new avenues for engine design.

DEFINITIONS

Figure 1:
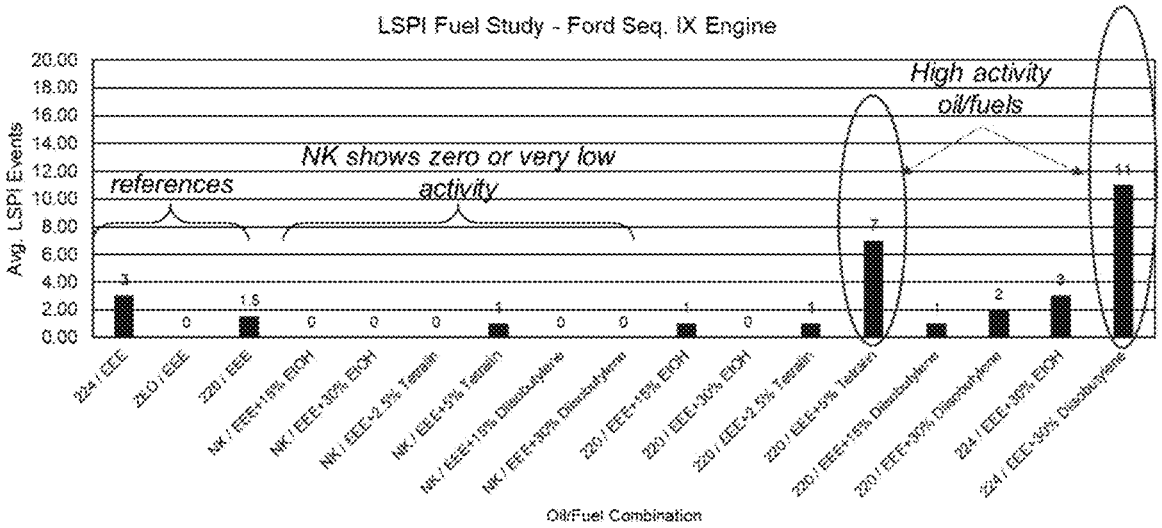
FIG. 1 (FIG. 1) is a graph of the results of the Sequence IX Testing for Example 2.

For purposes of this specification and all claims to this invention, the new numbering scheme for the Periodic Table of the Elements is used as set out in CHEMICAL AND ENGINEERING NEWS, 63(5), 27 (1985), i.e., Alkali metals are Group 1 metals (e.g. Li, Na, K, etc.) and Alkaline earth metals are Group 2 metals (e.g., Mg, Ca, Ba, etc.).

The term "comprising" or any cognate word specifies the presence of stated features, steps, or integers or components, but does not preclude the presence or addition of one or more other features, steps, integers, components or groups thereof. The expressions "consists of" or "consists essentially of" or cognates may be embraced within "comprises" or cognates, wherein "consists essentially of" permits inclusion of substances not materially affecting the characteristics of the composition to which it applies.

The term "LOC" means lubricating oil composition(s), which are also referred to as "lubricant composition(s)," "lubricating composition(s)," "lubricant oil composition(s)."

The term "major amount" means more than 50 mass % of a composition, such as more than 60 mass % of a composition, such as more than 70 mass % of a composition, such as from 80 to 99.009 mass % of a composition, such as from 80 to 99.9 from 80 to 99.009 mass % of a composition, of a composition based upon the mass of the composition.

The term "minor amount" means 50 mass % or less of a composition; such as 40 mass % or less of a composition; such as 30 mass % or less of a composition, such as from 20 to 0.001 mass %, such as from 20 to 0.1 mass %, based upon the mass of the composition.

The term "mass %" means mass percent of a component, based upon the mass of the composition as measured in grams, unless otherwise indicated, and is alternately referred to as weight percent ("weight %" "wt %" or "%/w").

The term "active ingredient" (also referred to as "a.i." or "A.I.") refers to additive material that is neither diluent nor solvent.

The terms "oil-soluble" and "oil-dispersible," or cognate terms, used herein do not necessarily indicate that the compounds or additives are soluble, dissolvable, miscible, or are capable of being suspended in the oil in all proportions. These do mean, however, that they are, for example, soluble or stably dispersible in oil to an extent sufficient to exert their intended effect in the environment in which the oil is employed. Moreover, the additional incorporation of other additives may also permit incorporation of higher levels of a particular additive, if desired.

The terms "group" and "radical" are used interchangeably herein.

The term "hydrocarbon" means a compound of hydrogen and carbon atoms. A "heteroatom" is an atom other than carbon or hydrogen. When referred to as "hydrocarbons," particularly as "refined hydrocarbons," the hydrocarbons may also contain one or more heteroatoms or heteroatom containing groups (such as halo, especially chloro and fluoro, amino, alkoxyl, mercapto, alkylmercapto, nitro, nitroso, sulfoxy, etc.) in minor amounts (e.g., where the heteroatom(s) do not substantially alter the hydrocarbon properties of the hydrocarbon compound).

The term "hydrocarbyl" means a radical that contains hydrogen and carbon atoms. Preferably, the group consists essentially of, more preferably consists only of, hydrogen and carbon atoms, unless specified otherwise. Preferably, the hydrocarbyl group comprises an aliphatic hydrocarbyl group. The term "hydrocarbyl" includes "alkyl," "alkenyl," "alkynyl," and "aryl" as defined herein. Hydrocarbyl groups may contain one or more atoms/groups other than carbon and hydrogen provided they do not affect the essentially hydrocarbyl nature of the hydrocarbyl group. Those skilled in the art will be aware of such atoms/groups (e.g., halo, especially chloro and fluoro, amino, alkoxyl, mercapto, alkylmercapto, nitro, nitroso, sulfoxy, etc.).

The term "alkyl" means a radical of carbon and hydrogen (such as a $C_1$ to $C_{30}$, such as a $C_1$ to $C_{12}$ group). Alkyl groups in a compound are typically bonded to the compound directly via a carbon atom. Unless otherwise specified, alkyl groups may be linear (i.e. unbranched) or branched, be cyclic, acyclic or part cyclic/acyclic. Preferably, the alkyl group comprises a linear or branched acyclic alkyl group. Representative examples of alkyl groups include, but are not limited to, methyl, ethyl, n-propyl, iso-propyl, n-butyl, sec-butyl, iso-butyl, tert-butyl, n-pentyl, iso-pentyl, neo-pentyl, hexyl, heptyl, octyl, dimethyl hexyl, nonyl, decyl, undecyl, dodecyl, tridecyl, tetradecyl, pentadecyl, hexadecyl, heptadecyl, octadecyl, nonadecyl, icosyl and triacontyl.

The term "alkenyl" means a radical of carbon and hydrogen (such as a $C_2$ to $C_{30}$ radical, such as a $C_2$ to $C_{12}$ radical) having at least one double bond. Alkenyl groups in a compound are typically bonded to the compound directly via a carbon atom. Unless otherwise specified, alkenyl groups may be linear (i.e. unbranched) or branched, be cyclic, acyclic or part cyclic/acyclic.

The term "alkylene" or "alkene" means a $C_1$ to $C_{20}$, preferably a $C_1$ to $C_{10}$, bivalent saturated aliphatic radical which may be linear or branched. Representative examples of alkylene include methylene, ethylene, propylene, butylene, pentylene, hexylene, heptylene, octylene, nonylene, decylene, 1-methyl ethylene, 1-ethyl ethylene, 1-ethyl-2-methyl ethylene, 1,1-dimethyl ethylene and 1-ethyl propylene.

The term "alkynyl" means a $C_2$ to $C_{30}$ (such as a $C_2$ to $C_{12}$) radical which includes at least one carbon to carbon triple bond.

The term "aryl" means a group containing at least one aromatic ring, such a cyclopentadiene, phenyl, naphthyl, anthracenyl, and the like. Aryl groups are typically $C_5$ to $C_{40}$ (such as $C_5$ to $C_{18}$, such as $C_6$ to $C_{14}$) aryl groups, optionally substituted by one or more hydrocarbyl groups, heteroatoms, or heteroatom containing groups (such as halo, hydroxyl, alkoxy and amino groups). Preferred aryl groups include phenyl and naphthyl groups and substituted derivatives thereof, especially phenyl, and alkyl substituted derivatives of phenyl.

The term "substituted" means that a hydrogen atom has been replaced with hydrocarbon group, a heteroatom or a heteroatom containing group. An alkyl substituted derivative means a hydrogen atom has been replaced with an alkyl group. An "alkyl substituted phenyl" is a phenyl group where a hydrogen atom has been replaced by an alkyl group, such as a $C_1$ to $C_{20}$ alkyl group, such as methyl, ethyl, n-propyl, iso-propyl, n-butyl, sec-butyl, iso-butyl, tert-butyl, n-pentyl, iso-pentyl, neo-pentyl, hexyl, heptyl, octyl, dimethyl hexyl, nonyl, decyl, undecyl, dodecyl, tridecyl, tetradecyl, pentadecyl, hexadecyl, heptadecyl, octadecyl, nonadecyl, icosyl and/or triacontyl.

The term "halogen" or "halo" means a group 17 atom or a radical of group 17 atom, such as fluoro, chloro, bromo and iodo.

The term "ashless" in relation to an additive means the composition does not include a metal.

The term "ash-containing" in relation to an additive means the composition includes a metal.

The term "effective amount" in respect of an additive means an amount of such an additive in a lubricating oil composition so that the additive provides the desired technical effect.

The term "effective minor amount" in respect of an additive means an amount of such an additive of less than 50 mass % of the lubricating oil composition so that the additive provides the desired technical effect.

The term "ppm" means parts per million by mass, based on the total mass of the lubricating oil composition, unless otherwise indicated.

The term "metal content" of a lubricating oil composition or of an additive component, for example magnesium content, molybdenum content or total metal content (i.e. the sum of all individual metal contents), is measured by ASTM D5185.

Phosphorus, Boron, Calcium, Zinc, Molybdenum, Silicon, Sodium, and Magnesium content are measured by ASTM 5185.

The term "Total Base Number" also referred to as "TBN" in relation to an additive component or of a lubricating oil composition (i.e. unused lubricating oil composition) means total base number as measured by ASTM D2896.

The term "Total Acid Number" also referred to as "TAN" means total acid number as measured by ASTM D664.

The term "adhesive wear" is determined by ASTM 8074-19, which is also referred to as the DD13 Scuffing Test.

The term "foam volume" is determined by ASTM D 892, option A).

Sulfur content is measured by ASTM D2622.

Sulfated ash content ("SASH") is measured by ASTM D874.

Kinematic viscosity ($KV_{100}$, $K_{40}$) is determined pursuant to ASTM D445-19a and is reported in units of cSt, unless otherwise specified.

Viscosity Index is determined according to ASTM D2270.

High Temperature Corrosion Bench Test (HTCBT) is determined pursuant to ASTM D6594.

The term "aliphatic hydrocarbyl fatty acid" means a monocarboxylic acid having an aliphatic $C_7$ to $C_{29}$, preferably a $C_9$ to $C_{27}$, most preferably a $C_{11}$ to $C_{23}$ hydrocarbyl chain. Such compounds may be referred to herein as aliphatic ($C_7$ to $C_{29}$), more preferably ($C_9$ to $C_{27}$), most preferably ($C_{11}$ to $C_{23}$), hydrocarbyl monocarboxylic acid(s) or hydrocarbyl fatty acid(s) (wherein $C_x$ to $C_y$ designates the total number of carbon atoms in the aliphatic hydrocarbyl chain of the fatty acid, the fatty acid itself due to the presence of the carboxyl carbon atom includes a total of $C_{x+1}$ to $C_{y+1}$ carbon atoms). Preferably, the aliphatic hydrocarbyl fatty acid, inclusive of the carboxyl carbon atom, has an even number of carbon atoms. The aliphatic hydrocarbyl chain of the fatty acid may be saturated or unsaturated (i.e. includes at least one carbon to carbon double bond); preferably, the aliphatic hydrocarbyl chain is unsaturated and includes at least one carbon to carbon double bond—such fatty acids may be obtained from natural sources (e.g. derived from animal or vegetable oils) and/or by reduction of the corresponding saturated fatty acid. It will be appreciated that a proportion of the aliphatic hydrocarbyl chain(s) of the corresponding aliphatic hydrocarbyl fatty acid ester(s) is unsaturated (i.e. includes at least one carbon to carbon double bond) to permit reaction with other agents, such as sulfur, to form the corresponding functionalized, such as sulfurized, aliphatic hydrocarbyl fatty acid ester(s).

The term "aliphatic hydrocarbyl fatty acid ester" means an ester obtainable by converting the monocarboxylic acid functional group of the corresponding aliphatic hydrocarbyl fatty acid into an ester group. Suitably, the monocarboxylic acid functional group of the aliphatic hydrocarbyl fatty acid is converted to a hydrocarbyl ester, preferably a $C_1$ to $C_{30}$ aliphatic hydrocarbyl ester, such as an alkyl ester, preferably a $C_1$ to $C_6$ alkyl ester, especially a methyl ester. Alternatively, or additionally, the monocarboxylic acid functional group of the aliphatic hydrocarbyl fatty acid may be in the form of the natural glycerol ester. Accordingly, the term "aliphatic hydrocarbyl fatty acid ester" embraces aliphatic hydrocarbyl fatty acid glycerol ester(s) and aliphatic hydrocarbyl fatty acid $C_1$ to $C_{30}$ aliphatic hydrocarbyl ester(s), (e.g. aliphatic hydrocarbyl fatty acid alkyl ester(s), more preferably aliphatic hydrocarbyl fatty acid $C_1$ to $C_6$ alkyl ester(s), especially aliphatic hydrocarbyl fatty acid methyl ester(s)). Suitably, the term "aliphatic hydrocarbyl fatty acid ester" embraces aliphatic ($C_7$ to $C_{29}$) hydrocarbyl, more preferably aliphatic ($C_9$ to $C_{27}$) hydrocarbyl, most preferably aliphatic ($C_{11}$ to $C_{23}$) hydrocarbyl fatty acid glycerol ester(s) and aliphatic ($C_7$ to $C_{29}$) hydrocarbyl, more preferably aliphatic ($C_9$ to $C_{27}$) hydrocarbyl, most preferably aliphatic ($C_{11}$ to $C_{23}$) hydrocarbyl fatty acid $C_1$ to $C_{30}$ aliphatic hydrocarbyl ester(s). Suitably, to permit functionalization, such as sulfurization, of the aliphatic hydrocarbyl fatty acid ester(s) a proportion of the aliphatic hydrocarbyl chain(s) of the fatty acid ester(s) is unsaturated and includes at least one carbon to carbon double bond.

The term "sulfurized aliphatic hydrocarbyl fatty acid ester" means a compound obtained by sulfurizing an aliphatic hydrocarbyl fatty acid ester as defined herein.

The term "absent" as it relates to components included within the lubricating oil compositions described herein and the claims thereto means that the particular component is present at 0 wt %, based upon the weight of the lubricating oil composition, or if present in the lubricating oil composition the component is present at levels that do not impact the lubricating oil composition properties, such as less than 10 ppm, or less than 1 ppm or less than 0.001 ppm.

Unless otherwise indicated, all percentages reported are mass % on an active ingredient basis, i.e. without regard to carrier or diluent oil, unless otherwise stated.

Also, it will be understood that various components used, essential as well as optimal and customary, may react under conditions of formulation, storage or use and that the invention also provides the product obtainable or obtained as a result of any such reaction.

Further, it is understood that any upper and lower quantity, range and ratio limits set forth herein may be independently combined.

Also, it will be understood that the preferred features of each aspect of the present invention are regarded as preferred features of every other aspect of the present invention. Accordingly, preferred and more preferred features of one aspect of the present invention may be independently combined with other preferred and/or more preferred features of the same aspect or different aspects of the present invention.

DETAILED DESCRIPTION

The features of the invention relating, where appropriate, to each and all aspects of the invention, will now be described in more detail as follows.

The lubricating oil compositions of the invention comprise components that may or may not remain the same chemically before and after mixing with an oleaginous carrier (such as a base oil) and/or other additives. This invention encompasses compositions which comprise the components before mixing, or after mixing, or both before and after mixing.

Further, it is understood that any upper and lower quantity, range and ratio limits set forth herein may be independently combined.

For purposes of this specification and all claims to this invention an abnormal combustion event ("ACE") is defined to be an event where combustion in a spark ignited internal combustion engine (SI engine) occurs outside the flame front propagated from a spark plug, or in a compression ignited internal combustion engine ("CI engine") an event where combustion occurs outside of or in the incorrect location or time of the piston compression cycle. (A spark assisted compression ignited engine may have either or both of the above defined of abnormal combustion events.) Auto-ignition and pre-ignition are both abnormal combustion events. Auto-ignition (also referred to as detonation) is the spontaneous combustion of an fuel/air mixture in the combustion chamber that occurs after normal combustion is initiated by the spark plug or compression (such as by a compressing piston). Pre-ignition is defined as the ignition of the air/fuel mixture prior to the spark plug firing in an SI engine or normal compression ignition in a CI engine). Low Speed Pre-ignition (LSPI) is a specific type of pre-ignition which occurs under low engine speeds and relatively high engine loads.

Knocking (also referred to as knock, detonation, spark knock, pinging or pinking) in spark ignited internal combustion engines typically occurs when combustion of some of the air/fuel mixture in the cylinder does not result from propagation of the flame front ignited by the spark plug, but one or more pockets of air/fuel mixture explode outside the envelope of the normal combustion front. The fuel-air charge is meant to be ignited by the spark plug only and at a precise point in the piston's stroke. Knock occurs when the peak of the combustion process no longer occurs at the optimum moment for the engine stroke cycle (such as a four-stroke cycle). The shock wave from the auto-ignition can create the characteristic metallic "pinging" or "knocking" sound. Effects of engine knocking range from inconsequential to completely destructive to the engine. Knocking should not be confused with pre-ignition as they are two separate events. However, pre-ignition can be followed by knocking.

Abnormal combustion events (such as auto-ignition) are influenced by multiple factors, including but not limited to, engine design (shape, size, geometry, plug location), spark plug performance/timing, compression ratio, engine timing, air/fuel mixture temperature, cylinder pressure, fuel octane rating, lubricant composition, fuel additive composition, and the like.

Gasoline octane rating (octane number) correlates to the ability to resist spontaneous ignition, i.e., knock. Octane number is defined as the Research Octane Number plus the Motor Octane Number divided by two (i.e., (RON+MON)/2). Research Octane Number is determined by ASTM D2699-21. Motor Octane Number is determined by ASTM D2700-21. Engines are designed to run on fuels which have a specific octane number or higher; these engines will be susceptible abnormal combustion events, particularly knock, if they encounter fuel octane numbers below the specific octane number requirement. For example, an engine designed to run on 93 octane fuel will encounter abnormal combustion events's if run on 88 octane fuel. Higher octane numbers are traditionally preferred in internal combustion engines and most engines on the road today do not handle lower octane numbers (such as less than 87) well. A low octane fuel (such as a low octane petroleum fuel, such as a low octane gasoline fuel), is a fuel having an octane number of 90 or less, such as 89 or less, such as 88 or less, such as from 75 to 90, such as 84 to 89, such as 85 to 88, such as 90, 89, 88, 87, 86, 85, 84, 83, 82, 81, 80, 79, 78, 7, 75 or 75 (as determined by ASTM D2700-21).

Diesel gasoline cetane rating (cetane number) is an indicator of the combustion speed of diesel fuel and compression needed for ignition, as determined by ASTM D613. A low cetane fuel (such as a low cetane petroleum fuel, such as a low cetane diesel fuel), is a fuel having an cetane number of 60 or less, such as 55 or less, such as 50 or less, such as from 40 to 60, such as 45 to 55, such as 40, 41, 42, 43, 44, 45, 46, 47, 48, 49, 50, 51, 52, 53, 54, 55, 56, 57, 58, 59, or 60 (as determined by ASTM D613).

"Haltermann 88 octane reference fuel" is Haltermann HF-02021 EPA Tier 3 EEE Emission Certification Fuel, Regular Octane having an octane number of 88 available from Haltermann Solutions, Houston, Texas).

"Haltermann 93 octane reference fuel" is Haltermann HF-00003 EEE Lube Certification Gasoline having an Octane number of 93 available from Haltermann Solutions, Houston, Texas).

An engine's minimum fuel octane rating is the lowest recommended octane fuel an engine can use as published by the engine manufacturer, typically an 85 to 88 octane rating for most passenger cars.

Phosphorus retention is determined as set out in ASTM D8111-17, IIIHB test.

Lubricating Oil Compositions

This invention relates to lubricating oil compositions, also referred to as "lubricant compositions," "lubricating compositions," "lubricant oil compositions," or "LOCs."

This invention relates to lubricating oil compositions comprising one or more abnormal combustion event ACE inhibitor compound(s), as described in component section B below (such as ACE inhibitor phosphorus containing compound(s), such as metal alkylthiophosphate, such as zinc dialkyl dithiophosphate), wherein said lubricating oil composition:

a) when used with gasoline fuel having an octane number of 88 (Haltermann 88 octane reference fuel) completes at least 1 (such as at least 2, such as at least 3, such as at least 4, such as 4) iterations of 175,000 cycles per iteration, as determined by Sequence IX Test, ASTM D829; and b) is identified by the viscometric descriptor SAE 10W-X, SAE 5W-X or SAE 0W-X (preferably SAE 5W-X or SAE 0W-X), where X is 8, 12, 16, 20, 30, 40 or 50 (preferably 8, 12, 16, or 20);

c) comprises 0.09 (such as 0.10, 0.12, 0.15, 0.17, 0.2, 0.4, 0.5, 1.5, 2.0, 2.5, 3.0, 3.5, 4.0) mass % or more P, Mo, B, and Si (such as 0.12 (such as 0.13, 0.14, 0.15, 0.17, 0.2, 0.4, 0.5, 1.5, 2.0, 2.5, 3.0, 3.5, 4.0) mass % or more phosphorus), derived from ACE inhibitor compound (s), based upon the weight of the lubricating composition.

This invention relates to lubricating oil compositions comprising or resulting from the admixing of:

(i) 50 mass % or more of base oil, (ii) Group 1 or 2 metal containing detergent;

(iii) dispersant (such as PIBSA-PAM); and (iv) one or more abnormal combustion event inhibitor compound(s)(as described in component section B below), other than (ii) and (iii), such as ACE inhibitor phosphorus containing compound(s), such as metal alkylthiophosphate (such as zinc dialkyl dithiophosphate);

wherein said lubricating oil composition:

a) when used with gasoline fuel having an octane number of 88 (Haltermann 88 octane reference fuel) completes at least 1 (such as at least 2, such as at least 3, such as at least 4, such as 4) iterations of 175,000 cycles per iteration, as determined by Sequence IX Test, ASTM D829; and b) is identified by the viscometric descriptor SAE 10W-X, 5W-X or SAE 0W-X (such as 5W-X or SAE 0W-X), where X is 8, 12, 16, 20, 30, 40 or 50 (such as 8, 12, 16, or 20);

c) comprises 0.09 (such as 0.10, 0.12, 0.15, 0.17, 0.2, 0.4, 0.5, 1.5, 2.0, 2.5, 3.0, 3.5, 4.0) mass % or more P, Mo, B, and Si (preferably 0.12 (such as 0.13, 0.14, 0.15, 0.17, 0.2, 0.4, 0.5, 1.5, 2.0, 2.5, 3.0, 3.5, 4.0) mass % or more phosphorus), derived from ACE inhibitor compound(s), based upon the weight of the lubricating composition.

This invention relates to lubricating oil compositions comprising or resulting from the admixing of:

(i) 50 mass % or more of base oil, (ii) detergent providing at least 800, such as at least 1500 ppm Mg and less than 500 ppm Ca, such as from 10 to 500 ppm Ca;

(iii) dispersant (such as PIBSA-PAM); and (iv) abnormal combustion event ACE inhibitor compound (s)(described in component section B below), other than (ii) and (iii), such as ACE inhibitor phosphorus containing compound(s), such as metal alkylthiophosphate (such as such as zinc dialkyl dithiophosphate);

(v) friction modifier (such as organic FM, such as organic ester, such as fatty acid ester);

wherein said lubricating oil composition:

a) when combined with gasoline fuel having an octane number of octane number of 88 (Haltermann 88 octane reference fuel) completes at least 1 (such as at least 2, such as at least 3, such as at least 4, such as 4) iterations of 175,000 cycles per iteration, as determined by Sequence IX Test, ASTM D829; and b) is identified by the viscometric descriptor SAE 10W-X, 5W-X or SAE 0W-X (such as 5W-X or SAE 0W-X), where X is 8, 12, 16, 20, 30, 40 or 50 (such as 8, 12, 16, or 20);

c) comprises 0.09 (such as 0.10, 0.12, 0.15, 0.17, 0.2, 0.4, 0.5, 1.5, 2.0, 2.5, 3.0, 3.5, 4.0) mass % or more P, Mo, B, and Si (preferably 0.12 (such as 0.13, 0.14, 0.15, 0.17, 0.2, 0.4, 0.5, 1.5, 2.0, 2.5, 3.0, 3.5, 4.0) mass % or more phosphorus), derived from ACE inhibitor compound(s), based upon the weight of the lubricating composition.

This invention relates to lubricating oil compositions comprising or resulting from the admixing of:

(i) from 1 to 99 mass % (alternately 30 to 95 mass %, alternately 50 to 90 mass %, alternately 60 to 95 mass %, alternately 70 to 90 mass %) of one or more base oils, based upon the weight of the lubricating composition;

(ii) from 0.10 to 20 mass % (in particular 0.15 to 10 mass %, alternately 0.20 mass % to 5 mass %, alternately 0.25 to 2 mass %), based upon the weight of the composition, of one or more detergents;

(iii) optionally, from 0.10 to 20 mass % (in particular 0.15 to 10 mass %, alternately 0.20 mass % to 5 mass %, alternately 0.25 to 2 mass %), based upon the weight of the composition, of one or more dispersants (such as PIBSA-PAM); and (iv) from 0.10 to 20 mass % (in particular 0.15 to 10 mass %, alternately 0.20 mass % to 5 mass %, alternately 0.25 to 2 mass %), based upon the weight of the composition, of one or more ACE inhibitor compound (s) (other than (ii) and (iii)) such as phosphorus containing compound(s), such as metal alkylthiophosphate (such as zinc dialkyl dithiophosphate);

(v) optionally, 0.2 to 0.6 mass % friction modifier (such as organic friction modifier, such as organic ester, such as fatty acid ester);

wherein said lubricating oil composition:

a) when combined with gasoline fuel having an octane number of 88 (Haltermann 88 octane reference fuel) completes at least 1 (such as at least 2, such as at least 3, such as at least 4, such as 4) iterations of 175,000 cycles per iteration, as determined by Sequence IX Test, ASTM D829; and b) is identified by the viscometric descriptor SAE 10W-X, 5W-X or SAE 0W-X (such as 5W-X or SAE 0W-X), where X is 8, 12, 16, 20, 30, 40 or 50 (such as 8, 12, 16, or 20); and c) comprises 0.09 (such as 0.10, 0.12, 0.15, 0.17, 0.2, 0.4, 0.5, 1.5, 2.0, 2.5, 3.0, 3.5, 4.0) mass % or more P, Mo, B, and Si (preferably 0.12 (such as 0.13, 0.14, 0.15, 0.17, 0.2, 0.4, 0.5, 1.5, 2.0, 2.5, 3.0, 3.5, 4.0) mass % or more phosphorus) derived from ACE inhibitor compound(s), based upon the weight of the lubricating composition (preferably where, when the ACE inhibitor compound comprises P, at least 80% of P is provided from metal alkylthiophosphate, such as zinc dialkyl dithiophosphate).

This invention relates to lubricating oil compositions comprising or resulting from the admixing of:

(i) from 1 to 99 mass % (alternately 30 to 95 mass %, alternately 50 to 90 mass %, alternately 60 to 95 mass %, alternately 70 to 85 mass %) of one or more base oils, based upon the weight of the lubricating composition;

(ii) from 0.10 to 20 mass % (in particular 0.15 to 10 mass %, alternately 0.20 mass % to 5 mass %, alternately 0.25 to 2 mass %), based upon the weight of the composition, of one or more detergents;

(iii) from 0.10 to 20 mass % (in particular 0.15 to 10 mass %, alternately 0.20 mass % to 5 mass %, alternately 0.25 to 2 mass %), based upon the weight of the composition, of one or more dispersant (such as PIBSA-PAM); and (iv) from 0.10 to 20 mass % (in particular 0.15 to 10 mass %, alternately 0.20 mass % to 5 mass %, alternately 0.25 to 2 mass %), based upon the weight of the composition, of one or more phosphorus containing compound(s), such as metal alkylthiophosphate (such as zinc dialkyl dithiophosphate);

(v) optionally, 0.2 to 0.6 mass % friction modifier (such as organic friction modifier, such as organic ester, such as fatty acid ester);

wherein said lubricating oil composition:

a) when combined with gasoline fuel having an octane number of 88 (Haltermann 88 octane reference fuel) completes at least 1 (such as at least 2, such as at least 3, such as at least 4, such as 4) iterations of 175,000 cycles per iteration, as determined by Sequence IX Test, ASTM D829; and b) is identified by the viscometric descriptor SAE 10W-X, 5W-X or SAE 0W-X (such as 5W-X or SAE 0W-X), where X is 8, 12, 16, 20, 30, 40 or 50 (such as 8, 12, 16, or 20); and c) comprises 0.12 (such as 0.13, 0.14, 0.15, 0.17, 0.2, 0.4, 0.5, 1.5, 2.0, 2.5, 3.0, 3.5, 4.0) mass % or more phosphorus derived from ACE inhibitor compound(s), based upon the weight of the lubricating composition, preferably where at least 80% of P is provided from metal alkylthiophosphate (such as zinc dialkyl dithiophosphate).

Alternately when the LOC is combined with gasoline fuel having an octane number of 88 (alternately 75, 76, 77, 78, 79, 80, 81, 82, 83, 84, 85, 86, or 87) the combination completes at least 1 (such as at least 2, such as at least 3, such as at least 4, such as 4) iterations of 175,000 cycles per iteration, as determined by Sequence IX Test, ASTM D829.

This invention also relates to lubricating oil compositions described above further comprising:

E) optionally, from 0.01 to 5 wt. % (in particular 0.01 to 3 mass %, alternately 0.1 to 1.5 mass %), based on total weight of the lubricating composition, of one or more antioxidants (such as blends of antioxidants);

F) optionally, from 0.01 to 5 wt. % (in particular 0.01 to 3 mass %, alternately 0.1 to 1.5 mass %), based on total weight of the lubricating composition, of one or more pour point depressants (such as blends of pour point depressants);

G) optionally, from 0.001 to 5 wt. % (in particular 0.01 to 3 mass %, alternately 0.1 to 1.5 mass %), based on total weight of the lubricating composition, of one or more anti-foam agents (such as blends of anti-foam agents);

H) optionally, from 0.001 to 6 wt. % (in particular 0.01 to 5 mass %, alternately 0.1 to 4 mass %, alternately 0.1 to 2 mass %, alternately 0.1 to 1 mass %), based on total weight of the lubricating composition, of one or more viscosity modifiers (such as blends of viscosity modifiers);

I) optionally, from 0.01 to 20 wt. % (in particular 0.1 to 12 mass %, alternately 0.1 to 8 mass %), based on total weight of the lubricating composition, of one or more dispersants (such as blends of dispersants);

J) optionally, from 0.01 to 5 wt. % (in particular 0.1 to 3 mass %, alternately 0.1 to 1.5 mass %), based on total weight of the lubricating composition, of one or more inhibitors and/or antirust agents (such as blends of inhibitors and/or antirust agents); and/or K) optionally, from 0.001 to 5 wt. % (in particular 0.1 to 3 mass %, alternately 0. to 1.5 mass %), based on total weight of the lubricating composition, of one or more anti-wear agents (such as blends of anti-wear agents) other than ACE inhibitor compound(s), where the lubricant:

a) when combined with gasoline fuel having an octane number of 88 (Haltermann 88 octane reference fuel) completes at least 1 (such as at least 2, such as at least 3, such as at least 4, such as 4) iterations of 175,000 cycles per iteration, as determined by Sequence IX Test, ASTM D829; and b) is identified by the viscometric descriptor SAE 10W-X, 5W-X or SAE 0W-X (such as 5W-X or SAE 0W-X), where X is 8, 12, 16, 20, 30, 40 or 50 (such as 8, 12, 16, or 20); and c) comprises 0.09 (such as 0.10, 0.12, 0.15, 0.17, 0.2, 0.4, 0.5, 1.5, 2.0, 2.5, 3.0, 3.5, 4.0) mass % or more P, B, Si and Mo (such as 0.12 (such as 0.13, 0.14, 0.15, 0.17, 0.2, 0.4, 0.5, 1.5, 2.0, 2.5, 3.0, 3.5, 4.0) mass % or more phosphorus) derived from ACE inhibitor compound(s), based upon the weight of the lubricating composition, preferably where, when the ACE inhibitor compound comprises P, at least 80% (such as 90%, such as 95%) of phosphorus is provided from metal alkylthiophosphate (such as zinc dialkyl dithiophosphate).

Alternately, when the LOC is combined with gasoline having an octane number of 88 (alternately 75, 76, 77, 78, 79, 80, 81, 82, 83, 84, 85, 86, or 87) the combination completes at least 1 (such as at least 2, such as at least 3, such as at least 4, such as 4) iterations of 175,000 cycles per iteration, as determined by Sequence IX Test, ASTM D829.

For purposes of this invention and the claims thereto, component B) ACE inhibitor compound(s) are not added in the elements C, D, E, F G, H, I, J, and/or K above for determining weight percentages, even though they may show similar properties, e.g., element B) may impact wear positively, but is not added into element K) for determining weight percent of anti-wear agents.

In embodiments, all of elements D, E, F G, H, I, J, and K are present in addition to the base oil, detergent, and the one or more ACE inhibitor compound(s) described herein.

In embodiments, elements D, E, F G, H, I, and J are present in addition to the base oil, detergent, and the one or more ACE inhibitor compound(s) described herein.

In embodiments, elements I, F, and G are present in addition to the base oil, detergent, and the one or more ACE inhibitor compound(s) described herein.

In embodiments, when metal alkylthiophosphate (such as zinc dialkyl dithiophosphate) is present in the lubricating oil composition or concentrate, the alkyl groups are independently one or more of $C_1$ to $C_{20}$ (such as $C_2$ to $C_{12}$, such as $C_3$ to $C_{10}$, such as $C_4$ to $C_8$) linear, branched or cyclic alkyl groups, such as linear or branched $C_1$ to $C_{20}$ (such as $C_2$ to $C_{12}$, such as $C_3$ to $C_{10}$, such as $C_4$ to $C_8$) alkyl groups, such as linear or branched $C_3$ to $C_8$ alkyl groups. The alkyl groups may be the same or different. The alkyl groups may be primary, secondary/and or tertiary, such as a combination of primary and secondary alkyl groups.

In embodiments, the ACE inhibitor compound(s) in the LOC or concentrate has low volatility, particularly under engine operating conditions.

In embodiments, the phosphorus containing compound (such as metal alkylthiophosphate, such as zinc dialkyl dithiophosphate) in the LOC or concentrate has low volatility, particularly under engine operating conditions.

Suitably, the lubricant composition may have an a phosphorus retention of 75% or more, such as 80% or more, such as 81% or more, such as 82% or more, such as 85% or more, such as 90% or more, such as 93% or more, such as 95% or more, alternately from 80 to 100%, such as 81 to 99%, such as 85 to 98%, such as 90 to 98%, such as 94 to 98% as measured by ASTM D8111-17, IIIHB. Phosphorus retention is not directly related to phosphorus content, thus is not a function of mass % P in a LOC. Phosphorus retention in an internal combustion engine is a multi-factorial parameter that is influenced by volatility/evaporation of the LOC, volatility of the phosphorus sources, engine temperature, oil consumption rate, oil leakage, seal integrity, and the like.

The term "high phosphorus containing lubricating oil composition" or "High P LOC" means lubricating oil compositions described herein having 0.09 such as 0.10, 0.12, 0.15, 0.17, 0.2, 0.24, 0.25, 0.3, 0.4, 0.5, 1.0, 1.5, 2.0, 2.5, 3.0, 3.5, 4.0) mass % or more P, derived from ACE inhibitor compound(s), based upon the mass of the lubricating oil composition. Typically the High P LOC has from 0.09 (such as 0.10, 0.12, 0.15, 0.17, 0.2, 0.4, 0.5, 1.5, 2.0, 2.5, 3.0, 3.5, or 4.0) to 10 (such as 9, 8, 7, 6, or 5) mass % P, derived from ACE inhibitor compound(s), based upon the mass of the lubricating oil composition.

Suitably, the lubricant composition may have:

1) an a phosphorus retention of 82% or more, such as 85% or more, such as 90% or more, such as 93% or more, such as 95% or more measured by ASTM D8111-17, IIIHB;
2) an SAE viscosity of SAE 10W-X, SAE 5W-X or SAE 0W-X, where X is 8, 12, 16, 20, or 30 (such as SAE 5W-X or SAE 0W-X, where X is 8, 12, 16, or 20); and
3) 0.12 (such as 0.15, 0.17, 0.2, 0.24, 0.25, 0.3, 0.35, 0.4, 0.5, 1.5, 2.0, 2.5, 3.0, 3.5, 4.0) mass % or more phosphorus content, derived from ACE inhibitor compound(s), based upon the weight of the LOC.

Suitably, the lubricant composition may have a total base number (TBN) of 1 to 30 mg KOH/g, such as 4 to 15 mg KOH/g, such as 5 to 15 mg KOH/g, such as 5 to 12 mg KOH/g, such as 7 to 11 mg KOH/g, such as 8 to 10 mg KOH/g, as measured by ASTM D2896.

Typically, the lubricating compositions may contain low levels of sulfur. Preferably, the lubricating composition contains up to 0.4, more preferably up to 0.3, most preferably up to 0.2, such as 0.1 to 0.4 mass % sulfur, expressed as atoms of sulfur, based on the total mass of the lubricating composition, as measured by ASTM D2622.

Typically, the lubricating compositions may contain low levels of sulfated ash, such as 1.0 mass % or less, preferably 0.8 or less mass %, alternately 0.0001 to 0.5 mass % sulfated ash, based on the total mass of the lubricating composition, as measured by ASTM D874.

In embodiments, the lubricating oil composition described herein has 1500 ppm or less of calcium, such as 1000 ppm or less, such as 500 ppm or less, such as 200 ppm or less calcium, such as 1 to 1500 ppm calcium, such as 10 to 1000 ppm calcium, such as 10 to 500 ppm calcium, such as 20 to less than 500 ppm such as 50 to 400 ppm calcium. While 0 ppm calcium is preferred, it is recognized that there may be inherent metal contamination in the production process for non-calcium based detergents.

In embodiments, the lubricating oil composition described herein has 1500 ppm or less of sodium, such as 1000 ppm or less, such as 500 ppm or less, such as 200 ppm or less sodium, such as 1 to 1500 ppm sodium, such as 10 to 1000 ppm sodium, such as 10 to 400 ppm sodium. While 0 ppm sodium is preferred, it is recognized that there may be inherent metal contamination in the production process for non-sodium based detergents.

In embodiments, the lubricating oil composition described herein comprises 1500 ppm or less of calcium and sodium, 1000 ppm or less, such as 500 ppm or less, such as 1 to 250 ppm, such as from 10 to 200 ppm calcium and sodium.

Generally, the kinematic viscosity at 100° C. ("$KV_{100}$") of the lubricating composition ranges from 2 to 30 cSt, such as 3 to 20 cSt, such as 3.5 to 17 cSt, such as 3.8 to 13 cSt as determined according to ASTM D 445-19a). Alternately, the kinematic viscosity at 100° C. ("$KV_{100}$") of the lubricating composition ranges from 2 to 10 cSt, such as 3 to 9 cSt, such as 3.3 to 7 cSt.

In embodiments, the lubricating oil composition described herein has a $KV_{100}$ (ASTM D 445-19a) of 2 to 10 cSt (such as 3 to 9 cSt, such as 3.3 to 7 cSt) at the TAN/TBN crossover. The TAN/TBN crossover is defined to be the point at which the total acid number (TAN, as determined by ASTM D664) of a lubricant in a crankcase becomes lower than the total base number (TBN, as determined by ASTM D2896).

In embodiments, the lubricating oil composition is absent tetraethyl lead. Alternately, tetraethyl lead is present at 10 ppm or less, such as 5 ppm or less, such as 1 ppm or less, such as 0 ppm. Alternately if tetraethyl lead is present in the lubricating oil composition the tetraethyl lead is present at levels that do not impact the lubricating oil composition properties.

In embodiments, the lubricating oil composition described herein has a TCO (turbo coolant outside) Temperature Increase of less than 9.0% (such as less than 8.0%, such as less than 7.0%, such as less than 5.0%) as measured using the 2015 version of the General Motors dexos1™ Turbocharger Coking Test (as described in WO 2017/192217, which is incorporated by reference herein %. See paragraphs [0005], [0165]-[0166]).

In embodiments, the lubricating oil composition described herein has an average of less than 2 peak pressure events and less than 3 LSPI events as determined by Sequence IX Test, ASTM D829, using Haltermann 88 octane reference fuel.

In embodiments, the lubricating oil composition has an average of less than 2, less than 1, preferably 0 peak pressure events as determined by Sequence IX Test, ASTM D829, using Haltermann 93 octane reference fuel.

Preferably, the lubricating composition of the present invention is a multigrade oil identified by the viscometric descriptor SAE 10W-X, SAE 5W-X or SAE 0W-X, where X represents any one of 8, 12, 16, 20, 30, 40 and 50; the characteristics of the different viscometric grades can be found in the SAE J300 classification. The lubricating composition is preferably in the form of an SAE 5W-X or SAE 0W-X, wherein X represents any one of 8, 12, 16, 20, 30, 40 and 50. Preferably X is 8, 12, 16 or 20. Alternately, the lubricating composition of the present invention is a multigrade oil identified by the viscometric descriptor SAE 5W-X or SAE 0W-X, where X represents is 8, 12, 16, or 20. (See standard SAE J300 published by SAE International, formerly known as Society of Automotive Engineers.)

A three-wav catalyst converts exhaust gas pollutants into $H_2O$ $N_2$, and $CO_2$ typically by providing a first catalytic bed containing rhodium followed by a second catalytic bed containing platinum or palladium. In embodiments, the lubricating oil composition described herein provides reduced 3-way catalytic converter fatigue, preferably by using an oil with high phosphorus retention of 75% or more, such as 80% or more, such as 81% or more, such as 82% or more, such as 85% or more, such as 90% or more, such as 93% or more, such as 95% or more, alternately from 80 to 100%, such as 81 to 99%, such as 85 to 98%, such as 90 to 98%, such as 94 to 98% as measured by ASTM D8111-17, IIIHB.

The lubricating compositions of the invention may be used to lubricate mechanical engine components, particularly in internal combustion engines, e.g. spark-ignited, compression-ignited (such as compression ignited two- or four-stroke reciprocating engines), and or spark assisted compression ignited internal combustion engines by adding the lubricant thereto. Typically, they are crankcase lubricants such as passenger car motor oils or heavy duty diesel engine lubricants.

In particular, the lubricating compositions of the present invention are suitably used in the lubrication of the crankcase of a compression-ignited internal combustion engine, such as a heavy duty diesel engine.

In particular, the lubricating compositions of the present invention are suitably used in the lubrication of the crankcase of a spark-ignited turbo charged internal combustion engine.

The lubricating oils of this disclosure are particularly useful in high compression spark ignition internal combustion engines and, when used in high compression spark ignition internal combustion engines, will prevent or minimize engine knocking and pre-ignition problems. The lubricating oil compositions of this disclosure are useful in lubricating high compression spark ignition engines, particularly those using with e-fuels and/or co-blended fuels.

In embodiments, the inventive lubricating oil compositions described herein, when used in combination with a gasoline having an octane number of 92 or less, such as 90 or less such as 88 or less such as 87 or less, such as 87 octane number, provide at least a 20% or more increase in weighted average spark advance (determined as show in the example section below), such as a 23% or more increase, such as a 45% or more increase, such as a 58% or more increase, such as a 76% or more increase, such as a 1000% or more increase, such as a 104% or more increase, such as a 105% or more increase, such as 111% or more increase, particularly at mass airflow rates of 45 g/s or more, such as 46 g/s or more, such as 47 g/s or more, such as 48 g/s or more, such as 50 g/s or more, such as 51 g/s or more, such as 52 g/s or more, such as 53 g/s or more, as compared to the weighted average spark advance in the same engine, operating under the same conditions, except that the lubricating oil contains less than 1200 ppm (such as 1100 ppm or less, 1000 ppm or less, 900 ppm or less, 800 ppm or less) phosphorus (and preferably also has more than 500 ppm Ca and Na, and/or less than 1200 ppm Mg, such as less than 800 ppm Mg).

In embodiments, the inventive lubricating oil compositions described herein, when used in combination with a gasoline having an octane number of about 87 octane number, provide at least a 20% or more increase in weighted average spark advance (determined as show in the example section below) at 43 g/s or more mass airflow, such as a 23% or more increase at 45 g/s or more mass airflow, such as a 45% or more increase at 46 g/s or more mass airflow, such as a 58% or more increase at 47 g/s or more mass airflow, such as a 76% or more increase at 48 g/s or more mass airflow, such as a 100% or more increase at 50 g/s or more mass airflow, such as a 104% or more increase at 51 g/s or more mass airflow, such as a 104% or more increase at 52 g/s or more mass airflow, such as 111% or more increase at 53 g/s or more mass airflow as compared to the weighted average spark advance in the same engine, operating under the same conditions, except that the lubricating oil contains less than 1200 ppm (such as 1100 ppm or less, 1000 ppm or less, 900 ppm or less, 800 ppm or less, 750 ppm or less) phosphorus (and preferably also has more than 500 ppm Ca and Na, and/or less than 1200 ppm Mg, such as less than 800 ppm Mg).

In embodiments, the inventive lubricating oil compositions described herein, when used in combination with a gasoline having an octane number of 90 or more, such as 91 or more such as 92 or more such as 93 or more, provide at least a 17% or more increase in weighted average spark advance (determined as show in the example section below), such as a 27% or more increase, such as a 44% or more increase, such as a 47% or more increase, such as a 54% or more increase, such as a 54% or more increase, particularly at mass airflow rates of such as 47 g/s or more, such as 48 g/s or more, such as 50 g/s or more, such as 51 g/s or more, such as 52 g/s or more, such as 53 g/s or more as compared to the weighted average spark advance in the same engine, operating under the same conditions, except that the lubricating oil contains less than 1200 ppm (such as 1100 ppm or less, 1000 ppm or less, 900 ppm or less, 800 ppm or less, 750 ppm or less) phosphorus (and preferably also has more than 500 ppm Ca and Na, and/or less than 1200 ppm Mg, such as less than 800 ppm Mg).

In embodiments, the inventive lubricating oil compositions described herein, when used in combination with a gasoline having an octane number of about 93, provide at least a 17% or more increase in weighted average spark advance (determined as show in the example section below) at mass airflow rates of 47 g/s or more, such as a 27% or more increase at mass airflow rates of 48 g/s or more, such as a 44% or more increase at mass airflow rates of 50 g/s or more, such as a 47% or more increase at mass airflow rates of 51 g/s or more, such as a 54% or more increase at mass airflow rates of 52 g/s or more, such as a 54% or more increase at mass airflow rates of 53 g/s or more, as compared to the weighted average spark advance in the same engine, operating under the same conditions, except that the lubricating oil contains less than 1200 ppm (such as 1100 ppm or less, 1000 ppm or less, 900 ppm or less, 800 ppm or less, 750 ppm or less) phosphorus (and preferably also has more than 500 ppm Ca and Na, and/or less than 1200 ppm Mg, such as less than 800 ppm Mg).

In embodiments, the inventive lubricating oil compositions described herein, when used with an 87 octane fuel in an engine with an 93 octane fuel rating operating at 1700 rpm and at least 45 g/s mass airflow provides at least 23% higher weighted average spark advance than the weighted average spark advance in the same engine, operating under the same conditions, except that the lubricating oil composition contains less than 1200 ppm phosphorus, such as 1150 ppm or less, 1100 ppm or less, 1000 ppm or less, 900 ppm or less, 850 ppm or less, 800 ppm or less, such as 750 ppm or less phosphorus (and preferably also has more than 500 ppm Ca and Na, and/or less than 1200 ppm Mg, such as less than 800 ppm Mg).

In embodiments, the inventive lubricating oil compositions described herein, when used with an 93 octane fuel in an engine with an 93 octane fuel rating operating at 1700 rpm and at least 45 g/s mass airflow provides at least 17% higher weighted average spark advance than the weighted average spark advance in the same engine, operating under the same conditions, except that the lubricating oil composition contains less than 1200 ppm phosphorus, such as 1150 ppm or less, 1100 ppm or less, 1000 ppm or less, 900 ppm or less, 850 ppm or less, 800 ppm or less, such as 750 ppm or less phosphorus (and preferably also has more than 500 ppm Ca and Na, and/or less than 1200 ppm Mg, such as less than 800 ppm Mg).

Concentrates

A concentrate, also referred to as an additive package, is a composition having less than 50 mass % (such as less than 40%, such as less than 30 mass %, such as less than 25%, such as less than 20%) base oil) which is typically then further blended with further base oil to form a lubricating oil product.

This invention relates to concentrate compositions comprising or resulting from the admixing of:

(i) from 1 to less than 50 mass % (alternately 5 to 45 mass %, alternately 7 to 40 mass %, alternately 10 to 35 mass %, alternately 10 to 25 mass %), based upon the weight of the composition, of one or more base oil(s);

(ii) from 0.10 to 40 mass % (in particular 0.10 to 20 mass %, alternately 0.15 to 10 mass %, alternately 0.20 mass % to 5 mass %, alternately 0.25 to 2 mass %), based upon the weight of the composition, of one or more detergent(s);

(iii) from 0.10 to 40 mass % (in particular 0.10 to 20 mass %, alternately 0.15 to 10 mass %, alternately 0.20 mass % to 5 mass %, alternately 0.25 to 2 mass %), based upon the weight of the composition, of one or more dispersant(s) (such as PIBSA-PAM); and (iv) from 0.10 to 40 mass % (in particular 0.10 to 20 mass %, alternately 0.15 to 10 mass %, alternately 0.20 mass % to 5 mass %, alternately 0.25 to 2 mass %), based upon the weight of the composition, of one or more ACE inhibitor compound(s) (other than (ii) and (iii)) such as phosphorus containing compound(s), such as metal alkylthiophosphate (such as ZDDP);

(v) optionally, 0.10 to 20 mass % (in particular 0.15 to 10 mass %, alternately 0.2 to 5 mass %), based upon the weight of the composition, of one or more friction modifier(s) (such as organic FM, such as organic ester, such as fatty acid ester);

(vi) optional additional components, anti-oxidants, pour point depressants, anti-foam agents, viscosity modifiers, corrosion inhibitors, anti-wear agents, extreme pressure additives, demulsifiers, seal compatibility agents, additive diluent base oils, etc.;

wherein said concentrate composition comprises 0.09 (such as 0.10, 0.12, 0.15, 0.17, 0.2, 0.4, 0.5, 1.5, 2.0, 2.5, 3.0, 3.5, 4.0, or 5.0) mass % or more P, Mo, B, and Si, preferably 0.09 (such as 0.10, 0.12, 0.15, 0.17, 0.2, 0.4, 0.5, 1.5, 2.0, 2.5, 3.0, 3.5, 4.0 or 5.0) mass % or more phosphorus, derived from ACE inhibitor compound(s), based upon the weight of the lubricating composition, preferably where at least 80% of P is provided from metal alkylthiophosphate (such as ZDDP).

This invention also relates to concentrate compositions comprising or resulting from the admixing of:

A) from 1 to less than 50 mass % (alternately 5 to 45 mass %, alternately 7 to 40 mass %, alternately 10 to 35 mass %, alternately 10 to 25 mass %), based upon the weight of the concentrate composition, of one or more base oil(s);

B) from 0.10 to 40 mass % (in particular 0.10 to 20 mass %, alternately 0.15 to 10 mass %, alternately 0.20 mass % to 5 mass %, alternately 0.25 to 2 mass %), based upon the weight of the concentrate composition, of one or more ACE inhibitor compound(s), preferably phosphorus containing compound(s), such as metal alkylthiophosphate (such as ZDDP);

C) from 40 mass % (in particular 0.10 to 20 mass %, alternately 0.5 to 8 mass %), based on total weight of the concentrate composition, of one or more detergent (s) (such as blends of detergents);

D) optionally, from 0.01 to 10 wt. % (in particular, alternately 0.01 to 5 wt %, alternately 0.1 to 4 mass %, alternately 0.25 to 3 mass %), based on total weight of the concentrate composition, of one or more friction modifier(s) (such as blends of friction modifiers);

E) optionally, from 0.01 to 5 wt. % (in particular 0.01 to 3 mass %, alternately 0.1 to 1.5 mass %), based on total weight of the concentrate composition, of one or more antioxidant(s) (such as blends of antioxidants);

F) optionally, from 0.01 to 5 wt. % (in particular 0.01 to 3 mass %, alternately 0.1 to 1.5 mass %), based on total weight of the concentrate composition, of one or more pour point depressants (such as blends of pour point depressants);

G) optionally, from 0.001 to 5 wt. % (in particular 0.01 to 3 mass %, alternately 0.1 to 1.5 mass %), based on total weight of the concentrate composition, of one or more anti-foam agents (such as blends of anti-foam agents);

H) optionally, from 0.001 to 6 wt. % (in particular 0.01 to 5 mass %, alternately 0.1 to 4 mass %, alternately 0.1 to 2 mass %, alternately 0.1 to 1 mass %), based on total weight of the concentrate composition, of one or more viscosity modifiers (such as blends of viscosity modifiers);

I) optionally, from 0.01 to 20 wt. % (in particular 0.1 to 12 mass %, alternately 0.1 to 8 mass %), based on total weight of the concentrate composition, of one or more dispersants (such as blends of dispersants);

J) optionally, from 0.01 to 5 wt. % (in particular 0.1 to 3 mass %, alternately 0.1 to 1.5 mass %), based on total weight of the concentrate composition, of one or more inhibitors and/or antirust agents (such as blends of inhibitors and/or antirust agents); and/or K) optionally, from 0.001 to 5 wt. % (in particular 0.1 to 3 mass %, alternately 0. to 1.5 mass %), based on total weight of the lubricating composition, of one or more anti-wear agents (such as blends of anti-wear agents) other than ACE inhibitor compound(s), where the concentrate comprises 0.09 (such as 0.10, 0.12, 0.15, 0.17, 0.2, 0.4, 0.5, 1.5, 2.0, 2.5, 3.0, 3.5, 4.0) mass % or more P, B, Si and Mo (preferably the concentrate comprises 0.09 (such as 0.10, 0.12, 0.15, 0.17, 0.2, 0.4, 0.5, 1.5, 2.0, 2.5, 3.0, 3.5, 4.0) mass % or more phosphorus, derived from ACE inhibitor compound(s), based upon the weight of the lubricating composition, preferably where at least 80% (such as 90%, such as 95%) of phosphorus is provided from metal alkylthiophosphate (such as zinc dialkyl dithiophosphate).

Lubricant/Fuel Combinations Present in an Engine During Combustion

The lubricants herein can be used in internal combustion engines utilizing hydrocarbon and or hydrogen fuels, whether from renewable or petroleum sources, or both.

A fuel or fuel product is defined herein as a product suitable for use as a fuel either directly or after optional further processing. Petroleum fuels include materials refined from crude oil, such as gasoline and diesel fuels. Hydrogen fuels include compressed hydrogen, and combinations of hydrogen with other fuels, such as natural gas, such as liquified natural gas.

An e-fuel or renewable fuel is a fuel derived from renewable sources, such as biomass, carbon dioxide, water, hydrogen, and the like, with or without the use of renewable energy (such as electricity, sunlight, wind, geothermal, water, etc.) or other energy input (such as petroleum derived energy, etc.). Ethanol and hydrogen are examples of e-fuels.

Generation of fuels from renewable sources is an area of increasing interest for supplementing and/or replacing conventional fossil fuels. Currently, many fuels generated from renewable sources (such as biological sources) are oxygenated fuels such as ethanol, which are intended to supplement the fuel pool for gasoline powered engines. An increasing amount of diesel fuel based on renewable sources (such as biological sources) is also being generated. Fuels, lubricants, and other products from renewable sources (such as biological sources) are based in part on carbon, hydrogen, and/or energy captured from the environment. Such fuels, lubricants, and other products are sometimes referred to as renewable.

This invention also relates to compositions comprising the lubricating oil compositions described herein and a hydrocarbon fuel, wherein the fuel may be derived from petroleum and/or an e-fuel (such as from biological sources ("biofuel")). In embodiments, the fuel comprises from 0.1 to 100 mass % renewable fuel, alternately from 1 to 75 mass % renewable fuel, alternately from 5 to 50 mass % renewable fuel, based upon the total mass of the from 1 to 50 mass % renewable fuel and the petroleum derived fuel.

The renewable fuel component may be produced from vegetable oil (such as palm oil, rapeseed oil, soybean oil, jatropha oil), microbial oil (such as algae oil), animal fats (such as cooking oil, animal fat, and/or fish fat) and or biogas. Renewable fuel refers to biofuel produced from biological resources formed through contemporary biological processes. In an embodiment, the renewable fuel component is produced by means of a hydrotreatment process. Hydrotreatment involves various reactions where molecular hydrogen reacts with other components, or the components undergo molecular conversions in the presence of molecular hydrogen and a solid catalyst. The reactions include, but are not limited to, hydrogenation, hydrodeoxygenation, hydrodesulfurization, hydrodenitrification, hydrodemetallization, hydrocracking, and isomerization. The renewable fuel component may have different distillation ranges which provide the desired properties to the component, depending on the intended use.

Figure 2:
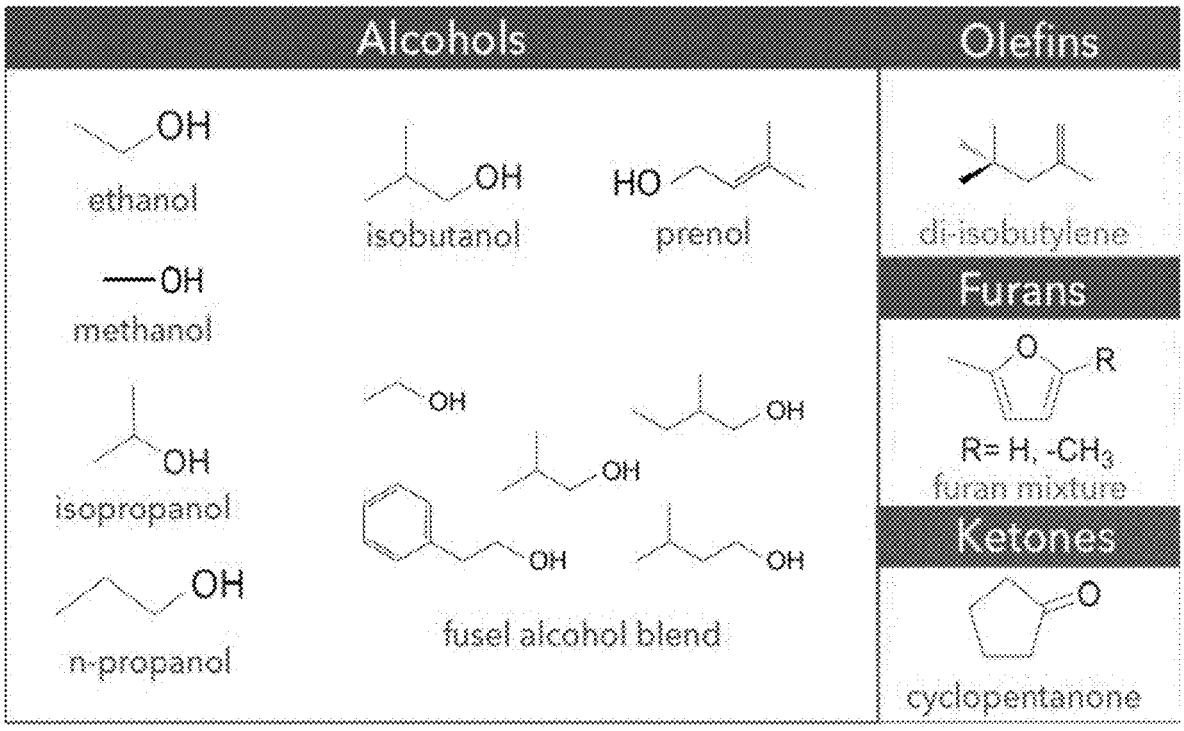
FIG. 2 (FIG. 2) is a drawing of useful fuel blending products.
Figure 2:
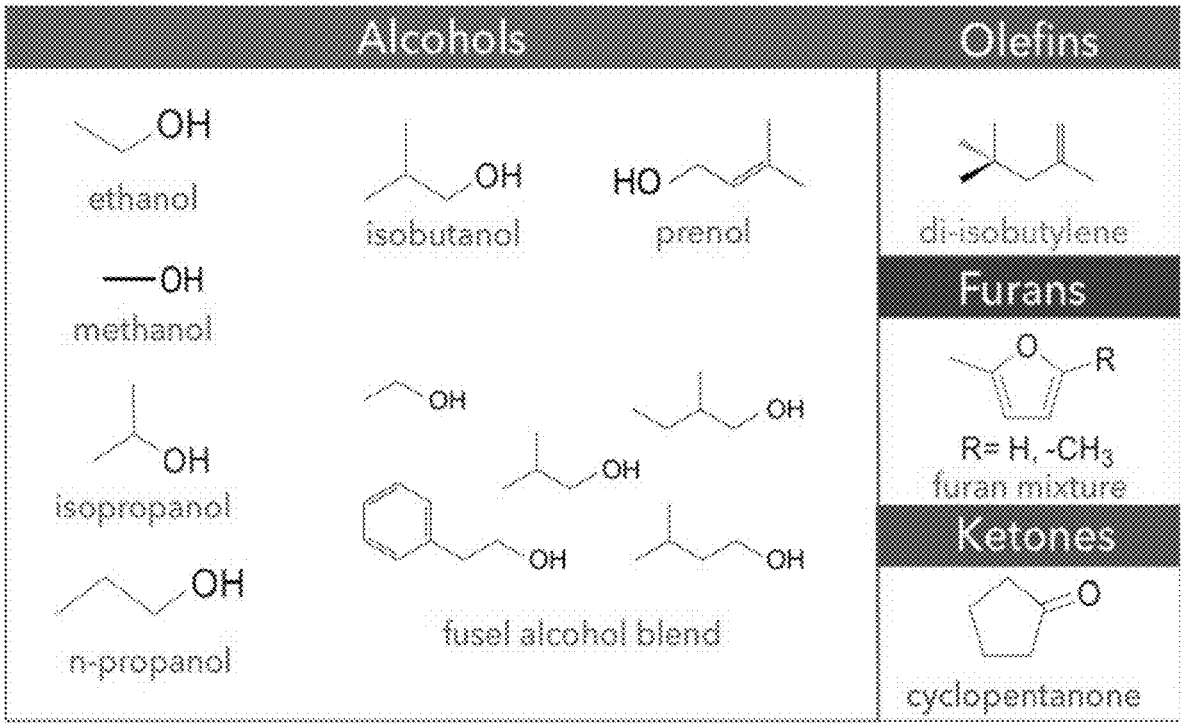
Figure 3:
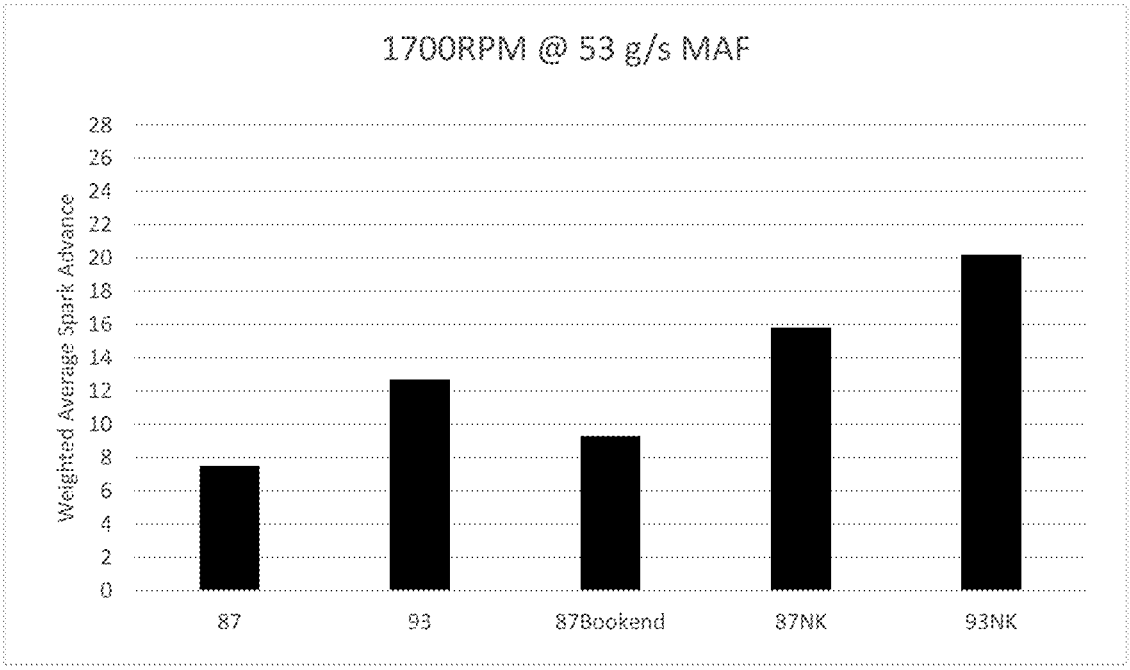
FIG. 3 (FIG. 3) is an illustration of weighted average spark advance data from Example 3 at 1700 rpm, 53 g/s mass airflow.

A fuel blending product is defined herein as a product suitable for blending into a fuel either directly or after optional further processing. Examples of fuel blending products include one or more biofuels/renewable fuels, di-isobutylene, a furan mixture as shown in FIG. 2, cyclopentanone, ethanol, methanol, a fusel alcohol blend as shown in FIG. 2, prenol, isobutanol, n-propanol, and isopropanol, preferably di-isobutylene, ethanol, a fusel alcohol blend, isobutanol, n-propanol, and isopropanol. A useful fuel alcohol blend comprises a combination of ethanol, isobutanol, 2-methyl-1-butanol, ethanol benzene, 3-methyl-1-butanol. A useful furan blend comprises dimethyl furan and methyl furan.

References to a fuel or fuel blending product correspond to a product that satisfies the definition for at least one of a fuel product or a fuel blending product. Note that a fuel product or fuel blending product does not have to be used as a fuel product or fuel blending product to satisfy this definition. Instead, this definition identifies products that are suitable as a fuel product or fuel blending product. For example, ethanol is suitable for use as a fuel product or a fuel blending product, such as by use as a fuel blending product for gasoline. Ethanol is also suitable for other purposes, such as facilitating extraction of products. According to the definition herein, such ethanol is considered a fuel or fuel blending product even though it is used for a different purpose.

A co-blended fuel is a petroleum fuel, such as natural gas, gasoline, or diesel fuel, that has been combined with up one or more fuel blending products (such those shown in FIG. 2) derived from non-petroleum based sources, i.e., renewable sources such as biomass, carbon dioxide, water, hydrogen, methane, and the like.

An e-fuel can also or alternately be used as a fuel blending product. Useful e-fuels include ethanol or other e-fuels derived from renewable sources, such as biomass, carbon dioxide, water, hydrogen, and the like, with or without the use of renewable energy (such as electricity, sunlight, wind, geothermal, water, etc.) or other energy input (such as petroleum derived energy, etc.).

A particularly useful co-blended fuel is a combination of compressed natural gas and compressed hydrogen.

A co-blended fuel may contain one or more petroleum fuels and 1 (such as 5, such as 10, such as 15, such as 20, such as 25, such as 30, such as 40, such as 50, such as 60, such as 70, such as 75, such as 80, such as 90, such as 95, such as 99) mass % or more of one or more e-fuels and/or fuel blending products, based upon the weight of the petroleum fuels, fuel blending products, and the e-fuels.

In embodiments, a co-blended fuel contains one or more petroleum fuels and 1 (such as 5, such as 10, such as 15, such as 20, such as 25, such as 30, such as 40, such as 50, such as 60, such as 70, such as 75, such as 80, such as 90, such as 95, such as 99) mass % or more of two or more e-fuels and/or fuel blending products, based upon the weight of the petroleum fuels, fuel blending products and the e-fuels.

In embodiments, a co-blended fuel contains one or more petroleum fuels and 1 (such as 5, such as 10, such as 15, such as 20, such as 25, such as 30, such as 40, such as 50, such as 60, such as 70, such as 75, such as 80, such as 90, such as 95, such as 99) mass % or more of one, two, three, four, five, six or more e-fuels and/or fuel blending products, based upon the weight of the petroleum fuels, fuel blending products and the e-fuels.

In embodiments, a co-blended fuel contains:

1) 1 (such as 5, such as 10, such as 15, such as 20, such as 25, such as 30, such as 40, such as 50, such as 60, such as 70, such as 75, such as 80, such as 90, such as 95, such as 99) mass % or more of one or more petroleum fuels,
2) 1 (such as 5, such as 10, such as 15, such as 20, such as 25, such as 30, such as 40, such as 50, such as 60, such as 70, such as 75, such as 80, such as 90, such as 95, such as 99) mass % or more of one or more fuel blending products selected from the group consisting of di-isobutylene, cyclopentanone, ethanol, methanol, prenol, isobutanol, n-propanol, isopropanol, 2-methyl-1-butanol, ethanol benzene, 3-methyl-1-butanol, dimethyl furan, methyl furan, and mixtures thereof (Examples of preferred fuel blending products include di-isobutylene, methanol, ethanol, isobutanol, n-propanol, isopropanol, a fusel alcohol blend of ethanol, isobutanol, 2-methyl-1-butanol, ethanol benzene, 3-methyl-1-butanol, and a furan blend of dimethyl furan and methyl furan), based upon the weight of the petroleum fuels and fuel blending products.

In embodiments, a co-blended fuel contains:

1) 1 (such as 5, such as 10, such as 15, such as 20, such as 25, such as 30, such as 40, such as 50, such as 60, such as 70, such as 75, such as 80, such as 90, such as 95, such as 99) mass % or more of one or more petroleum fuels,
2) 1 (such as 5, such as 10, such as 15, such as 20, such as 25, such as 30, such as 40, such as 50, such as 60, such as 70, such as 75, such as 80, such as 90, such as 95, such as 99) mass % or more of one or more e fuels;
3) 1 (such as 5, such as 10, such as 15, such as 20, such as 25, such as 30, such as 40, such as 50, such as 60, such as 70, such as 75, such as 80, such as 90, such as 95, such as 99) mass % or more of one or more fuel blending products selected from the group consisting of di-isobutylene, cyclopentanone, ethanol, methanol, prenol, isobutanol, n-propanol, isopropanol, 2-methyl-1-butanol, ethanol benzene, 3-methyl-1-butanol, dimethyl furan, methyl furan and mixtures thereof, based upon the weight of the petroleum fuels and fuel blending products. (Examples of preferred fuel blending products include di-isobutylene, methanol, ethanol, isobutanol, n-propanol, isopropanol, a fusel alcohol blend of ethanol, isobutanol, 2-methyl-1-butanol, ethanol benzene, 3-methyl-1-butanol, and a furan blend of dimethyl furan and methyl furan.) For purposes this specification and the claims thereto, when e-fuels and fuel blending products are itemized separately in a description of a composition, such as in the above paragraph, and when a component that can be characterized as both e-fuel and fuel blending product (such as ethanol) is present, then the component shall be considered an e-fuel if it is present at 20 mass % or more, based upon the weight of the petroleum fuels, fuel blending products and the e-fuels, and shall be considered a fuel blending product if present at less than 20 mass %, based upon the weight of the petroleum fuels, fuel blending products and the e-fuels.

In embodiments, a co-blended fuel contains:

1) 1 (such as 5, such as 10, such as 15, such as 20, such as 25, such as 30, such as 40, such as 50, such as 60, such as 70, such as 75, such as 80, such as 90, such as 95, such as 98) mass % or more of one or more petroleum fuels,
2) 1 (such as 5, such as 10, such as 15, such as 20, such as 25, such as 30, such as 40, such as 50, such as 60, such as 70, such as 75, such as 80, such as 90, such as 95, such as 98) mass % or more of a first e-fuel or fuel blending product (such as ethanol), and
3) 1 (such as 5, such as 10, such as 15, such as 20, such as 25, such as 30, such as 40, such as 50, such as 60, such as 70, such as 75, such as 80, such as 90, such as 95, such as 98) mass % or more of a second e-fuel or fuel blending product, based upon the weight of the petroleum fuels, fuel blending products and the e-fuels.

In embodiments, a petroleum fuel useful in combination with the lubricants herein (alone or in a co-blended fuel) is a gasoline fuel having an octane number of 84 or more, 85 or more, such as 88 or more, such as 90 or more, such as 91 or more, such as 92 or more, such as 93 or more, where octane number is determined according to ASTM D2700-21. Alternately, In embodiments, a petroleum fuel useful in combination with the lubricants herein (alone or in a co-blended fuel) is a gasoline fuel having an octane number of 90 or less, such as a 89 or less, such as 88 or less, such as 87 or less, such as 86 or less, where octane number is determined according to ASTM D2700-21.

In embodiments, a petroleum fuel useful in combination with the lubricants herein (alone or in the co-blended fuel) is a diesel fuel having a cetane number of 40 or more, such as 48 or more, such as 50 or more, such as 40 to 60, such as 45-55, such as 50 to 55, where cetane number is determined according to ASTM D613. Alternately, In embodiments, a petroleum fuel useful in combination with the lubricants herein (alone or in a co-blended fuel) is a diesel fuel having a cetane number of 60 or less, such as 55 or less, such as 50 or less, such as 45 or less where cetane number is determined according to ASTM D613.

In embodiments, the fuel for an internal combustion engine, such as a spark ignited internal combustion engine, can contain up to 100% hydrogen.

Methods to Reduce ACE

This invention also relates to a method of lubricating an automotive internal combustion engine during operation of the engine comprising:

(i) providing the lubricating composition described herein to a crankcase of the automotive internal combustion engine;
(ii) providing a hydrocarbon fuel, such as a petroleum fuel, a co-blended fuel and/or an e-fuel, in the automotive internal combustion engine; and
(iii) combusting the fuel in the automotive internal combustion engine, such as a spark-ignited or compression-ignited two- or four-stroke reciprocating engine, such as a diesel engine or passenger car engine (such as a spark-ignited combustion engine, such as a such as a spark-ignited boosted direct gasoline injected combustion engine).

This invention relates to methods of lubricating an automotive internal combustion engine during operation of an internal combustion engine comprising:

(i) providing to a crankcase of the automotive internal combustion engine an automotive crankcase the lubricating composition described herein;
(ii) providing a hydrocarbon fuel (petroleum fuel and/or e-fuel with optional fuel blending product as described above) in the automotive internal combustion engine; and
(iii) combusting the fuel in the automotive internal combustion engine.

In embodiments the fuel comprises one or more fuel blending product.

In embodiments the engine has compression ratio of 8:1 or more and air:fuel ratio of less than 1.0:1.

In embodiments the engine is an automotive internal combustion diesel engine or a spark ignited turbocharged engine.

In embodiments the engine is a high compression spark ignition engine and has a compression ratio of at least 11:1.

In embodiments the fuel is a petroleum fuel having an octane number of 93 or more, the engine is a high compression spark ignition engine and the engine has a compression ratio of at least 14:1.

In embodiments the high compression spark ignition engine is a super-charged engine or a turbo-charged engine.

As indicated herein, the lubricating oil formulations described herein are particularly useful in high compression spark ignition engines and, when used in the high compression spark ignition engines, will prevent or minimize engine knocking and pre-ignition problems. The high compression spark ignition engines include, for example, super-charged engines and turbo-charged engines, particularly those using co-blended fuels. The high compression spark ignition engines have a compression ratio of at least about 11, preferably at least about 13, and more preferably at least about 15.

This invention further relates to a method to reduce abnormal combustion events in the operation of an internal combustion engine comprising:

(i) providing a lubricating oil composition to the crankcase of an internal combustion engine;
(ii) providing fuel to the internal combustion engine; and
(iii) combusting the fuel in the internal combustion engine;

wherein:

1) the lubricating oil composition comprises or results from the admixing of:
   (i) 50 mass % or more of base oil,
   (ii) detergent providing at least 800 ppm Mg (such as at least 1200 ppm Mg) and less preferably than 500 ppm Ca; and
   (iii) abnormal combustion event inhibitor compound(s) comprising at least one phosphorus containing compound providing greater than 0.12 mass % phosphorus, based upon the weight of the lubricating oil composition;
2) said lubricating oil composition is identified by the viscometric descriptor SAE 0W-X, SAE 5W-X, or SAE 10W-X, where X is 8, 12, 16, 20, or 30; and
3) when said lubricating oil composition is used with fuel having an octane number of 88, the combination completes at least 1 iteration of 175,000 cycles per iteration, as determined by Sequence IX Test, ASTM D829.

This invention relates a method to reduce abnormal combustion events in the operation of an internal combustion engine comprising:

(i) providing a lubricating oil composition to the crankcase of an internal combustion engine;
(ii) providing fuel to the internal combustion engine; and
(iii) combusting the fuel in the internal combustion engine;

wherein:

1) the lubricating oil composition comprises or results from the admixing of:
   (i) 50 mass % or more of base oil,
   (ii) detergent (such as detergent providing at least 800 ppm (such as at least 1500 ppm) Mg);
   (iii) one or more abnormal combustion event inhibitors comprising a phosphorus containing compound, optionally one or more of B, Si, and or Mo containing compounds, where abnormal combustion event inhibitors provide at least 1200 ppm P;
2) said lubricating oil composition is identified by the viscometric descriptor SAE 10W-X, SAE 5W-X or SAE 0W-X, where X is 8, 12, 16, 20, or 30;
3) the fuel comprises co-blended fuel, preferably the co-blended fuel comprises hydrocarbon or hydrogen fuel blended with one or more of ethanol, methanol, isopropanol, isobutanol, n-propanol, prenol, dimethyl furan, methyl furan, cyclopentanone, 2-methyl-1-butanol, ethanol benzene, and 3-methyl-1-butanol.

This invention relates to a method to reduce abnormal combustion events in the operation of an internal combustion engine comprising:

(i) providing a lubricating oil composition to the crankcase of an internal combustion engine;
(ii) providing fuel to the internal combustion engine; and
(iii) combusting the fuel in the internal combustion engine;

wherein:

1) the lubricating oil composition comprises or results from the admixing of:
   (i) 50 mass % or more of base oil,
   (ii) detergent (such as detergent providing at least 800 ppm (such as at least 1500 ppm) Mg);
   (iii) one or more abnormal combustion event inhibitors comprising a phosphorus containing compound, optionally one or more of B, Si, and or Mo containing compounds, where abnormal combustion event inhibitors provide at least 1200 ppm P;
2) said lubricating oil composition is identified by the viscometric descriptor SAE 10W-X, SAE 5W-X or SAE 0W-X, where X is 8, 12, 16, 20, or 30;
3) the internal combustion engine is a spark ignited internal combustion engine;
4) the fuel has an octane number that is at least 1 (such as at least 2, such as at least 3, such as at least 4, such as at least 5) octane number less than the internal combustion engine's minimum fuel octane rating.

This invention relates to a method to reduce abnormal combustion events in the operation of an internal combustion engine comprising:

(i) providing a lubricating oil composition to the crankcase of an internal combustion engine;
(ii) providing fuel to the internal combustion engine; and
(iii) combusting the fuel in the internal combustion engine;

wherein:

1) the lubricating oil composition comprises or results from the admixing of:
   (i) 50 mass % or more of base oil,
   (ii) detergent containing Mg compounds, said detergent providing at least 800 ppm (such as at least 1500 ppm) Mg (preferably having reduced or absent (such as 500 ppm or less) Ca and Na compounds);
   (iii) one or more abnormal combustion event inhibitors comprising one or more of B, P, Si, and or Mo containing compounds (such as one or more phosphorus compounds, such as one or more phosphorus compounds providing greater than 0.12 mass % (such as greater than 0.24 mass %) phosphorus, based upon the weight of the lubricating oil composition);
2) said lubricating oil composition is identified by the viscometric descriptor SAE 10W-X, SAE 5W-X or SAE 0W-X, where X is 8, 12, 16, 20, or 30; and
3) the fuel comprises hydrogen fuel, e-fuel, co-blended fuel, or any combination thereof.

This invention also relates to a method of lubricating an internal combustion engine and reducing abnormal combustion events during operation of the engine comprising:

(i) providing the lubricating composition described herein to a crankcase of the internal combustion engine;

(ii) providing a hydrocarbon fuel, such as a petroleum fuel, a co-blended fuel and/or an e-fuel, in the internal combustion engine; and (iii) combusting the fuel in the internal combustion engine, such as a spark-ignited or compression-ignited two- or four-stroke reciprocating engine, such as a diesel engine or passenger car engine (such as a spark-ignited combustion engine, such as a such as a spark-ignited boosted direct gasoline injected combustion engine).

This invention also relates to a method of lubricating an internal combustion engine and reducing abnormal combustion events during operation of the engine comprising:

(i) providing lubricating composition as described herein to a crankcase of the internal combustion engine;

(ii) providing a co-blended fuel in the internal combustion engine; and (iii) combusting the fuel in the internal combustion engine, such as a spark-ignited or compression-ignited two- or four-stroke reciprocating engine, such as a diesel engine or passenger car engine (such as a spark-ignited combustion engine, such as a such as a spark-ignited boosted direct gasoline injected combustion engine);

wherein the co-blended fuel contains:

1) 1 (such as 5, such as 10, such as 15, such as 20, such as 25, such as 30, such as 40, such as 50, such as 60, such as 70, such as 75, such as 80, such as 90, such as 95, such as 99) mass % or more of one or more petroleum fuels, 2) 1 (such as 5, such as 10, such as 15, such as 20, such as 25, such as 30, such as 40, such as 50, such as 60, such as 70, such as 75, such as 80, such as 90, such as 95, such as 99) mass % or more of one or more fuel blending products selected from the group consisting of di-isobutylene, cyclopentanone, ethanol, methanol, prenol, isobutanol, n-propanol, isopropanol, 2-methyl-1-butanol, ethanol benzene, 3-methyl-1-butanol, dimethyl furan and methyl furan (Examples of preferred fuel blending products include di-isobutylene, methanol, ethanol, isobutanol, n-propanol, isopropanol, a fusel alcohol blend of ethanol, isobutanol, 2-methyl-1-butanol, ethanol benzene, 3-methyl-1-butanol, and a furan blend of dimethyl furan and methyl furan), based upon the weight of the petroleum fuels and fuel blending products.

The lubricants described herein, when combined with a fuel, such as a co-blended fuel, in an internal combustion engine, can reduce abnormal combustion events. For example, for a 50% (such as 75%, such as 90%) or more reduction in LSPI, as measured by Sequence IX Test described below, can be obtained as compared to the same formulation, except that P derived from ACE inhibitors is present at 0.08 mass %, based upon the weight of the lubricating oil composition.

The lubricants described herein, when combined with a fuel, such as a co-blended fuel, in an internal combustion engine, can reduce abnormal combustion events, such as for example, 3 or less, such than 2 or less, such as 1.75 or less, such as 1.5 or less, such as 1 or less, such as zero average LSPI events, as measured by as measured by Sequence IX Test described below.

The lubricants described herein, when combined with a fuel, such as a co-blended fuel, in an internal combustion engine, can reduce abnormal combustion events, such as for example, such as showing zero knock events.

The lubricants described herein, when combined with a fuel such as a co-blended fuel, having an octane number of 90 (such as 87, such as 85, such as 83) or less, in an internal combustion engine, can reduce abnormal combustion events, such as for example, 3 or less (such than 2 or less, such as 1.75 or less, such as 1.5 or less, such as 1 or less, such as zero average LSPI events, as measured by as measured by Sequence IX Test described below.

The lubricants described herein, when combined with a fuel such as a co-blended fuel, having an octane number of 90 (such as 87, such as 85, such as 83) or less, in an internal combustion engine, can reduce or eliminate knock events as compared to the same formulation, except that P derived from ACE inhibitors is present at 0.08 mass % based upon the weight of the lubricating oil composition.

The lubricants described herein, when combined with a fuel such as a co-blended fuel, having an octane number of 84 (such as 85, such as 87, such as 88, such as 89, such as 90, such as 91, such as 92, such as 93, such as 94, such as 95) or more, in an internal combustion engine, can have low or no abnormal combustion events, such as for example, 3 or less (such than 2 or less, such as 1.75 or less, such as 1.5 or less, such as 1 or less, such as zero average LSPI events, as measured by as measured by Sequence IX Test described below.

The lubricants described herein, when combined with a fuel, such as a co-blended fuel, in an internal combustion engine, can have low or no abnormal combustion events, such as for example, 3 or less, such than 2 or less, such as 1 or less, such as 0.5 or less, such as 0.05 or less, such as 0 peak pressure events, as measured by as measured by Sequence IX Test described below.

In embodiments, a co-blended fuel (optionally having at least 10 (such as 15, such as 20, such as 25, such as 30, such as 40, such as 50, such as 60, such as 70, such as 75, such as 80, such as 90, such as 95, such as 99) mass % or more of one or more fuel blending products (such as those selected from the group consisting of di-isobutylene, cyclopentanone, ethanol, methanol, prenol, isobutanol, n-propanol, isopropanol, 2-methyl-1-butanol, ethanol benzene, 3-methyl-1-butanol, dimethyl furan and methyl furan, based upon the weight of the petroleum fuels and fuel blending products), useful in combination with the lubricants herein may have an octane number of 84 or more, 85 or more, such as 88 or more, such as 90 or more, such as 91 or more, such as 92 or more, such as 93 or more, where octane number is determined according to ASTM D2700-21.

In embodiments, a co-blended fuel useful in combination with the lubricants herein may have a cetane number of 40 or more, such as 48 or more, such as 50 or more, such as 40 to 60, such as 45-55, such as 50 to 55, where cetane number is determined according to ASTM D613.

Vehicles powered by hydrogen burning internal combustion engines have application in passenger car, light duty trucks, mass transit vehicles, medium and heavy-duty trucking and more. The lubricant composition described herein can be used in hydrogen internal combustion engines This invention also relates to a method of lubricating an internal combustion engine during operation of the engine comprising:

(i) providing lubricating composition described herein to the crankcase of a hydrogen burning internal combustion engine;

(ii) providing hydrogen fuel to the hydrogen burning internal combustion engine; and (iii) combusting the fuel in the internal combustion engine.

In embodiments, the hydrogen fuel may comprise from 10 (such as 15, such as 20, such as 25, such as 30, such as 40, such as 50, such as 60, such as 70, such as 75, such as 80, such as 90, such as 95, such as 99) mass % or more hydrogen. Alternately, hydrogen fuel may comprise 100 mass % hydrogen.

In embodiments, the hydrogen fuel is combined with hydrocarbon fuels (such as petroleum fuels or hydrocarbon e-fuels described above, optionally in aerosolized form) and may comprise from 10 (such as 15, such as 20, such as 25, such as 30, such as 40, such as 50, such as 60, such as 70, such as 75, such as 80, such as 90, such as 95, such as 99) vol % to 99.9 vol % hydrogen where the balance is hydrocarbon fuel (petroleum and or e-fuel). Alternately, hydrogen fuel may comprise 0.1 to 99.9 vol % (such as 1 to 75 vol %, such as 5 to 50 vol %) hydrogen and 99 to 1 vol % (such as 99 to 25 vol %, such as 95 to 50 vol %) petroleum and/or hydrocarbon e-fuel.

In embodiments, the hydrogen fuel may be combined with compressed natural gas at volumes of 0.1 to 99.9 vol % (such as 1 to 75 vol %, such as 5 to 50 vol %) of hydrogen and 99.9 to 0.1 vol % (such as 99 to 25 vol %, such as 95 to 50 vol %) of compressed natural gas.

In embodiments, the hydrogen fuel may be hydrogen compressed natural gas where hydrogen is present at 0.1 to 20 vol % (such as 1 to 15 vol %, such as 2 to 12 vol %, such as 4 to 10 vol %) and compressed natural gas is present at 80 to 99.9 vol % (such as 99 to 85 vol %, such as 98 to 88 vol %).

Alternately, when the LOC is combined with gasoline fuel having an octane number of 88 (alternately 75, 76, 77, 78, 79, 80, 81, 82, 83, 84, 85, 86, or 87) the combination completes at least 1 (such as at least 2, such as at least 3, such as at least 4, such as 4) iterations of 175,000 cycles per iteration, as determined by Sequence IX Test, ASTM D829.

Components

A. Base Oil

The base oil (also referred to as "base stock" or "oil of lubricating viscosity") useful herein may be a single oil or a blend of oils, and is typically a large liquid constituent of a lubricating composition, also referred to as a lubricant, into which additives and optional additional oils are blended, for example, to produce a lubricating composition, such as a final lubricant composition, a concentrate, or other lubricating composition.

A base oil may be selected from vegetable, animal, mineral, and synthetic lubricating oils, and mixtures thereof. It may range in viscosity from light distillate mineral oils to heavy lubricating oils such as gas engine oil, mineral lubricating oil, motor vehicle oil and heavy duty diesel oil. Generally, the kinematic viscosity at 100° C. ("$KV_{100}$") of the base oil ranges from 1 to 30, such as 2 to 25 cSt, such as 5 to 20 cSt, as determined according to ASTM D 445-19a, in particular from 1.0 cSt to 10 cSt, from 1.5 cSt to 3.3 cSt, from 2.7 cSt to 8.1 cSt, from 3.0 cSt to 7.2 cSt, or from 2.5 cSt to 6.5 cSt. Generally, the high temperature high shear (HTHS) viscosity at 150° C. and $1.0\times10^6$ $s^{-1}$ shear rate of the base oil ranges from 0.5 to 20 cP, such as 1 to 10 cP, such as 2 to 5 cP as determined according to ASTM D4683-20).

Typically, when lubricating oil basestock(s) is used to make a concentrate, it may advantageously be present in a concentrate-forming amount to give a concentrate containing, from 5 wt % to 80 wt %, from 10 wt % to 70 wt %, or from 5 wt % to 50 wt % of active ingredient, based upon the weight of the concentrate.

Common oils useful as base oils include animal and vegetable oils (e.g. castor and lard oil), liquid petroleum oils, and hydrorefined and/or solvent-treated mineral lubricating oils of the paraffinic, naphthenic and mixed paraffinic-naphthenic types. Oils derived from coal or shale are also useful base oils. Base stocks may be manufactured using a variety of different processes including, but not limited to, distillation, solvent refining, hydrogen processing, oligomerization, esterification, and re-refining.

Synthetic lubricating oils useful herein as base oils include hydrocarbon oils such as homopolymerized and copolymerized olefins, referred to as polyalphaolefins or PAO's or group IV base oils (according to the API EOLCS 1509 definition (American Petroleum Institute Publication 1509, see section E.1.3, 19$^{th}$ edition, January 2021, www.API.org)). Examples of PAO's useful as base oils include: poly(ethylenes), copolymers of ethylene and propylene, polybutylenes, polypropylenes, propylene-isobutylene copolymers, chlorinated polybutylenes, poly(1-hexenes), poly(1-octenes), poly(1-decenes), homo- or co-polymers of $C_8$ to $C_{20}$ alkenes, homo- or co-polymers of $C_8$, and/or $C_{10}$, and/or $C_{12}$ alkenes, $C_8/C_{10}$ copolymers, $C_8/C_{10}/C_{12}$ copolymers, and $C_{10}/C_{12}$ copolymers, and the derivatives, analogues and homologues thereof.

In another embodiment, the base oil comprises polyalphaolefins comprising oligomers of linear olefins having 6 to 14 carbon atoms, more preferably 8 to 12 carbon atoms, more preferably 10 carbon atoms having a Kinematic viscosity at 100° C. of 10 or more (as measured by ASTM D 445); and preferably having a viscosity index ("VI"), as determined by ASTM D-2270, of 100 or more, preferably 110 or more, more preferably 120 or more, more preferably 130 or more, more preferably 140 or more; and/or having a pour point of −5° C. or less (as determined by ASTM D 97), more preferably −10° C. or less, more preferably −20 or less.

In another embodiment polyalphaolefin oligomers useful in the present invention comprise $C_{20}$ to $C_{1500}$ paraffins, preferably $C_{40}$ to $C_{1000}$ paraffins, preferably $C_{50}$ to $C_{750}$ paraffins, preferably $C_{50}$ to $C_{500}$ paraffins. The PAO oligomers are dimers, trimers, tetramers, pentamers, etc. of $C_5$ to $C_{14}$ alpha-olefins in one embodiment, and $C_6$ to $C_{12}$ alpha-olefins in another embodiment, and $C_8$ to $C_{12}$ alpha-olefins in another embodiment. Suitable olefins include 1-pentene, 1-hexene, 1-heptene, 1-octene, 1-nonene, 1-decene, 1-undecene and 1-dodecene. In one embodiment, the olefin is 1-decene, and the PAO is a mixture of dimers, trimers, tetramers and pentamers (and higher) of 1-decene. Useful PAO's are described more particularly in, for example, U.S. Pat. Nos. 5,171,908, 5,783,531, and in SYNTHETIC LUBRICANTS AND HIGH-PERFORMANCE FUNCTIONAL FLUIDS 1-52 (Leslie R. Rudnick & Ronald L. Shubkin, ed. Marcel Dekker, Inc. 1999).

PAO's useful in the present invention typically possess a number average molecular weight of from 100 to 21,000 g/mol in one embodiment, and from 200 to 10,000 g/mol in another embodiment, and from 200 to 7,000 g/mol in yet another embodiment, and from 200 to 2,000 g/mol in yet another embodiment, and from 200 to 500 g/mol in yet another embodiment. Desirable PAO's are commercially available as SpectraSyn™ Hi-Vis, SpectraSyn™ Low-Vis, SpectraSyn™ plus, SpectraSyn™ Elite PAO's (ExxonMobil Chemical Company, Houston Texas) and Durasyn PAO's from Ineos Oligomers USA LLC.

Synthetic lubricating oils useful as base oils also include hydrocarbon oils such as homopolymerized and copolymerized: alkylbenzenes (e.g. dodecylbenzenes, tetradecylbenzenes, dinonylbenzenes, di(2-ethylhexyl)benzenes); polyphenols (e.g. biphenyls, terphenyls, alkylated polyphenols); and alkylated diphenyl ethers and alkylated diphenyl sulfides; and the derivatives, analogues and homologues thereof.

Another suitable class of synthetic lubricating oils useful as base oils comprises the esters of dicarboxylic acids (e.g. phthalic acid, succinic acid, alkyl succinic acids and alkenyl succinic acids, maleic acid, azelaic acid, suberic acid, sebasic acid, fumaric acid, adipic acid, linoleic acid dimer, malonic acid, alkylmalonic acids, alkenyl malonic acids) reacted with a variety of alcohols (e.g. butyl alcohol, hexyl alcohol, dodecyl alcohol, 2-ethylhexyl alcohol, ethylene glycol, diethylene glycol monoether, propylene glycol). Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid.

Esters useful as synthetic oils herein also include those made from $C_5$ to $C_{12}$ monocarboxylic acids and polyols, and polyol ethers such as neopentyl glycol, trimethylolpropane, pentaerythritol, dipentaerythritol and tripentaerythritol.

Desirable ester base oils are commercially available as Esterex™ Esters (ExxonMobil Chemical Company, Houston Texas).

Silicon-based oils such as the polyalkyl-, polyaryl-, polyalkoxy- or polyaryloxysilicone oils and silicate oils comprise another useful class of synthetic lubricants useful herein; such oils include tetraethyl silicate, tetraisopropyl silicate, tetra-(2-ethylhexyl)silicate, tetra-(4-methyl-2-ethylhexyl)silicate, tetra-(p-tert-butyl-phenyl) silicate, hexa-(4-methyl-2-ethylhexyl)disiloxane, poly(methyl)siloxanes and poly(methylphenyl)siloxanes.

Other synthetic lubricating oils useful herein include liquid esters of phosphorous-containing acids (e.g., tricresyl phosphate, trioctyl phosphate, diethyl ester of decylphosphonic acid) and polymeric tetrahydrofurans.

Unrefined, refined, and re-refined oils can be used in the lubricating compositions of the present invention. Unrefined oils are those obtained directly from a natural or synthetic source without further purification treatment. For example, a shale oil obtained directly from retorting operations, a petroleum oil obtained directly from distillation, or an ester oil obtained directly from an esterification process and used without further treatment is considered an unrefined oil. Refined oils are similar to the unrefined oils except they have been further treated in one or more purification steps to improve one or more properties. Many such purification techniques, such as distillation, solvent extraction, acid or base extraction, filtration, and percolation are used by those in the art. Re-refined oils are oils obtained by processes similar to those used to obtain refined oils where the refining processes are applied to previously refined oils which have been previously used in service. Such re-refined oils are also referred to as reclaimed or reprocessed oils and often are additionally processed for removal of spent additive and oil breakdown products. A re-refined base oil is preferably substantially free from materials introduced through manufacturing, contamination or previous use.

Other examples of useful base oils are gas-to-liquid ("GTL") base oils, i.e. the base oil is an oil derived from hydrocarbons made from synthesis gas ("syn gas") containing $H_2$ and CO using a Fischer-Tropsch catalyst. These hydrocarbons typically require further processing in order to be useful as a base oil. For example, they may, by methods known in the art, be hydroisomerized; hydrocracked and hydroisomerized; dewaxed; or hydroisomerized and dewaxed. For further information on useful GTL base oils and blends thereof, please see U.S. Pat. No. 10,913,916 (column 4, line 62 to column 5, line 60) and U.S. Pat. No. 10,781,397 (column 14, line 54 to column 15, line 5, and column 16, line 44 to column 17, line 55).

In particular, oils from renewable sources, i.e., based in part on carbon and energy captured from the environment, such as biological sources, are useful herein.

The various base oils are often categorized as Group I, II, III, IV, or V according to the API EOLCS 1509 definition (American Petroleum Institute Publication 1509, see section E.1.3, 19$^{th}$ edition, January 2021, www.API.org). Generally speaking, Group I base stocks have a viscosity index of between about 80 to 120 and contain greater than about 0.03% sulfur and/or less than about 90% saturates. Group II base stocks have a viscosity index of between about 80 to 120, and contain less than or equal to about 0.03% sulfur and greater than or equal to about 90% saturates. Group III base stocks have a viscosity index greater than about 120 and contain less than or equal to about 0.03% sulfur and greater than about 90% saturates. Group IV base stocks includes polyalphaolefins (PAO). Group V base stocks include base stocks not included in Groups I-IV. (Viscosity index measured by ASTM D 2270, saturates is measured by ASTM D2007, and sulfur is measured by ASTM D2622, ASTM D4294, ASTM D4927, and ASTM D3120).

Base oils for use in the formulated lubricating compositions useful in the present disclosure are any one, two, three, or more of the variety of oils described herein. In desirable embodiments, base oils for use in the formulated lubricating compositions useful in the present disclosure are those described as API Group I, Group II, Group III (including Group III+), Group IV, and Group V oils and mixtures thereof, preferably API Group II, Group III, Group IV, and Group V oils and mixtures thereof, more preferably the Group III, Group III+, IV and Group V base oils due to their exceptional volatility, stability, viscometric and cleanliness features. Minor quantities of Group I basestock, such as the amount used to dilute additives for blending into formulated lube oil products, can be tolerated but are typically kept to a minimum, e.g., amounts only associated with their use as diluent/carrier oil for additives used on an "as-received" basis. In regard to the Group II stocks, it is more useful that the Group II base stock be in the higher quality range associated with that stock, i.e. a Group II stock having a viscosity index in the range from 100 to 120.

The base oil useful herein may be selected from any of the synthetic, natural, or re-refined oils (such as those typically used as crankcase lubricating oils for spark-ignited and compression-ignited engines). Mixtures of synthetic and/or natural and/or re-refined base oils may be used if desired. Multi-modal mixtures (such as bi- or tri-modal mixtures) of Group I, II, III, IV, and/or V base stocks may be used if desired.

The base oil or base oil blend used herein conveniently has a kinematic viscosity at 100° C. ($KV_{100}$, as measured according to ASTM D 445-19a, and reported in units of centistoke (cSt) or it its equivalent, $mm^2/s$), of about 2 to about 40 cSt, alternately of 3 to 30 cSt, alternately 4 to 20 cSt at 100° C., alternately 5 to 10 cSt, alternately the base oil or base oil blend may have a kinematic viscosity at 100° C. of 2 to 20 cSt, of 2.5 to 2 cSt, and preferably of about 2.5 cSt to about 9 cSt.

The base oil or base oil blend preferably has a saturate content of at least 65 mass %, more preferably at least 75 mass %, such as at least 85 mass %, such as greater than 90 mass % as determined by ASTM D 2007.

Preferably, the base oil or base oil blend will have a sulfur content of less than 1 mass %, preferably less than 0.6 mass %, most preferably less than 0.4 mass %, such as less than 0.3 mass %, based on the total mass of the lubricating composition, as measured by ASTM D2622.

In embodiments, the volatility of the base oil or base oil blend, as measured by the Noack test (ASTM D5800, procedure B), is less than or equal to 30 mass %, such as less than or equal to 25 mass %, such as less than or equal to 20 mass %, such as less than or equal 16 mass %, such as less than or equal to 12 mass %, such as less than or equal to 10 mass %, based on the total mass of the lubricating composition.

In embodiments, the viscosity index (VI) of the base oil is at least 95, preferably at least 110, more preferably at least 120, even more preferably at least 125, most preferably from about 130 to 240, in particular from about 105 to 140 (as determined by ASTM D 2270).

The base oil may be provided in a major amount, in combination with a minor amount of one or more additive components as described hereinafter, constituting a lubricant. This preparation may be accomplished by adding the additives directly to the oil or by adding the one or more additives in the form of a concentrate thereof to disperse or dissolve the additive(s). Additives may be added to the oil by any method known to those skilled in the art, either before, at the same time as, or after addition of other additives.

The base oil may be provided in a minor amount, in combination with minor amounts of one or more additive components as described hereinafter, constituting an additive concentrate. This preparation may be accomplished by adding the additives directly to the oil or by adding the one or more additives in the form of a solution, slurry or suspension thereof to disperse or dissolve the additive(s) in the oil. Additives may be added to the oil by any method known to those skilled in the art, either before, at the same time as, or after addition of other additives.

The base oil typically constitutes the major component of an engine oil lubricant composition of the present disclosure and typically is present in an amount ranging from about 50 to about 99 weight percent, preferably from about 70 to about 95 weight percent, and more preferably from about 80 to about 95 weight percent, based on the total weight of the composition.

Typically, one or more base oils are present in the lubricating composition in an amount of 32 weight % or more, alternately 55 weight % or more, alternately 60 weight % or more, alternately 65 weight % or more, based on the total weight of the lubricating composition. Typically, one or more base oils are present in the lubricating composition at an amount of 98 weight % or less, more preferably 95 weight % or less, even more preferably 90 weight % or less. Alternately, one or more base oils are present in the lubricating composition at from 1 to 99 mass %, alternately 50 to 97 mass %, alternately to 60 to 95 mass %, alternately 70 to 95 mass %, based upon the weight of the lubricating composition.

The base oils and blends thereof described above are also useful for making concentrates as well as for making lubricants therefrom.

Concentrates constitute a convenient means of handling additives before their use, as well as facilitating solution or dispersion of additives in lubricants. When preparing a lubricant that contains more than one type of additive (sometime referred to as "additive components"), each additive may be incorporated separately, each in the form of a concentrate. In many instances, however, it is convenient to provide a so-called additive "package" (also referred to as an "adpack") comprising one or more co-additives, such as described hereinafter, in a single concentrate.

B. Abnormal Combustion Event Inhibitor Component

Mass % of silicon, sodium, phosphorus, boron, molybdenum, and calcium is determined by ASTM 5185.

Abnormal Combustion Event ACE inhibitor compound(s) are defined to be compounds, that are not detergents or dispersants, that provide at least 0.9 (such as 0.10, 0.12, 0.15, 0.17, 0.2, 0.4, 0.5, 1.5, 2.0, 2.5, 3.0, 3.5, 4.0) mass % of one or more of P, Si, Mo, and B (preferably at least 0.9 mass % phosphorus) to a lubricating oil composition, based upon the mass of the lubricating oil composition. For purposes of determining mass % of abnormal combustion event ACE inhibitor compound(s) in a lubricating oil composition ACE inhibitor compounds shall not include detergents and dispersants. For purposes of determining mass % of P, Si, Mo and B provided to an LOC by abnormal combustion event ACE inhibitor compound(s) in a lubricating oil composition, ACE inhibitor compounds shall not include detergents and dispersants, even though the Si, Mo, B or P in detergents and dispersants (such as boron provided by any borated detergent or dispersant, or phosphorus contributed by a phenate detergent) contributes to the total amount of B, Si, P and Mo in a lubricating oil composition. In preferred embodiments the abnormal combustion event ACE inhibitor compound(s) provide 0.9 (such as 0.10, 0.12, 0.15, 0.17, 0.1740, 0.2, 0.4, 0.5, 1.5, 2.0, 2.5, 3.0, 3.5, 4.0) mass % or more of P to a lubricating oil composition and one or more of Si, Mo, and B, and optionally provide 0.21 mass % or more of Si, Mo and B to the LOC), based upon the mass of the lubricating oil composition.

Abnormal combustion event ACE inhibitor compound(s) include metal alkylthiophosphate, metal arylthiophosphate and metal alky-arylthiophosphate (such as metal diaryldithiophosphate, such as metal dialkyldithiophosphate, such as zinc diaryldithiophosphate, zinc dialkyldithiophosphate, and the like.

ACE inhibitor phosphorus containing compound(s) are defined to be one or more phosphorus containing compound (s) that provide at least 0.09 (such as 0.10, 0.12, 0.15, 0.17, 0.2, 0.24, 0.3, 0.4, 0.5, 1.5, 2.0, 2.5, 3.0, 3.5, 4.0) mass % or more phosphorus, to a lubricating oil composition, based upon the mass of the lubricating oil composition. ACE inhibitor phosphorus containing compounds can be compounds having more than one function, such as ZDDP which functions to provide anti-wear and antioxidant effects in addition to providing phosphorus for ACE inhibition.

The lubricating oil composition may comprise 0.09 (such as 0.10, 0.12, 0.15, 0.17, 0.2, 0.24, 0.3, 0.4, 0.5, 1.5, 2.0, 2.5, 3.0, 3.5, 4.0) or more mass % of phosphorus, boron, molybdenum and silicon, based upon the mass of the lubricating oil composition.

Alternately the lubricating composition may comprise from 0.09 (such as 0.10, 0.12, 0.15, 0.17, 0.2, 0.4, 0.5, 1.5, 2.0, 2.5, 3.0, 3.5, or 4.0) to 10 (such as 9, 8, 7, 6, or 5) mass % phosphorus, boron, molybdenum and silicon, based upon the mass of the lubricating oil composition.

Alternately, the lubricating composition comprises 0.09 (such as, 0.10, 0.12, 0.15, 0.17, 0.2, 0.4, 0.5, 1.5, 2.0, 2.5, 3.0, 3.5, 4.0) or more mass % of phosphorus (preferably the phosphorus is derived from metal alkylthiophosphate (such as ZDDP) based upon the mass of the lubricating oil composition.

Alternately the lubricating composition may comprise from 0.09 (such as 0.10, 0.12, 0.15, 0.17, 0.2, 0.4, 0.5, 1.5, 2.0, 2.5, 3.0, 3.5, or 4.0) to 10 (such as 9, 8, 7, 6, or 5) mass % phosphorus, based upon the mass of the lubricating oil composition.

Alternately, the lubricating composition comprises 0.09 (such as 0.10, 0.12, 0.15, 0.17, 0.2, 0.4, 0.5, 1.5, 2.0, 2.5, 3.0, 3.5, 4.0) or more mass % of phosphorus and comprises less than 1500 ppm, such as less than 1000 ppm, such as less than 500 (such as less than 300) mass % Ca and Na.

Alternately, the lubricating composition comprises 0.09 (0.10, 0.12, 0.15, 0.17, 0.2, 0.4, 0.5, 1.5, 2.0, 2.5, 3.0, 3.5, 4.0) or more mass % of phosphorus derived from zinc dialkyldithiophosphate and comprises less than 1500 ppm, such as less than 1000 ppm, such as less than 500 (such as less than 300) mass % Ca and Na.

Alternately, the lubricating composition comprises 0.12 (such as 0.15, 0.17, 0.2, 0.4, 0.5, 1.5, 2.0, 2.5, 3.0, 3.5, 4.0) or more mass % or more of phosphorus, boron, molybdenum, and silicon and comprises less than 1500 ppm, such as less than 1000 ppm, such as less than 500 (such as less than 300) mass % Ca.

Alternately, the lubricating composition comprises 0.12 (such as 0.15, 0.17, 0.2, 0.4, 0.5, 1.5, 2.0, 2.5, 3.0, 3.5, 4.0) mass % or more of phosphorus (preferably derived from metal alkylthiophosphate, such as ZDDP) and comprises less than 500 ppm (such as less than 300 ppm) mass % Ca.

Non-limiting examples of suitable ACE inhibitor compounds include metal (e.g., Pb, Sb, Mo, Zn and the like) salts of dithiophosphates (such as zinc dithiophosphate), phosphate esters, phosphite esters, amine salts of phosphoric acid esters or thiophosphoric acid esters, reaction products of dicyclopentadiene and thiophosphoric acids and combinations thereof.

In embodiments, the ACE inhibitor compound is or comprises a dihydrocarbyl dithiophosphate metal salt, where the metal of the dihydrocarbyl dithiophosphate metal salt may be an alkali or alkaline earth metal, such as aluminum, lead, tin, molybdenum, manganese, nickel or copper (such as zinc) and the hydrocarbyl groups are alkyl or aryl groups. In embodiments, the hydrocarbyl groups of the dihydrocarbyl dithiophosphate metal salt comprises the same or different linear, cyclic, and or branched alkyl groups having from about 3 to about 22 carbon atoms, from about 4 to about 18 carbon atoms, from about 4 to about 12 carbon atoms, or from about 3 to about 8 carbon atoms. In further embodiments, the alkyl group is linear or branched. In embodiments the dihydrocarbyl dithiophosphate metal salt, is one or more zinc dialkyl dithiophosphate compounds. Alternately, the hydrocarbyl groups of the dihydrocarbyl dithiophosphate metal salt comprises the same or different substituted or unsubstituted cyclic (such as aryl) groups having from about 3 to about 22 carbon atoms, from about 4 to about 18 carbon atoms, from about 5 to about 12 carbon atoms, from about 6 to about 12 carbon atoms. Alternately, the hydrocarbyl groups of the dihydrocarbyl dithiophosphate metal salt comprises the same or different substituted or unsubstituted cyclic (such as aryl) groups and or the same or different linear, cyclic, and or branched alkyl groups as described above.

Useful ACE inhibitor compound also include substituted or unsubstituted thiophosphoric acids, and salts thereof include zinc-containing compounds such as zinc dithiophosphate compounds selected from zinc dialkyl-, diaryl- and/or alkylaryl-dithiophosphates.

A metal alkylthiophosphate and more particularly a metal dialkyl dithio phosphate in which the metal constituent is zinc, or zinc dialkyl dithio phosphate (ZDDP) can be a useful ACE inhibitor compound. ZDDP can be derived from primary alcohols, secondary alcohols or mixtures thereof. ZDDP compounds generally are of the formula $Zn[SP(S)(OR^1)(OR^2)]_2$ where $R^1$ and $R^2$ are $C_1$-$C_{15}$ alkyl groups, such as $C_2$-$C_{12}$ alkyl groups, such as such as $C_3$-$C_5$ alkyl groups, alternately $C_8$ to $C_{18}$ groups, such as methyl ethyl, propyl, butyl, pentyl, hexyl, heptyl, octyl, nonyl, undecyl, dodecyl and isomers thereof, such isopropyl, isobutyl, isoamyl, isohexyl, isoheptyl, isooctyl, isononyl, isodecyl, isoundecyl, isododecyl, methyl-propyl, methyl-butyl, methyl-pentyl, ethyl-hexyl (such as 2-methyl-propyl, 2-methyl-butyl, 4-methyl-pentyl, 2-ethyl-hexyl) and the like. These alkyl groups may be straight chain or branched and may be the same or different. Alcohols used in the ZDDP production process that provide the alkyl groups can be linear or branched $C_2$ to $C_{20}$ (such as $C_3$ to $C_{12}$) alcohols, such as propanols, butanols, pentanols, hexanols, and octanols, such as linear $C_2$ to $C_{20}$ (such as $C_3$ to $C_{12}$) alcohols (such as n-propanol, n-butanol, n-pentanol, n-hexanol, n-octanol), such as branched $C_2$ to $C_{20}$ (such as $C_3$ to $C_{12}$) alcohols, such as secondary butanols, pentanols, hexanols, octanols (such as 4-methyl-2-pentanol, iso-octanol, isopropanol, 2-ethyl hexanol, iso-hexanol, iso-butanol, 2-ethyl hexanol, 2-methyl-butanol, 2-butanol, 2-methyl-propanol,) alkylated phenols, and the like. Secondary alcohols, mixtures of secondary alcohols or of primary and secondary alcohols can be used, such as mixtures of $C_2$ to $C_{1s}$ secondary alcohols or of primary and secondary alcohols. In embodiments the alcohol comprises or is a $C_{6-8}$ alcohol, or is a mixture of alcohols comprising at least one $C_{6-8}$ alcohol, such as hexanol, methyl-pentanol, octanol, and or isooctanol. In embodiments the alcohol comprises or is a $C_8$ alcohol, or is a mixture of alcohols comprising at least one $C_8$ alcohol, such as octanol and or isooctanol. Useful zinc dithiophosphates include secondary zinc dithiophosphates such as those available from The Lubrizol Corporation under the trade designations "LZ 677A", "LZ 1095" and "LZ 1371", from Chevron Oronite under the trade designation "OLOA 262" and from Afton Chemical under the trade designation "HITEC™ 7169."

The lubricating composition according to the present invention may further comprise one or more additives such as detergents, friction modifiers, anti-oxidants, pour point depressants, anti-foam agents, viscosity modifiers, dispersants, corrosion inhibitors, anti-wear agents, extreme pressure additives, demulsifiers, seal compatibility agents, additive diluent base oils, etc. Specific examples of such additives are described in for example Kirk-Othmer Encyclopedia of Chemical Technology, third edition, volume 14, pages 477-526, and several are discussed in further detail below.

C. Detergents

The lubricating composition may comprise one or more metal detergents (such as blends of metal detergents) also referred to as a "detergent additive." Metal detergents typically function both as detergents to reduce or remove deposits and as acid neutralizers or rust inhibitors, thereby reducing wear and corrosion and extending engine life. Detergents generally comprise a polar head with a long hydrophobic tail, with the polar head comprising a metal salt of an acidic organic compound. The salts may contain a substantially stoichiometric amount of the metal in which case they are usually described as normal or neutral salts, and would typically have a total base number ("TBN" as measured by ASTM D2896) of up to 150 mg KOH/g, such as from 0 to 80 (or 5-30) mg KOH/g. A large amount of a metal base may be incorporated by reacting excess metal compound (e.g., an oxide or hydroxide) with an acidic gas (e.g., carbon dioxide). Such detergents, sometimes referred to as overbased, may have a TBN of 100 mg KOH/g or more (such as 200 mg KOH/g or more), and typically will have a TBN of 250 mg KOH/g or more, such as 300 mg KOH/g or more, such as from 200 to 800 mg KOH/g, 225 to 700 mg KOH/g, 250 to 650 mg KOH/g, or 300 to 600 mg KOH/g, such as 150 to 650 mg KOH/g.

Suitable detergents include, oil-soluble neutral and overbased sulfonates, phenates, sulfurized phenates, thiophosphonates, salicylates, naphthenates and other oil-soluble carboxylates of a metal, particularly the alkali metals (Group 1 metals, e.g., Li, Na, K, Rb) or alkaline earth metals (Group 2 metals, e.g., Be, Mg, Ca, Sr, Ba), particularly, sodium, potassium, lithium, calcium, and magnesium, such as Ca and or Mg. Furthermore, the detergent may comprise hybrid detergent comprising any combination of sodium, potassium, lithium, calcium, or magnesium salts of sulfonates, phenates, sulfurized phenates, thiophosphonates, salicylates, and naphthenates or other oil-soluble carboxylates of a Group 1 and/or 2 metal.

Preferably, the detergent additive(s) useful in the present invention comprises calcium and/or magnesium metal salts. The detergent may a calcium and or magnesium carboxylate (e.g., salicylates), sulfonate, or phenate detergent. More preferably, the detergents additives are selected from magnesium salicylate, calcium salicylate, magnesium sulfonate, calcium sulfonate, magnesium phenate, calcium phenate, and hybrid detergents comprising two, three, four or more of more of these detergents and/or combinations thereof.

The metal-containing detergent may also include "hybrid" detergents formed with mixed surfactant systems including phenate and/or sulfonate components, e.g. phenate/salicylates, sulfonate/phenates, sulfonate/salicylates, sulfonates/phenates/salicylates, as described, for example, in U.S. Pat. Nos. 6,429,178; 6,429,179; 6,153,565; and 6,281,179. Where, for example, a hybrid sulfonate/phenate detergent is employed, the hybrid detergent would be considered equivalent to amounts of distinct phenate and sulfonate detergents introducing like amounts of phenate and sulfonate soaps, respectively.

The overbased metal-containing detergent may be sodium salts, calcium salts, magnesium salts, or mixtures thereof of the phenates, sulfur-containing phenates, sulfonates, salixarates and salicylates. Overbased phenates and salicylates typically have a total base number of 180 to 650 mg KOH/g, such as 200 to 450 TBN mg KOH/g. Overbased sulfonates typically have a total base number of 250 to 600 mg KOH/g, or 300 to 500 mg KOH/g. In embodiments, the sulfonate detergent may be predominantly a linear alkylbenzene sulfonate detergent having a metal ratio of at least 8 as is described in paragraphs [0026] to [0037] of US Patent Publication 2005/065045 (and granted as U.S. Pat. No. 7,407,919). The overbased detergent may be present at 0 wt % to 15 wt %, or 0.1 wt % to 10 wt %, or 0.2 wt % to 8 wt %, or 0.2 wt % to 3 wt %, based upon of the lubricating composition. For example, in a heavy duty diesel engine, the detergent may be present at 2 wt % to 3 wt % of the lubricating composition. For a passenger car engine, the detergent may be present at 0.2 wt % to 1 wt % of the lubricating composition.

The detergent additive(s) may comprise one or more magnesium sulfonate detergents. The magnesium detergent may be a neutral salt or an overbased salt. Suitably the magnesium detergent is an overbased magnesium sulfonate having TBN of from 80 to 650 mg KOH/g (ASTM D2896), such as 200 to 500 mg KOH/g, such as 240 to 450 mg KOH/g.

Alternately, the detergent additive(s) is a magnesium salicylate. Suitably the magnesium detergent is a magnesium salicylate having TBN of from 30 to 650 mg KOH/g (ASTM D2896), such as 50 to 500 mg KOH/g, such as 200 to 500 mg KOH/g, such as 240 to 450 mg KOH/g or alternately of 150 mg KOH/g or less, such as 100 mg KOH/g or less.

Alternately, the detergent additive(s) is a combination of magnesium salicylate and magnesium sulfonate.

The magnesium detergent provides the lubricating composition thereof with from 200-4000 ppm of magnesium atoms, suitably from 200-2000 ppm, from 300 to 1500 or from 450-1200 ppm of magnesium atoms (ASTM D5185).

The detergent composition may comprise (or consist of) a combination of one or more magnesium sulfonate detergents and one or more calcium salicylate detergents.

The combination of one or more magnesium sulfonate detergents and one or more calcium salicylate detergents provides the lubricating composition thereof with: 1) from 200-4000 ppm of magnesium atoms, suitably from 200-2000 ppm, from 300 to 1500 or from 450-1200 ppm of magnesium atoms (ASTM D5185), and 2) at least 500 ppm, preferably at least 750 more preferably at least 900 ppm of atomic calcium, such as from 500-4000 ppm, preferably from 750-3000 ppm, more preferably from 900-2000 ppm atomic calcium (ASTM D5185).

The detergent may comprise one or more calcium detergents such as calcium carboxylate (e.g., salicylate), sulfonate, or phenate detergent.

Suitably the calcium detergent has a TBN of from 30 to 700 mg KOH/g (ASTM D2896), such as 50 to 650 mg KOH/g, such as 200 to 500 mg KOH/g, such as 240 to 450 mg KOH/g or alternately of 150 mg KOH/g or less, such as 100 mg KOH/g or less, or 200 mg KOH/g or more, or 300 mg KOH/g or more, or 350 mg KOH/g or more.

Suitably the calcium detergent is a calcium salicylate, sulfonate or phenate having TBN of from 30 to 700 mg KOH/g, 30 to 650 mg KOH/g (ASTM D2896), such as 50 to 650 mg KOH/g, such as 200 to 500 mg KOH/g, such as 240 to 450 mg KOH/g or alternately of 150 mg KOH/g or less, such as 100 mg KOH/g or less, or 200 mg KOH/g or more, or 300 mg KOH/g or more, or 350 mg KOH/g or more.

Calcium detergent is typically present in amount sufficient to provide at least 500 ppm, preferably at least 750 more preferably at least 900 ppm atomic calcium to the lubricating oil composition (ASTM D5185). If present, any calcium detergent is suitably present in amount sufficient to provide no more than 4000 ppm, preferably no more than 3000, more preferably no more than 2000 ppm atomic calcium to the lubricating oil composition (ASTM D5185). If present, any calcium detergent is suitably present in amount sufficient to provide at from 500-4000 ppm, preferably from 750-3000 ppm more preferably from 900-2000 ppm atomic calcium to the lubricating oil composition (ASTM D5185).

Suitably the total atomic amount of metal from detergent in the lubrication composition according to all aspects of the invention is no more than 5000 ppm, preferably no more than 4000 pm and more preferably no more than 2000 ppm (ASTM D5185). The total amount of atomic metal from detergent in the lubrication oil composition according to all aspects of the invention is suitably at least 500 ppm, preferably at least 800 ppm and more preferably at least 1000 ppm (ASTM D5185). The total amount of atomic metal from detergent in the lubrication oil composition according to all aspects of the invention is suitably from 500 to 5000 ppm, preferably from 500 to 3000 ppm and more preferably from 500 to 2000 ppm (ASTM D5185).

Sulfonate detergents may be prepared from sulfonic acids which are typically obtained by the sulfonation of alkyl substituted aromatic hydrocarbons such as those obtained from the fractionation of petroleum or by the alkylation of aromatic hydrocarbons. Examples included those obtained by alkylating benzene, toluene, xylene, naphthalene, diphenyl or their halogen derivatives such as chlorobenzene, chlorotoluene and chloronaphthalene. The alkylation may be carried out in the presence of a catalyst with alkylating agents having from about 3 to more than 70 carbon atoms. The alkaryl sulfonates usually contain from about 9 to about 80 or more carbon atoms, preferably from about 16 to about 60 carbon atoms per alkyl substituted aromatic moiety. The oil soluble sulfonates or alkaryl sulfonic acids may be neutralized with oxides, hydroxides, alkoxides, carbonates, carboxylate, sulfides, hydrosulfides, nitrates, borates and ethers of the metal. The amount of metal compound is chosen having regard to the desired TBN of the final product but typically ranges from about 100 to 220 mass % (preferably at least 125 mass %) of that stoichiometrically required.

Metal salts of phenols and sulfurized phenols are prepared by reaction with an appropriate metal compound such as an oxide or hydroxide and neutral or overbased products may be obtained by methods well known in the art. Sulfurized phenols may be prepared by reacting a phenol with sulfur or a sulfur containing compound such as hydrogen sulfide, sulfur monohalide or sulfur dihalide, to form products which are generally mixtures of compounds in which 2 or more phenols are bridged by sulfur containing bridges.

Carboxylate detergents, e.g., salicylates, can be prepared by reacting an aromatic carboxylic acid (such as a $C_{5-100}$, $C_{9-30}$, $C_{14-24}$ alkyl-substituted hydroxy-benzoic acid) with an appropriate metal compound such as an oxide or hydroxide and neutral or overbased products may be obtained by methods well known in the art. The aromatic moiety of the aromatic carboxylic acid can contain heteroatoms, such as nitrogen and oxygen. Preferably, the moiety contains only carbon atoms; more preferably the moiety contains six or more carbon atoms; for example benzene is a preferred moiety. The aromatic carboxylic acid may contain one or more aromatic moieties, such as one or more benzene rings, either fused or connected via alkylene bridges.

Preferred substituents in oil-soluble salicylic acids are alkyl substituents. In alkyl—substituted salicylic acids, the alkyl groups advantageously contain 5 to 100, preferably 9 to 30, especially 14 to 20, carbon atoms. Where there is more than one alkyl group, the average number of carbon atoms in all of the alkyl groups is preferably at least 9 to ensure adequate oil solubility.

In embodiments, the ratio of atomic detergent metal to atomic molybdenum in the lubricating oil composition may be less than 3:1, such as less than 2:1.

Further, as metal organic and inorganic base salts which are used as detergents can contribute to the sulfated ash content of a lubricating oil composition, in embodiments of the present invention, the amounts of such additives are minimized. In order to maintain a low sulfur level, salicylate detergents can be used and the lubricating composition herein may comprise one or more salicylate detergents (said detergents are preferably used in amounts in the range of 0.05 to 20.0 wt. %, more preferably from 1.0 to 10.0 wt. % and most preferably in the range of from 2.0 to 5.0 wt. %, based on the total weight of the lubricating composition).

The total sulfated ash content of the lubricating composition herein is typically not greater than 2.0 wt. alternately at a level of not greater than 1.0 wt. % and alternately at a level of not greater than 0.8 wt. 00 based on the total weight of the lubricating composition as determined by ASTM D874.

Furthermore, it is useful that each of the detergents, independently, have a TBN (total base number) value in the range of from 10 to 700 mg KOH/g, 10 to 500 mg KOH/g, alternately in the range of from 100 to 650, alternately in the range of from, 10 to 500 mg KOH/g, alternately in the range of from 30 to 350 mg KOH/g and alternately in the range of from 50 to 300 mg KOH/g, as measured by ISO 3771.

Typically, lubricating compositions formulated for use in a heavy duty diesel engines comprise detergents at from about 0.5 to about 10 mass %, alternately from about 2.5 to about 7.5 mass 00 alternately from about 4 to about 6.5 mass %, based on the lubricating composition.

D. Friction Modifiers

A friction modifier is any material or materials that can alter the coefficient of friction of a surface lubricated by any lubricant or fluid containing such material(s). Friction modifiers, also known as friction reducers, or lubricity agents or oiliness agents, and other such agents that change the ability of base oils, formulated lubricating compositions, or functional fluids, to modify the coefficient of friction of a lubricated surface may be effectively used in combination with the base oils or lubricating compositions of the present disclosure if desired. Friction modifiers that lower the coefficient of friction are particularly advantageous in combination with the base oils and lubricating compositions of this disclosure.

Illustrative friction modifiers may include, for example, organometallic compounds or materials, or mixtures thereof. Illustrative organometallic friction modifiers useful in the lubricating oil formulations of this disclosure include, for example, tungsten and or molybdenum compounds, such as molybdenum amine, molybdenum diamine, an organotungstenate, a molybdenum dithiocarbamate, molybdenum dithiophosphates, molybdenum amine complexes, molybdenum carboxylates, and the like, and mixtures thereof. Examples of useful molybdenum-containing compounds may conveniently include molybdenum dithiocarbamates, trinuclear molybdenum compounds, for example as described in WO 98/26030, sulfides of molybdenum and molybdenum dithiophosphate.

Other known friction modifiers comprise oil-soluble organo-molybdenum compounds. Such organo-molybdenum friction modifiers may also provide antioxidant and antiwear credits to a lubricating oil composition. Examples of such oil-soluble organo-molybdenum compounds include dithiocarbamates, dithiophosphates, dithiophosphinates, xanthates, thioxanthates, sulfides, and the like, and mixtures thereof. Particularly preferred are molybdenum dithiocarbamates, dialkyldithiophosphates, alkyl xanthates and alkylthioxanthates.

Additionally, the molybdenum compound may be an acidic molybdenum compound. These compounds will react with a basic nitrogen compound as measured by ASTM test D-664 or D-2896 titration procedure and are typically hexavalent. Included are molybdic acid, ammonium molybdate, sodium molybdate, potassium molybdate, and other alkali metal molybdates and other molybdenum salts, e.g., hydrogen sodium molybdate, $MoOCl_4$, $MoO_2Br_2$, $Mo_2O_3Cl_6$, molybdenum trioxide or similar acidic molybdenum compounds.

Among the molybdenum compounds useful in the compositions of this invention are organo-molybdenum compounds of the formula $$Mo(R''OCS_2)_4 \text{ and } Mo(R''SCS_2)_4$$

wherein R" is an organo group selected from the group consisting of alkyl, aryl, aralkyl and alkoxyalkyl, generally of from 1 to 30 carbon atoms, and preferably 2 to 12 carbon atoms and most preferably alkyl of 2 to 12 carbon atoms. Especially preferred are the dialkyldithiocarbamates of molybdenum.

Another group of organo-molybdenum compounds useful in the lubricating compositions of this invention are trinuclear molybdenum compounds, especially those of the formula $Mo_3S_kL_nQ_z$ and mixtures thereof wherein the L are independently selected ligands having organo groups with a sufficient number of carbon atoms to render the compound soluble or dispersible in the oil, n is from 1 to 4, k varies from 4 to 7, Q is selected from the group of neutral electron donating compounds such as water, amines, alcohols, phosphines, and ethers, and z ranges from 0 to 5 and includes non-stoichiometric values. At least 21 carbon atoms should be present among all the ligand organo groups, such as at least 25, at least 30, or at least 35, carbon atoms.

Lubricating oil compositions useful in all aspects of the present invention preferably contain at least 10 ppm, at least 30 ppm, at least 40 ppm and more preferably at least 50 ppm molybdenum. Suitably, lubricating oil compositions useful in all aspects of the present invention contain no more than 1000 ppm, no more than 750 ppm or no more than 500 ppm of molybdenum. Lubricating oil compositions useful in all aspects of the present invention preferably contain from 10 to 1000, such as 30 to 750 or 40 to 500, ppm of molybdenum (measured as atoms of molybdenum).

For more information or useful friction modifiers containing Mo, please see U.S. Pat. No. 10,829,712 (column 8, line 58 to column 11, line 31).

Ashless friction modifiers may be present in the lubricating oil compositions of the present invention and are known generally and include esters formed by reacting carboxylic acids and anhydrides with alkanols and amine-based friction modifiers. Other useful friction modifiers generally include a polar terminal group (e.g. carboxyl or hydroxyl) covalently bonded to an oleophilic hydrocarbon chain. Esters of carboxylic acids and anhydrides with alkanols are described in U.S. Pat. No. 4,702,850. Examples of other conventional organic friction modifiers are described by M. Belzer in the "Journal of Tribology" (1992), Vol. 114, pp. 675-682 and M. Belzer and S. Jahanmir in "Lubrication Science" (1988), Vol. 1, pp. 3-26. Typically, the total amount of organic ashless friction modifier in a lubricant according to the present invention does not exceed 5 mass %, based on the total mass of the lubricating oil composition and preferably does not exceed 2 mass % and more preferably does not exceed 0.5 mass %.

Illustrative friction modifiers useful in the lubricating compositions described herein include, for example, alkoxylated fatty acid esters, alkanolamides, polyol fatty acid esters, borated glycerol fatty acid esters, fatty alcohol ethers, and mixtures thereof.

Illustrative alkoxylated fatty acid esters include, for example, polyoxyethylene stearate, fatty acid polyglycol ester, and the like. These can include polyoxypropylene stearate, polyoxybutylene stearate, polyoxyethylene isostearate, polyoxypropylene isostearate, polyoxyethylene palmitate, and the like.

Illustrative alkanolamides include, for example, lauric acid diethylalkanolamide, palmic acid diethylalkanolamide, and the like. These can include oleic acid diethyalkanolamide, stearic acid diethylalkanolamide, oleic acid diethylalkanolamide, polyethoxylated hydrocarbylamides, polypropoxylated hydrocarbylamides, and the like.

Illustrative polyol fatty acid esters include, for example, glycerol mono-oleate, saturated mono-, di-, and tri-glyceride esters, glycerol mono-stearate, and the like. These can include polyol esters, hydroxyl-containing polyol esters, and the like.

Illustrative borated glycerol fatty acid esters include, for example, borated glycerol mono-oleate, borated saturated mono-, di-, and tri-glyceride esters, borated glycerol monosterate, and the like. In addition to glycerol polyols, these can include trimethylolpropane, pentaerythritol, sorbitan, and the like. These esters can be polyol monocarboxylate esters, polyol dicarboxylate esters, and on occasion polyoltricarboxylate esters. Preferred can be the glycerol monooleates, glycerol dioleates, glycerol trioleates, glycerol monostearates, glycerol distearates, and glycerol tristearates and the corresponding glycerol monopalmitates, glycerol dipalmitates, and glycerol tripalmitates, and the respective isostearates, linoleates, and the like. Ethoxylated, propoxylated, butoxylated fatty acid esters of polyols, especially using glycerol as underlying polyol are useful herein.

Illustrative fatty alcohol ethers include, for example, stearyl ether, myristyl ether, and the like. Alcohols, including those that have carbon numbers from $C_3$ to $C_{50}$, can be ethoxylated, propoxylated, or butoxylated to form the corresponding fatty alkyl ethers. The underlying alcohol portion can preferably be stearyl, myristyl, $C_{11}$-$C_{13}$ hydrocarbon, oleyl, isostearyl, and the like.

Useful concentrations of friction modifiers may range from 0.01 weight percent to 5 weight percent, or about 0.1 weight percent to about 2.5 weight percent, or about 0.1 weight percent to about 1.5 weight percent, or about 0.1 weight percent to about 1 weight percent. Concentrations of molybdenum-containing materials are often described in terms of Mo metal concentration. Advantageous concentrations of Mo may range from 25 ppm to 700 ppm or more, and often with a preferred range of 50-200 ppm. Friction modifiers of all types may be used alone or in mixtures with the materials of this disclosure. Often mixtures of two or more friction modifiers, or mixtures of friction modifier(s) with alternate surface active material(s), are also desirable. For example, combinations of Mo containing compounds with polyol fatty acid esters, such as glycerol mono-oleate are useful herein.

E. Antioxidants

Antioxidants retard the oxidative degradation of base oils during service. Such degradation may result in deposits on metal surfaces, the presence of sludge, or a viscosity increase in a lubricant. A wide variety of oxidation inhibitors that are useful in lubricating oil compositions. See *Lubricants and Related Products*, Klamann, Wiley VCH, 1984; U.S. Pat. Nos. 4,798,684; and 5,084,197, for example.

Useful antioxidants include hindered phenols. These phenolic antioxidants may be ashless (metal-free) phenolic compounds or neutral or basic metal salts of certain phenolic compounds. Typical phenolic antioxidant compounds are the hindered phenolics which contain a sterically hindered hydroxyl group, and these include those derivatives of dihydroxy aryl compounds in which the hydroxyl groups are in the o- or p-position to each other. Typical phenolic antioxidants include the hindered phenols substituted with $C_{6+}$ alkyl groups and the alkylene coupled derivatives of these hindered phenols. Examples of phenolic materials of this type 2-t-butyl-4-heptyl phenol; 2-t-butyl-4-octyl phenol; 2-t-butyl-4-dodecyl phenol; 2,6-di-t-butyl-4-heptyl phenol; 2,6-di-t-butyl-4-dodecyl phenol; 2-methyl-6-t-butyl-4-heptyl phenol; and 2-methyl-6-t-butyl-4-dodecyl phenol. Other useful hindered mono-phenolic antioxidants may include, for example, hindered 2,6-di-alkyl-phenolic proprionic ester derivatives. Bis-phenolic antioxidants may also be advantageously used herein. Examples of ortho-coupled phenols include: 2,2'-bis(4-heptyl-6-t-butyl-phenol); 2,2'-bis(4-octyl-6-t-butyl-phenol); and 2,2'-bis(4-dodecyl-6-t-butyl-phenol). Para-coupled bisphenols include for example 4,4'-bis (2,6-di-t-butyl phenol) and 4,4'-methylene-bis(2,6-di-t-butyl phenol).

Effective amounts of one or more catalytic antioxidants may also be used. The catalytic antioxidants comprise an effective amount of a) one or more oil soluble polymetal organic compounds; and, effective amounts of b) one or more substituted N,N'-diaryl-o-phenylenediamine compounds or c) one or more hindered phenol compounds; or a combination of both b) and c). Catalytic antioxidants useful herein are more fully described in U.S. Pat. No. 8,048,833.

Non-phenolic oxidation inhibitors which may be used include aromatic amine antioxidants and these may be used either as such or in combination with phenolics. Typical examples of non-phenolic antioxidants include: alkylated and non-alkylated aromatic amines such as aromatic monoamines of the formula $R^8R^9R^{10}N$, where $R^8$ is an aliphatic, aromatic or substituted aromatic group, $R^9$ is an aromatic or a substituted aromatic group, and $R^{10}$ is H, alkyl, aryl or $R^{11}S(O)_xR^{12}$ where $R^{11}$ is an alkylene, alkenylene, or aralkylene group, $R^{12}$ is an alkyl group, or an alkenyl, aryl, or alkaryl group, and x is 0, 1 or 2. The aliphatic group $R^8$ may contain from 1 to about 20 carbon atoms, and preferably contains from about 6 to 12 carbon atoms. The aliphatic group is typically a saturated aliphatic group. Preferably, both $R^8$ and $R^9$ are aromatic or substituted aromatic groups, and the aromatic group may be a fused ring aromatic group such as naphthyl. Aromatic groups $R^8$ and $R^9$ may be joined together with other groups such as S.

Typical aromatic amines antioxidants have alkyl substituent groups of at least about 6 carbon atoms. Examples of aliphatic groups include hexyl, heptyl, octyl, nonyl, and decyl. Generally, the aliphatic groups will not contain more than about 14 carbon atoms. The general types of amine antioxidants useful in the present compositions include diphenylamines, phenyl naphthylamines, phenothiazines, imidodibenzyls and diphenyl phenylene diamines. Mixtures of two or more aromatic amines are also useful. Polymeric amine antioxidants can also be used. Particular examples of aromatic amine antioxidants useful in the present disclosure include: p,p'-dioctyldiphenylamine; t-octylphenyl-alpha-naphthylamine; phenyl-alphanaphthylamine; and p-octylphenyl-alpha-naphthylamine.

Sulfur containing anti-oxidants are also useful herein. In particular, one or more oil-soluble or oil-dispersible sulfur containing anti-oxidant(s) can be used as an antioxidant additive. For example, sulfurized alkyl phenols and alkali or alkaline earth metal salts thereof also are useful antioxidants herein. Suitably, the lubricating oil composition(s) of the present invention may include the one or more sulfur containing anti-oxidant(s) in an amount to provide the lubricating oil composition with from 0.02 to 0.2, preferably from 0.02 to 0.15, even more preferably 0.02 to 0.1, even more preferably 0.04 to 0.1, mass % sulfur based on the total mass of the lubricating oil composition. Optionally the oil-soluble or oil-dispersible sulfur containing anti-oxidant(s) are selected from sulfurized $C_4$ to $C_{25}$ olefin(s), sulfurized aliphatic ($C_7$ to $C_{29}$) hydrocarbyl fatty acid ester(s), ashless sulfurized phenolic anti-oxidant(s), sulfur containing organo-molybdenum compound(s), and combinations thereof. For further information, on sulfurized materials useful as anti-oxidants herein, please see U.S. Pat. No. 10,731,101 (column 15, line 55 to column 22, line 12).

Antioxidants useful herein include hindered phenols, arylamines. These antioxidants may be used individually by type or in combination with one another.

Typical antioxidants include: Irganox™ L67, ETHANOX™ 4702, Lanxess Additin™ RC 7110; ETHANOX™ 4782J; Irganox™ 1135, Irganox™ 5057, sulfurized lard oil and palm oil fatty acid methyl ester.

Antioxidant additives may be used in an amount of about 0.01 to 5 weight percent, preferably about 0.01 to 3 weight percent, more preferably 0.01 to 1.5 weight percent, more preferably 0.01 to less than 1 weight percent, based upon the weight of the lubricating composition.

Compositions according to the present disclosure may contain an additive having a different enumerated function that also has secondary effects as an antioxidant (for example, phosphorus-containing anti-wear agents (such as metal alkylthiophosphate (such as ZDDP)) may also have antioxidant effects). These additives are not included as antioxidants for purposes of determining the amount of antioxidant in a lubricating oil composition or concentrate herein.

F. Pour Point Depressants

Conventional pour point depressants (also known as lube oil flow improvers) may be added to the compositions of the present disclosure if desired. These pour point depressant may be added to lubricating compositions of the present disclosure to lower the minimum temperature at which the fluid will flow or can be poured. Examples of suitable pour point depressants include polymethacrylates, polyacrylates, polyarylamides, condensation products of haloparaffin waxes and aromatic compounds, vinyl carboxylate polymers, and terpolymers of dialkylfumarates, vinyl esters of fatty acids and allyl vinyl ethers. U.S. Pat. Nos. 1,815,022; 2,015,748; 2,191,498; 2,387,501; 2,655,479; 2,666,746; 2,721,877; 2,721,878; and 3,250,715 describe useful pour point depressants and/or the preparation thereof. Such additives may be used in an amount of about 0.01 to 5 weight percent, preferably about 0.01 to 1.5 weight percent, based upon the weight of the lubricating composition.

G. Anti-Foam Agents

Anti-foam agents may advantageously be added to lubricant compositions described herein. These agents prevent or retard the formation of stable foams. Silicones and organic polymers are typical anti-foam agents. For example, polysiloxanes, such as silicon oil or polydimethyl siloxane, provide antifoam properties.

Anti-foam agents are commercially available and may be used in minor amounts such as 5 wt % or less, 3 wt % or less, 1 wt % or less, 0.1 wt % or less, such as from 5 to wt % to 0.1 ppm such as from 3 wt % to 0.5 ppm, such as from 1 wt % to 10 ppm.

For example, it may be that the lubricating oil composition comprises an anti-foam agent comprising polyalkyl siloxane, such as a polydialkyl siloxane, for example wherein the alkyl is a $C_1$-$C_{10}$ alkyl group, e.g. a polydimethylsiloxane (PDMS), also known as a silicone oil. Alternately, the siloxane is a poly($R^3$)siloxane, wherein $R^3$ is one or more same or different linear branched or cyclic hydrocarbyls, such as alkyls or aryls, typically having 1 to 20 carbon atoms. It may be that, for example, the lubricating oil composition comprises a polymeric siloxane compound according to Formula 1 below wherein $R^1$ and $R^2$ are independently are independently methyl, ethyl, propyl, butyl, pentyl, hexyl, heptyl, octyl, nonyl or decyl, phenyl, naphthyl, alkyl substituted phenyl, or isomers thereof (such as methyl, phenyl) and n is from 2 to 1000, such as 50 to 450, alternately such as 40 to 100.

Additionally or alternatively, it may be that the lubricating oil composition comprises an organo modified siloxane (OMS), such as a siloxane modified with an organo group such as a polyether (e.g. ethylene-propyleneoxide copolymer), long chain hydrocarbyl (e.g. $C_{11}$-$C_{100}$ alkyl), or aryl (e.g. $C_6$-$C_{14}$ aryl). It may be that, for example, the lubricating oil composition comprises an organo modified siloxane compound according to Formula 1, wherein n is from 2 to 2000, such as 50 to 450 (alternately such as 40 to 100), and wherein $R^1$ and $R^2$ are the same or different, optionally wherein each of $R^1$ and $R^2$ is, independently an organo group, such as an organo group selected from polyether (e.g. ethylene-propyleneoxide copolymer), long chain hydrocarbyl (e.g. $C_{11}$-$C_{100}$ alkyl), or aryl (e.g. $C_6$-$C_{14}$ aryl). Preferably, one of $R^1$ and $R^2$ is $CH_3$.

Formula 1

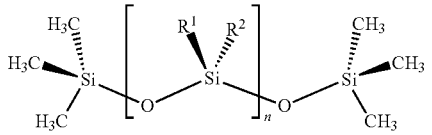

Based on the total weight of the lubricant composition, the siloxane according to Formula 1 is incorporated so as to provide about 0.1 to less than about 30 ppm Si, or about 0.1 to about 25 ppm Si, or about 0.1 to about 20 ppm Si, or about 0.1 to about 15 ppm Si, or about 0.1 to about 10 ppm Si. More preferably, it is in the range of about 3-10 ppm Si.

In an embodiment, silicone antifoam agents useful herein are available from Dow Corning Corporation and Union Carbide Corporation, such as Dow Corning FS-1265 (1000 centistokes), Dow Corning DC-200, and Union Carbide UC-L45. Silicone anti-foamants useful herein are polydimethylsiloxane, phenyl-methyl polysiloxane, linear, cyclic or branched siloxanes, silicone polymers and copolymers, and organo-silicone copolymers. Also, a siloxane polyether copolymer antifoamant available from OSI Specialties, Inc. of Farmington Hills, Mich. and may be substituted or included. One such material is sold as SILWET-L-7220.

Acrylate polymer antifoam agent can also be used herein. Typical acrylate anti-foamants include polyacrylate antifoamant available from Monsanto Polymer Products Co. known as PC-1244. A preferred acrylate polymer antifoam agent useful herein is PX™3841 (i.e., an alkyl acrylate polymer), commercially available from Dorf Ketl, also referred to as Mobilad™C402.

In embodiments, a combination of silicone anti-foamant and acrylate anti-foamant can be used, such as at a weight ratio of the silicone anti-foamant to the acrylate anti-foamant of from about 5:1 to about 1:5, see for example US 2021/0189283A1.

H. Viscosity Modifiers

Viscosity modifiers (also referred to as viscosity index improvers or viscosity improvers) can be included in the lubricating compositions described herein. Viscosity modifiers provide lubricants with high and low temperature operability. These additives impart shear stability at elevated temperatures and acceptable viscosity at low temperatures. Suitable viscosity modifiers include high molecular weight hydrocarbons, polyesters, and viscosity modifier dispersants that can function as both a viscosity modifier and a dispersant. Typical molecular weights of these polymers can be between about 10,000 to 1,500,000 g/mol, more typically about 20,000 to 1,200,000 g/mol, and even more typically between about 50,000 and 1,000,000 g/mol.

Examples of suitable viscosity modifiers are linear or star-shaped polymers and copolymers of methacrylate, butadiene, olefins, or alkylated styrenes. Polyisobutylene is a commonly used viscosity modifier. Another suitable viscosity modifier is polymethacrylate (copolymers of various chain length alkyl methacrylates, for example), some formulations of which also serve as pour point depressants. Other suitable viscosity modifiers include copolymers of ethylene and propylene, hydrogenated block copolymers of styrene and isoprene, and polyacrylates (copolymers of various chain length acrylates, for example). Specific examples include styrene-isoprene or styrene-butadiene based polymers of 50,000 to 200,000 g/mol molecular weight.

Copolymers useful as viscosity modifiers include those commercially available from Chevron Oronite Company LLC under the trade designation "PARATONE™" (such as "PARATONE™ 8921," PARATONE™ 68231," and "PARATONE™ 8941"); from Afton Chemical Corporation under the trade designation "HiTEC™" (such as HiTEC™ 5850B, and HiTEC™5777); and from The Lubrizol Corporation under the trade designation "Lubrizol™ 7067C". Hydrogenated polyisoprene star polymers useful as viscosity modifiers herein include those commercially available from Infinium International Limited, e.g., under the trade designation "SV200™" and "SV600™". Hydrogenated diene-styrene block copolymers useful as viscosity modifiers herein are commercially available from Infinium International Limited, e.g., under the trade designation "SV 50™".

Polymers useful as viscosity modifiers herein include polymethacrylate or polyacrylate polymers, such as linear polymethacrylate or polyacrylate polymers, such as those available from Evnoik Industries under the trade designation "Viscoplex™" (e.g., Viscoplex™ 6-954) or star polymers which are available from Lubrizol Corporation under the trade designation Asteric™ (e.g., Lubrizol™ 87708 and Lubrizol 87725).

Vinyl aromatic-containing polymers useful as viscosity modifiers herein may be derived from vinyl aromatic hydrocarbon monomers, such as styrenic monomers, such as styrene. Illustrative vinyl aromatic-containing copolymers useful herein may be represented by the following general formula: A-B wherein A is a polymeric block derived predominantly from vinyl aromatic hydrocarbon monomer (such as styrene), and B is a polymeric block derived predominantly from conjugated diene monomer (such as isoprene).

Typically, the viscosity modifiers may be used in an amount of about 0.01 to about 10 weight percent, such as about 0.1 to about 7 weight percent, such as 0.1 to about 4 weight percent, such as about 0.2 to about 2 weight percent, such as such as about 0.2 to about 1 weight percent, and such as such as about 0.2 to about 0.5 weight percent, based on the total weight of the formulated lubricant composition.

Viscosity modifiers are typically added as concentrates, in large amounts of diluent oil. The "as delivered" viscosity modifier typically contains from 20 weight percent to 75 weight percent of an active polymer for polymethacrylate or polyacrylate polymers, or from 8 weight percent to 20 weight percent of an active polymer for olefin copolymers, hydrogenated polyisoprene star polymers, or hydrogenated diene-styrene block copolymers, in the "as delivered" polymer concentrate.

I. Dispersants

During engine operation, oil-insoluble oxidation byproducts are produced. Dispersants help keep these byproducts in solution, thus diminishing their deposition on metal surfaces. Dispersants used in the formulation of the lubricating compositions herein may be ashless or ash-forming in nature. Preferably, the dispersant is ashless. So called ashless dispersants are organic materials that form substantially no ash upon combustion. For example, non-metal-containing or borated metal-free dispersants are considered ashless. In contrast, metal-containing detergents tend form ash upon combustion.

Dispersants useful herein typically contain a polar group attached to a relatively high molecular weight hydrocarbon chain. The polar group typically contains at least one element of nitrogen, oxygen, or phosphorus. Typical hydrocarbon chains contain 50 to 400 carbon atoms.

Dispersants of (Poly)Alkenylsuccinic Derivatives

A particularly useful class of dispersants includes the (poly)alkenylsuccinic derivatives, typically produced by the reaction of a long chain hydrocarbyl substituted succinic compound, usually a hydrocarbyl substituted succinic anhydride, with a polyhydroxy or polyamino compound. The long chain hydrocarbyl group constituting the oleophilic portion of the molecule which confers solubility in the oil, is often a polyisobutylene group (typically the long chain hydrocarbyl group, such as a polyisobutylene group, has an Mn of 400 to 3000 g/mol, such as 450 to 2500 g/mol). Many examples of this type of dispersant are well known commercially and in the literature. Exemplary U.S. patents describing such dispersants include U.S. Pat. Nos. 3,172,892; 3,2145,707; 3,219,666; 3,316,177; 3,341,542; 3,444,170; 3,454,607; 3,541,012; 3,630,904; 3,632,511; 3,787,374 and 4,234,435. Other types of dispersant are described in U.S. Pat. Nos. 3,036,003; 3,200,107; 3,254,025; 3,275,554; 3,438,757; 3,454,555; 3,565,804; 3,413,347; 3,697,574; 3,725,277; 3,725,480; 3,726,882; 4,454,059; 3,329,658; 3,449,250; 3,519,565; 3,666,730; 3,687,849; 3,702,300; 4,100,082; 5,705,458. A further description of dispersants useful herein may be found, for example, in European Patent Application No. 0 471 071 and European Patent Application No. 0 451 380, to which reference is made for this purpose.

Hydrocarbyl-substituted succinic acid and hydrocarbyl-substituted succinic anhydride derivatives are useful dispersants. In particular, succinimide, succinate esters, or succinate ester amides prepared by the reaction of a hydrocarbon-substituted succinic acid or anhydride compound (typically having at least 25 carbon atoms, such as 28 to 400 carbon atoms, in the hydrocarbon substituent), with at least one equivalent of with a polyhydroxy or polyamino compound (such as an alkylene amine) are particularly useful herein. Hydrocarbyl-substituted succinic acid and hydrocarbyl-substituted succinic anhydride derivatives may have a number average molecular weight of at least 400 g/mol, such as at least 900 g/mol, such as at least 1500 g/mol, such as from 400 and 4000 g/mol, such as from 800 to 3000, such as from 2000 and 2800 g/mol, such from about 2100 to 2500 g/mol, and such as from about 2200 to about 2400 g/mol.

Succinimides, which are particularly useful herein, are formed by the condensation reaction between: 1) hydrocarbyl substituted succinic anhydrides, such as polyisobutylene succinic anhydride (PIBSA); and 2) polyamine (PAM). Examples of suitable polyamines include: polyalkylene polyamines, hydroxy-substituted polyamines, polyoxyalkylene polyamines, and combinations thereof. Examples of polyalkylene polyamines include tetraethylene pentamine, pentaethylene hexamine, tetraethylenepentamine (TEPA), pentaethylenehaxamine (PEHA), and other polyamines having an average of 5, 6, 7, 8, or 9 nitrogen atoms per molecule). Mixtures where the average number of nitrogen atoms per polyamine molecule is greater than 7 are commonly called heavy polyamines or H-PAMs and may be commercially available under trade names such as HPA™ and HPA-X™ from DowChemical, E-100™ from Huntsman Chemical, et al. Examples of hydroxy-substituted polyamines include N-hydroxyalkyl-alkylene polyamines such as N-(2-hydroxyethyl)ethylene diamine, N-(2-hydroxyethyl)piperazine, and/or N-hydroxyalkylated alkylene diamines of the type described, for example, in U.S. Pat. No. 4,873,009. Examples of polyoxyalkylene polyamines include polyoxyethylene and/or polyoxypropylene diamines and triamines (as well as co-oligomers thereof) having an average Mn from about 200 to about 5000 g/mol. Products of this type are commercially available under the tradename Jeffamine™. Representative examples of useful succinimides are shown in U.S. Pat. Nos. 3,087,936; 3,172,892; 3,219,666; 3,272,746; 3,322,670; 3,652,616; 3,948,800; 6,821,307; and Canada Patent No. 1,094,044.

Succinate esters useful as dispersants include those formed by the condensation reaction between hydrocarbyl substituted succinic anhydrides and alcohols or polyols. For example, the condensation product of a hydrocarbyl substituted succinic anhydride and pentaerythritol is a useful dispersant.

Succinate ester amides useful herein are formed by a condensation reaction between hydrocarbyl substituted succinic anhydrides and alkanol amines. Suitable alkanol amines include ethoxylated polyalkylpolyamines, propoxylated polyalkylpolyamines, and polyalkenylpolyamines such as polyethylene polyamines and or propoxylated hexamethylenediamine. Representative examples are shown in U.S. Pat. No. 4,426,305.

Hydrocarbyl substituted succinic anhydrides (such as PIBSA) esters of hydrocarbyl bridged aryloxy alcohols are also useful as dispersants herein. For information on such dispersants, please see U.S. Pat. No. 7,485,603, particularly, column 2, line 65 to column 6, line 22 and column 23, line 40 to column 26, line 46. In particular PIBSA esters of methylene-bridged naphthyloxy ethanol (i.e., 2-hydroxyethyl-1-naphthol ether (or hydroxy-terminated ethylene oxide oligomer ether of naphthol) are useful herein.

The molecular weight of the hydrocarbyl substituted succinic anhydrides used in the preceding paragraphs will typically range from 350 to 4000 g/mol, such as 400 to 3000 g/mol, such as 450 to 2800 g/mol, such as 800 to 2500 g/mol. The above (poly)alkenylsuccinic derivatives can be post-reacted with various reagents such as sulfur, oxygen, formaldehyde, carboxylic acids such as oleic acid.

The dispersant may be present in the lubricant in an amount 0.1 mass % to 20 mass % of the composition, such as 0.2 to 15 mass %, such as 0.25 to 10 mass %, such as 0.3 to 5 mass %, such as 1.0 mass % to 3.0 mass % of the lubricating oil composition.

The above (poly)alkenylsuccinic derivatives, can also be post reacted with boron compounds such as boric acid, borate esters or highly borated dispersants, to form borated dispersants generally having from about 0.1 to about 5 moles of boron per mole of dispersant reaction product.

Dispersants useful herein include borated succinimides, including those derivatives from mono-succinimides, bis-succinimides, and/or mixtures of mono- and bis-succinimides, wherein the hydrocarbyl succinimide is derived from a hydrocarbylene group such as polyisobutylene having a Mn of from about 300 to about 5000 g/mol, or from about 500 to about 3000 g/mol, or about 1000 to about 2000 g/mol, or a mixture of such hydrocarbylene groups, often with high terminal vinylic groups.

The boron-containing dispersant may be present at 0.01 wt % to 20 wt %, or 0.1 wt % to 15 wt 00 or 0.1 wt % to 10 wt %, or 0.5 wt % to 8 wt %, or 1.0 wt % to 6.5 wt %, or 0.5 wt % to 2.2 wt % of the lubricating composition.

The boron-containing dispersant may be present in an amount to deliver boron to the composition at 15 ppm to 2000 ppm, or 25 ppm to 1000 ppm, or 40 ppm to 600 ppm, or 80 ppm to 350 ppm.

The borated dispersant may be used in combination with non-borated dispersant and may be the same or different compound as the non-borated dispersant. In one embodiment, the lubricating composition may include one or more boron-containing dispersants and one or more non-borated dispersants, wherein the total amount of dispersant may be 0.01 wt % to 20 wt %, or 0.1 wt % to 15 wt %, or 0.1 wt % to 10 wt %, or 0.5 wt % to 8 wt %, or 1.0 wt % to 6.5 wt %, or 0.5 wt % to 2.2 wt % of the lubricating composition and wherein the ratio of borated dispersant to non-boronated dispersant may be 1:10 to 10:1 (weight:weight) or 1:5 to 3:1 or 1:3 to 2:1.

Dispersants of Mannich Bases

Mannich base dispersants useful herein are typically made from the reaction of an amine component, a hydroxy aromatic compound (substituted or unsubstituted, such as alkyl substituted), such as alkylphenols, and an aldehyde, such as formaldehyde. See U.S. Pat. Nos. 4,767,551 and 10,899,986. Process aids and catalysts, such as oleic acid and sulfonic acids, can also be part of the reaction mixture.

Representative examples are shown in U.S. Pat. Nos. 3,697,574; 3,703,536; 3,704,308; 3,751,365; 3,756,953; 3,798,165; 3,803,039; 4,231,759 9,938,479; 7,491,248; 10,899,986, and WO 01/42399.

Dispersants of Polymethacrylate or Polyacrylate Derivatives

Polymethacrylate or polyacrylate derivatives are another class of dispersants useful herein. These dispersants are typically prepared by reacting a nitrogen containing monomer and a methacrylic or acrylic acid esters containing 5-25 carbon atoms in the ester group. Representative examples are shown in U.S. Pat. Nos. 2,100,993, and 6,323,164. Polymethacrylate and polyacrylate dispersants are typically lower molecular weights.

The lubricating composition of the invention typically comprises dispersant at 0.1 mass % to 20 mass % of the composition, such as 0.2 to 15 mass %, such as 0.25 to 10 mass %, such as 0.3 to 5 mass %, such as 1.0 mass % to 3.0 mass % of the lubricating oil composition. Alternately the dispersant may be present at 0.1 wt % to 5 wt %, or 0.01 wt % to 4 wt %, or 0.05 wt % to 2 wt % of the lubricating composition.

For further information on dispersants useful herein, please see U.S. Pat. No. 10,829,712 column 13, line 36 to column 16, line 67; and U.S. Pat. No. 7,485,603, column 2, line 65 to column 6, line 22, column 8, line 25 to column 14, line 53, and column 23, line 40 to column 26, line 46.

J. Corrosion Inhibitors/Antirust Agents

Corrosion inhibitors may be used to reduce the corrosion of metals and are often alternatively referred to as metal deactivators or metal passivators. Some corrosion inhibitors may alternatively be characterized as antioxidants.

Suitable corrosion inhibitors may include nitrogen and/or sulfur containing heterocyclic compounds such as triazoles (e.g., benzotriazoles), substituted thiadiazoles, imidazoles, thiazoles, tetrazoles, hydroxyquinolines, oxazolines, imidazolines, thiophenes, indoles, indazoles, quinolines, benzoxazines, dithiols, oxazoles, oxatriazoles, pyridines, piperazines, triazines and derivatives of any one or more thereof. A particular corrosion inhibitor is a benzotriazole represented by the structure:

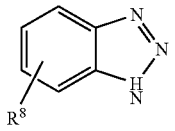

wherein $R^8$ is absent (hydrogen) or is a $C_1$ to $C_{20}$ hydrocarbyl or substituted hydrocarbyl group which may be linear or branched, saturated or unsaturated. It may contain ring structures that are alkyl or aromatic in nature and/or contain heteroatoms such as N, O, or S. Examples of suitable compounds may include benzotriazole, alkyl-substituted benzotriazoles (e.g., tolyltriazole, ethylbenzotriazole, hexylbenzotriazole, octylbenzotriazole, etc.), aryl substituted benzotriazole, alkylaryl- or arylalkyl-substituted benzotriazoles, and the like, as well as combinations thereof. For instance, the triazole may comprise or be a benzotriazole and/or an alkylbenzotriazole in which the alkyl group contains from 1 to about 20 carbon atoms or from 1 to about 8 carbon atoms. Non-limiting examples of such corrosion inhibitors may comprise or be benzotriazole, tolyltriazole, and/or optionally substituted benzotriazoles such as Irgamet™ 39, which is commercially available from BASF of Ludwigshafen, Germany. A preferred corrosion inhibitor may comprise or be benzotriazole and/or tolyltriazole.

Additionally or alternatively, the corrosion inhibitor may include a substituted thiadiazoles represented by the structure:

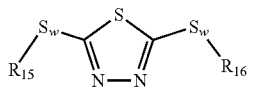

wherein $R^{15}$ and $R^{16}$ are independently hydrogen or a hydrocarbon group, which group may be aliphatic or aromatic, including cyclic, alicyclic, aralkyl, aryl and alkaryl, and wherein each w is independently 1, 2, 3, 4, 5, or 6 (preferably 2, 3, or 4, such as 2). These substituted thiadiazoles are derived from the 2,5-dimercapto-1,3,4-thiadiazole (DMTD) molecule. Many derivatives of DMTD have been described in the art, and any such compounds may be included in the fluid used in the present disclosure. For example, U.S. Pat. Nos. 2,719,125, 2,719,126, and 3,087,937 describe the preparation of various 2, 5-bis-(hydrocarbon dithio)-1,3,4-thiadiazoles.

Further additionally or alternatively, the corrosion inhibitor may include one or more other derivatives of DMTD, such as a carboxylic ester in which $R^{15}$ and $R^{16}$ may be joined to the sulfide sulfur atom through a carbonyl group. Preparation of these thioester containing DMTD derivatives is described, for example, in U.S. Pat. No. 2,760,933. DMTD derivatives produced by condensation of DMTD with alpha-halogenated aliphatic carboxylic acids having at least 10 carbon atoms are described, for example, in U.S. Pat. No. 2,836,564. This process produces DMTD derivatives wherein $R^{15}$ and $R^{16}$ are HOOC—CH($R^{19}$)— ($R^{19}$ being a hydrocarbyl group). DMTD derivatives further produced by amidation or esterification of these terminal carboxylic acid groups may also be useful.

The preparation of 2-hydrocarbyldithio-5-mercapto-1,3,4-thiadiazoles is described, for example, in U.S. Pat. No. 3,663,561.

A class of DMTD derivatives may include mixtures of a 2-hydrocarbyldithio-5-mercapto-1,3,4-thiadiazole and a 2,5-bis-hydrocarbyldithio-1,3,4-thiadiazole. Such mixtures may be sold under the tradename HiTEC® 4313 and are commercially available from Afton Chemical Company.

The preparation of 2-hydrocarbyldithio-5-mercapto-1,3,4-thiadiazoles is described, for example, in U.S. Pat. No. 3,663,561.

A class of DMTD derivatives may include mixtures of a 2-hydrocarbyldithio-5-mercapto-1,3,4-thiadiazole and a 2,5-bis-hydrocarbyldithio-1,3,4-thiadiazole. Such mixtures may be sold under the tradename HiTEC™ 4313 and are commercially available from Afton Chemical Company.

Still further additionally or alternatively, the corrosion inhibitor may include a trifunctional borate having the structure, $B(OR^{46})_3$, in which each $R^{46}$ may be the same or different. As the borate may typically be desirably compatible with the non-aqueous medium of the composition, each $R^{46}$ may in particular comprise or be a hydrocarbyl $C_1$-$C_8$ moiety. For compositions in which the non-aqueous medium comprises or is a lubricating oil basestock, for example, better compatibility can typically be achieved when the hydrocarbyl moieties are each at least $C_4$. Non-limiting examples of such corrosion inhibitors thus include, but are not limited to, triethylborate, tripropylborates such as triisopropylborate, tributylborates such as tri-tert-butylborate, tripentylborates, trihexylborates, trioctylborates such as tri-(2-ethylhexyl)borate, monohexyl dibutylborate, and the like, as well as combinations thereof.

When used, a corrosion inhibitor may comprise a substituted thiadiazole, a substituted benzotriazole, a substituted triazole, a trisubstituted borate, or a combination thereof.

When desired, corrosion inhibitors can be used in any effective amount, but, when used, may typically be used in amounts from about 0.001 wt % to 5.0 wt %, based on the weight of the composition, e.g., from 0.005 wt % to 3.0 wt % or from 0.01 wt % to 1.0 wt %. Alternately, Such additives may be used in an amount of about 0.01 to 5 weight percent, preferably about 0.01 to 1.5 weight percent, based upon the weight of the lubricating composition.

In some embodiments, 3,4-oxypyridinone-containing compositions may contain substantially no (e.g., 0, or less than 0.001 wt %, 0.0005 wt % or less, not intentionally added, and/or absolutely no) triazoles, benzotriazoles, substituted thiadiazoles, imidazoles, thiazoles, tetrazoles, hydroxyquinolines, oxazolines, imidazolines, thiophenes, indoles, indazoles, quinolines, benzoxazines, dithiols, oxazoles, oxatriazoles, pyridines, piperazines, triazines, derivatives thereof, combinations thereof, or all corrosion inhibitors.

K. Antiwear Agents

Compositions according to the present disclosure may contain an additive having a different enumerated function that also has secondary effects as an anti-wear (for example, organo-molybdenum friction modifiers (such as molybdenum dithiocarbamates, dialkyldithiophosphates, alkyl xanthates and alkylthioxanthates) may also have anti-wear effects). These additives are not included as anti-wear additives for purposes of determining the amount of anti-wear additives in a lubricating oil composition or concentrate herein.

The lubricating oil composition of the present invention can contain one or more anti-wear agents that can reduce friction and excessive wear. Any anti-wear agent known by a person of ordinary skill in the art may be used in the lubricating oil composition. Non-limiting examples of suitable anti-wear agents include metal (e.g., Zn, Pb, Sb, Mo and the like) salts of dithiocarbamates, metal (e.g., Zn, Pb, Sb and the like) salts of fatty acids, boron compounds, and combinations thereof. The amount of the anti-wear agent may vary from about 0.01 wt. % to about 5 wt. %, from about 0.05 wt. % to about 3 wt. %, or from about 0.1 wt. % to about 1 wt. %, based on the total weight of the lubricating oil composition.

In embodiments, the zinc compound can be a zinc dithiocarbamate complex, such as the zinc dithiocarbamates represented by the formula:

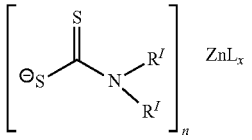

where each $R_1$ is independently a linear, cyclic, or branched, saturated or unsaturated, aliphatic hydrocarbon moiety having from 1 to about 10 carbon atoms, n is 0, 1, or 2, L is a ligand that saturates the coordination sphere of zinc, and x is 0, 1, 2, 3, or 4. In certain embodiments, the ligand, L, is selected from the group consisting of water, hydroxide, ammonia, amino, amido, alkylthiolate, halide, and combinations thereof.

The zinc carbamates are typically used in amounts of from about 0.4 weight percent to about 1.2 weight percent, preferably from about 0.5 weight percent to about 1.0 weight percent, and more preferably from about 0.6 weight percent to about 0.8 weight percent, based on the total weight of the lubricating composition, although more or less can often be used advantageously.

Antiwear additives useful herein also include boron-containing compounds, such as borate esters, borated fatty amines, borated epoxides, alkali metal (or mixed alkali metal or alkaline earth metal) borates and borated overbased metal salts.

Other Additives

Other optional additives include de-emulsifiers see 10,829,712 (Col 20, ln 34-40). Typically, a small amount of a demulsifying component may be used herein. A preferred demulsifying component is described in EP 330,522. It is obtained by reacting an alkylene oxide with an adduct obtained by reacting a bis-epoxide with a polyhydric alcohol.

Other optional additives include seal compatibility agents such as organic phosphates, aromatic esters, aromatic hydrocarbons, esters (butylbenzyl phthalate, for example), and polybutenyl succinic anhydride. Such additives may be used in an amount of about 0.001 to 5 weight percent, preferably about 0.01 to 2 weight percent.

When lubricating oil compositions contain one or more of the additives discussed above, the additive(s) are typically blended into the composition in an amount sufficient for it to perform its intended function. Typical amounts of such additives useful in the present disclosure, especially for use in crankcase lubricants, are shown the Table below.

It is noted that many of the additives are shipped from the additive manufacturer as a concentrate, containing one or more additives together, with a certain amount of base oil or other diluents.

Accordingly, the weight amounts in the table below, as well as other amounts mentioned herein, are directed to the amount of active ingredient (that is the non-diluent portion of the ingredient). The weight percent (mass %) indicated below is based on the total weight of the lubricating oil composition.

The foregoing additives are typically commercially available materials. These additives may be added independently but are usually pre-combined in packages which can be obtained from suppliers of lubricant oil additives. Additive packages with a variety of ingredients, proportions and characteristics are available and selection of the appropriate package will take the use of the ultimate composition into account.

In another aspect the lubricating oil compositions described herein contain from 600 to 1000 ppm of group 4, 5, 10, 11, 12, or 13 metals (such as group 10, 11, 12, or 13 metals, such as metal selected from the group consisting of nickel, palladium, platinum, copper, silver, gold, zinc, tin, zirconium, hafnium, titanium, vanadium, niobium, and tantalum.

Alternately the lubricating oil composition described herein contains from 50 to 5000 ppm, alternately 60 to 4000 ppm, alternately 75 to 3000 ppm, 100 to 2500 ppm, alternately 60 to 2000 ppm, alternately 100 to 1500 ppm, alternately 150 to 600 ppm, of zinc.

Alternately zinc is present at about the same amount as the phosphorus or at an amount greater than the phosphorus, based upon the weight of the zinc and phosphorus. Zinc may be present at greater than 1 wt % more that the phosphorus, such as greater than 3 wt % more, such as greater than 5 wt % more, such as greater than 7 wt % more, such as at greeter than about 10 wt % more, based upon the weight of the zinc and phosphorus.

This invention further relates to:

1. A method to reduce abnormal combustion events in the operation of an internal combustion engine comprising:
(i) providing a lubricating oil composition to the crankcase of an internal combustion engine;
(ii) providing fuel to the internal combustion engine; and
(iii) combusting the fuel in the internal combustion engine;
wherein:
1) the lubricating oil composition comprises or results from the admixing of:
(i) 50 mass % or more of base oil,
(ii) detergent providing at least 800 ppm Mg (such as at least 1200 ppm Mg) and less preferably than 500 ppm Ca; and
(iii) abnormal combustion event inhibitor compound(s) comprising at least one phosphorus containing compound providing greater than 0.12 mass % phosphorus, based upon the weight of the lubricating oil composition;
2) said lubricating oil composition is identified by the viscometric descriptor SAE 0W-X, SAE 5W-X, or SAE 10W-X, where X is 8, 12, 16, 20, or 30; and
3) when said lubricating oil composition is used with fuel having an octane number of 88, the combination completes at least 1 iteration of 175,000 cycles per iteration, as determined by Sequence IX Test, ASTM D829.

2. A method to reduce abnormal combustion events in the operation of an internal combustion engine comprising:
(i) providing a lubricating oil composition to the crankcase of an internal combustion engine;
(ii) providing fuel to the internal combustion engine; and
(iii) combusting the fuel in the internal combustion engine;
wherein:
1) the lubricating oil composition comprises or results from the admixing of:
(i) 50 mass % or more of base oil,
(ii) detergent (such as detergent providing at least 800 ppm (such as at least 1500 ppm) Mg);
(iii) one or more abnormal combustion event inhibitors comprising a phosphorus containing compound, optionally one or more of B, Si, and or Mo containing compounds, where abnormal combustion event inhibitors provide at least 1200 ppm P;
2) said lubricating oil composition is identified by the viscometric descriptor SAE 10W-X, SAE 5W-X or SAE 0W-X, where X is 8, 12, 16, 20, or 30;
3) the fuel comprises co-blended fuel, preferably the co-blended fuel comprises hydrocarbon or hydrogen fuel blended with one or more of ethanol, methanol, isopropanol, isobutanol, n-propanol, prenol, dimethyl furan, methyl furan, cyclopentanone, 2-methyl-1-butanol, ethanol benzene, and 3-methyl-1-butanol.

3. A method to reduce abnormal combustion events in the operation of an internal combustion engine comprising:
(i) providing a lubricating oil composition to the crankcase of an internal combustion engine;
(ii) providing fuel to the internal combustion engine; and
(iii) combusting the fuel in the internal combustion engine;
wherein:
1) the lubricating oil composition comprises or results from the admixing of:
(i) 50 mass % or more of base oil,
(ii) detergent (such as detergent providing at least 800 ppm (such as at least 1500 ppm) Mg);
(iii) one or more abnormal combustion event inhibitors comprising a phosphorus containing compound, and optionally one or more of B, Si, and or Mo containing compounds, where abnormal combustion event inhibitors provide at least 1200 ppm P;
2) said lubricating oil composition is identified by the viscometric descriptor SAE 10W-X, SAE 5W-X or SAE 0W-X, where X is 8, 12, 16, 20, or 30;
3) the internal combustion engine is a spark ignited internal combustion engine;
4) the fuel has an octane number that is at least 1 (such as at least 2, such as at least 3, such as at least 4, such as at least 5) octane number less than the internal combustion engine's minimum fuel octane rating.

4. A method to reduce abnormal combustion events in the operation of an internal combustion engine comprising:
(i) providing a lubricating oil composition to the crankcase of an internal combustion engine;
(ii) providing fuel to the internal combustion engine; and (iii) combusting the fuel in the internal combustion engine;

wherein:

1) the lubricating oil composition comprises or results from the admixing of:
   (i) 50 mass % or more of base oil,
   (ii) detergent containing Mg compounds, said detergent providing at least 800 ppm (such as at least 1500 ppm) Mg (preferably having reduced or absent (such as 500 ppm or less) Ca and Na compounds);
   (iii) one or more abnormal combustion event inhibitors comprising one or more of B, P, Si, and or Mo containing compounds (such as one or more phosphorus compounds, such as one or more phosphorus compounds providing greater than 0.12 mass % (such as greater than 0.24 mass %) phosphorus, based upon the weight of the lubricating oil composition);
2) said lubricating oil composition is identified by the viscometric descriptor SAE 10W-X, SAE 5W-X or SAE 0W-X, where X is 8, 12, 16, 20, or 30; and
3) the fuel comprises hydrogen fuel, e-fuel, co-blended fuel, or any combination thereof.

5. The method of paragraph 1, 2, or 3, wherein the fuel comprises a petroleum fuel, e-fuel, hydrogen fuel, co-blended fuel, or any combination thereof.
6. The method of paragraph 1, 2, 3 or 4, wherein the fuel is a co-blended fuel containing petroleum fuel and at least 10 wt % of fuel blending product (based upon the weight of the petroleum fuel and the fuel blending product based), and said fuel having an octane number of 84 or above or a cetane number of 40 or more.
7. The method of paragraph 1, 2, 3 or 4, wherein the fuel comprises diesel fuel, preferably having a cetane number of 40 to 60.
8. The method of paragraph 1, 2, 3 or 4, wherein the detergent comprises Mg compounds provide at least 800 ppm (such as at least 1500 ppm) Mg, (preferably having reduced (such as 500 ppm or less) or absent Ca and Na compounds);
9. The method of paragraph 1, 2, 3 or 4, wherein the lubricating composition comprises at least 1200 ppm phosphorus where at least 80% of the phosphorus comes from metal alkylthiophosphate(s).
10. The method of paragraph 1, wherein the lubricating oil composition has an average of less than 2 peak pressure events and less than 3 LSPI events as determined by Sequence IX Test, ASTM D829, using 88 octane reference fuel.
11. The method of paragraph 1, wherein the fuel comprises petroleum fuel having an octane number of 84 or more and the fuel is absent tetraethyl lead.
12. The method of paragraph 1, 2, 3, 4, 5, 6, 7, 8, 9, 10, or 11, wherein the lubricating oil composition has a phosphorus retention of 80% or more.
13. The method of paragraph 2 or 4, wherein the fuel comprises hydrogen fuel.
14. The method of any of paragraphs 1 to 13, wherein the detergent comprises one or more of oil-soluble neutral and overbased sulfonates, phenates, sulfurized phenates, thiophosphonates, salicylates, naphthenates and other oil-soluble carboxylates of a Group 1 and 2 metals.
15. The method of any of paragraphs 1 to 13, wherein the detergent comprises magnesium carboxylate, magnesium sulfonate, or magnesium phenate detergent.
16. The method of any of paragraphs 1 to 15, further comprising dispersant comprising polyisobutylene succinimide and or polyisobutylene succinic acid.
17. The method of any of paragraphs 1 to 16, wherein the ACE inhibitor compound(s) comprise metal dihydrocarbylthiophosphate, where the hydorcarbly group may be alkyl and or aryl (where thehydrocarbyl groups may be the same or different), preferably the alkyl group comprises one or more $C_6$ to $C_{12}$ alkyl groups (where the alkyl groups may be the same or different), and the aryl group comprises one or more $C_6$ to $C_{22}$ aryl groups (where the aryl groups may be the same).
18. The method of any of paragraphs 1 to 16, wherein the ACE inhibitor compound(s) comprises zinc dialkylthiophosphate, zinc diarylthiophosphate, and/or zinc alkylaryl-dithiophosphate.
19. The method of any of paragraphs 1 to 18, further comprising one or more friction modifiers, anti-oxidants, pour point depressants, anti-foam agents, viscosity modifiers, detergents, dispersants, corrosion inhibitors, anti-wear agents, extreme pressure additives, demulsifiers, and or seal compatibility agents.
20. The method of any of paragraphs 1 to 19, where in the lubricating oil composition:
   A) the base oil is present at 50 to 99 mass % based upon the weight of the lubricating composition;
   B) the ACE inhibitor compound(s) is present at from 0.1 to 10 mass %, based on total weight of the lubricating composition;
   C) the detergent is present at from 0.1 to 20 mass %, based on total weight of the lubricating composition;
   D) one or more friction modifiers are optionally present at from 0.01 to 5 mass %, based on total weight of the lubricating composition;
   E) one or more antioxidants are optionally present at from 0.01 to 5 mass %, based on total weight of the lubricating composition;
   F) optionally one or more pour point depressants are present at from 0.01 to 5 mass %, based on total weight of the lubricating composition;
   G) optionally, one or more anti-foaming agents are present at from 0.001 to 5 mass %, based on total weight of the lubricating composition;
   H) optionally, one or more viscosity modifiers are present at from 0.001 to 10 mass %, based on total weight of the lubricating composition;
   I) optionally, one or more dispersants are present at from 0.01 to 20 mass %, based on total weight of the lubricating composition;
   J) optionally, one or more inhibitors and/or antirust agents are present at from 0.01 to 5 mass %, based on total weight of the lubricating composition; and
   K) optionally, one or more anti-wear agents, other than those of component B), are present at from 0.001 to 5 mass % based on total weight of the lubricating composition.
21. The method of any of paragraphs 1 to 20 wherein the fuel is hydrogen fuel and the hydrogen fuel is supplied as compressed gas.
22. The method of paragraph 21 wherein the hydrogen fuel is supplied as compressed gas comprising hydrogen and compressed natural gas.
23. The method of any of paragraphs 1 to 22, wherein the engine has compression ratio of 8 or more and air fuel ratio of less than 1.0.

24. The method of any of paragraphs 1 to 23, wherein the engine is an automotive internal combustion diesel engine.
25. The method of any of paragraphs 1 to 24, wherein the engine is a spark ignited turbocharged engine.
26. The method of any of paragraphs 1 to 25, wherein the engine is a high compression spark ignition engine and has a compression ratio of at least 11:1.
27. The method of paragraph 26 wherein the high compression spark ignition engine is a super-charged engine or a turbo-charged engine.
28. The method of any of paragraphs 1 to 27, wherein the fuel is a petroleum fuel having an octane number of 93 or more, the engine is a high compression spark ignition engine and the engine has a compression ratio of at least 14:1.
29. The method of any of paragraphs 1 to 22, wherein the engine is a hydrogen engine.
30. The method of any of paragraphs 1 to 22, wherein the fuel is an 87 octane fuel and the weighted average spark advance in an engine with an 87 octane fuel rating operating at 1700 rpm and at least 45 g/s mass airflow is at least 23% higher than the weighted average spark advance in said engine, operating under the same conditions, except that the lubricating oil contains 800 mass % or less phosphorus.
31. The method of any of paragraphs 1 to 22, wherein the fuel is an 93 octane fuel and the weighted average spark advance in an engine with an 93 octane fuel rating operating at 1700 rpm and at least 47 g/s mass airflow is at least 17% higher than the weighted average spark advance in said engine, operating under the same conditions, except that the lubricating oil contains 800 mass % or less phosphorus.
32. The method of any of paragraphs 1 to 22, wherein the ACE inhibitor compound(s) are present at from 0.12 to 10 mass %, based on total weight of the lubricating composition.

This invention also relates to:

1A. A method to reduce abnormal combustion events in the operation of an internal combustion engine comprising:
(i) providing a lubricating oil composition to the crankcase of an internal combustion engine;
(ii) providing fuel to the internal combustion engine; and
(iii) combusting the fuel in the internal combustion engine;
wherein:
1) the lubricating oil composition comprises or results from the admixing of:
(i) 50 mass % or more of base oil,
(ii) optionally one or more abnormal combustion event promotors (optionally selected from magnesium containing compounds, calcium containing compounds);
(iii) one or more abnormal combustion event inhibitors comprising a phosphorus containing compound providing at least 1200 ppm phosphorus to the lubricating oil composition;
2) said lubricating oil composition is identified by the viscometric descriptor SAE 10W-X, SAE 5W-X or SAE 0W-X, where X is 8, 12, 16, 20, or 30;
3) where the lubricating oil comprises one or more abnormal combustion event promotors, the fuel comprises or more abnormal combustion event promotors, or both.

2A. The method of paragraph 1A, wherein the one or more abnormal combustion event promotors include one or more e-fuels, one or more co-blended fuels, one or more fuel additives or any combination thereof.
3A. The method of paragraph 1A, wherein one or more abnormal combustion event promotors are present in the lubricating oil composition and comprise one or more of magnesium containing compounds and or calcium containing compounds.
4A. The method of paragraph 1A, wherein one or more abnormal combustion event promotors are present in the fuel and comprise one or more of hydrogen, ethanol, tetralin, di-isobutylene, dimethyl furan, methyl furan, a combination dimethyl furan and methyl furan, cyclopentanone, ethanol, methanol, prenol, isobutanol, n-propanol, isopropanol, and a combination of ethanol, isobutanol, 2-methyl-1-butanol, ethanol benzene, and 3-methyl-1-butanol.
5A. The method of paragraph 1A, wherein abnormal combustion event inhibitors in the lubricating oil composition further comprise one or more of boron containing compounds, silicon containing compounds, and molybdenum containing compounds.
6A. A method to reduce abnormal combustion events in the operation of an internal combustion engine comprising:
(i) providing a lubricating oil composition to the crankcase of an internal combustion engine;
(ii) providing fuel to the internal combustion engine; and
(iii) combusting the fuel in the internal combustion engine;
wherein:
1) the lubricating oil composition comprises or results from the admixing of:
(i) 50 mass % or more of base oil,
(ii) detergent providing at least 800 ppm Mg, or at least 1200 ppm Mg, and optionally less than 500 ppm Ca; and
(iii) abnormal combustion event inhibitor compound(s) comprising at least one phosphorus containing compound providing greater than 0.12 mass % phosphorus, based upon the weight of the lubricating oil composition;
2) said lubricating oil composition is identified by the viscometric descriptor SAE 0W-X, SAE 5W-X, or SAE 10W-X, where X is 8, 12, 16, 20, or 30; and
3) when said lubricating oil composition is used with fuel having an octane number of 88, the combination completes at least 1 iteration of 175,000 cycles per iteration, as determined by Sequence IX Test, ASTM D829.
7A. A method to reduce abnormal combustion events in the operation of an internal combustion engine comprising:
(i) providing a lubricating oil composition to the crankcase of an internal combustion engine;
(ii) providing fuel to the internal combustion engine; and
(iii) combusting the fuel in the internal combustion engine;
wherein:
1) the lubricating oil composition comprises or results from the admixing of:
(i) 50 mass % or more of base oil,
(ii) detergent (such as detergent providing at least 800 ppm Mg, or at least 1500 ppm Mg);
(iii) one or more abnormal combustion event inhibitors comprising a phosphorus containing compound, optionally one or more of B, Si, and or Mo containing compounds, where abnormal combustion event inhibitors provide at least 1200 ppm P;

2) said lubricating oil composition is identified by the viscometric descriptor SAE 10W-X, SAE 5W-X or SAE 0W-X, where X is 8, 12, 16, 20, or 30;

3) the fuel comprises co-blended fuel, preferably the co-blended fuel comprises hydrocarbon or hydrogen fuel blended with one or more of ethanol, methanol, isopropanol, isobutanol, n-propanol, prenol, dimethyl furan, methyl furan, cyclopentanone, 2-methyl-1-butanol, ethanol benzene, and 3-methyl-1-butanol.

8A. A method to reduce abnormal combustion events in the operation of an internal combustion engine comprising:

(i) providing a lubricating oil composition to the crankcase of an internal combustion engine;

(ii) providing fuel to the internal combustion engine; and (iii) combusting the fuel in the internal combustion engine;

wherein:

1) the lubricating oil composition comprises or results from the admixing of:

(i) 50 mass % or more of base oil, (ii) detergent (such as detergent providing at least 800 ppm Mg, or at least 1500 ppm Mg);

(iii) one or more abnormal combustion event inhibitors comprising a phosphorus containing compound, and optionally one or more of B, Si, and or Mo containing compounds, where abnormal combustion event inhibitors provide at least 1200 ppm P;

2) said lubricating oil composition is identified by the viscometric descriptor SAE 10W-X, SAE 5W-X or SAE 0W-X, where X is 8, 12, 16, 20, or 30;

3) the internal combustion engine is a spark ignited internal combustion engine;

4) the fuel has an octane number that is at least 1 (such as at least 2, such as at least 3, such as at least 4, such as at least 5) octane number less than the internal combustion engine's minimum fuel octane rating.

9A. A method to reduce abnormal combustion events in the operation of an internal combustion engine comprising:

(i) providing a lubricating oil composition to the crankcase of an internal combustion engine;

(ii) providing fuel to the internal combustion engine; and (iii) combusting the fuel in the internal combustion engine;

wherein:

1) the lubricating oil composition comprises or results from the admixing of:

(i) 50 mass % or more of base oil, (ii) detergent containing Mg compounds, said detergent providing at least 800 ppm mg, or at least 1500 ppm Mg (preferably having reduced or absent (such as 500 ppm or less) Ca and Na compounds);

(iii) one or more abnormal combustion event inhibitors comprising one or more of B, P, Si, and or Mo containing compounds (such as one or more phosphorus compounds, such as one or more phosphorus compounds providing greater than 0.12 mass % (such as greater than 0.24 mass %) phosphorus, based upon the weight of the lubricating oil composition);

2) said lubricating oil composition is identified by the viscometric descriptor SAE 10W-X, SAE 5W-X or SAE 0W-X, where X is 8, 12, 16, 20, or 30; and 3) the fuel comprises hydrogen fuel, e-fuel, co-blended fuel, or any combination thereof.

10A. The method of paragraph 1A, wherein the fuel comprises a petroleum fuel, e-fuel, hydrogen fuel, co-blended fuel, or any combination thereof.

11A. The method of paragraph 1A, wherein the fuel is a co-blended fuel containing petroleum fuel and at least 10 wt % of fuel blending product (based upon the weight of the petroleum fuel and the fuel blending product based), and said fuel has an octane number of 84 or above or a cetane number of 40 or more.

12A. The method of paragraph 1A, wherein the fuel comprises diesel fuel, preferably having a cetane number of 40 to 60.

13A. The method of paragraph 1A, wherein the detergent comprises Mg compounds provide at least 800 ppm (such as at least 1500 ppm) Mg, (preferably having reduced (such as 500 ppm or less) or absent Ca and Na compounds).

14A. The method of paragraph 1A, wherein the lubricating composition comprises at least 1200 ppm phosphorus where at least 80% of the phosphorus comes from metal alkylthiophosphate(s).

15A. The method of paragraph 1A, wherein the lubricating oil composition has an average of less than 2 peak pressure events and less than 3 LSPI events as determined by Sequence IX Test, ASTM D829, using 88 octane reference fuel.

16A. The method of paragraph 1A, wherein the fuel comprises petroleum fuel having an octane number of 84 or more and the fuel is absent tetraethyl lead.

17A. The method of paragraph 1A, wherein the lubricating oil composition has a phosphorus retention of 80% or more.

18A. The method of paragraph 2A, wherein the fuel comprises hydrogen fuel.

19A. The method of paragraph 4A, wherein the fuel comprises hydrogen fuel.

20A. The method of paragraph 1A, wherein the detergent comprises one or more of oil-soluble neutral and overbased sulfonates, phenates, sulfurized phenates, thiophosphonates, salicylates, naphthenates and other oil-soluble carboxylates of a Group 1 and 2 metals.

21A. The method paragraph 1A, wherein the detergent comprises magnesium carboxylate, magnesium sulfonate, or magnesium phenate detergent.

22A. The method paragraph 1A, further comprising dispersant comprising polyisobutylene succinimide and or polyisobutylene succinic acid.

23A. The method paragraph 1A, wherein the abnormal combustion event inhibitor compound(s) comprise metal dihydrocarbylthiophosphate, where the hydorcarbly group may be alkyl and or aryl (where thehydrocarbyl groups may be the same or different), preferably the alkyl group comprises one or more $C_6$ to $C_{12}$ alkyl groups (where the alkyl groups may be the same or different), and the aryl group comprises one or more $C_6$ to $C_{22}$ aryl groups (where the aryl groups may be the same).

24A. The method of paragraph 1A, wherein the abnormal combustion event inhibitor compound(s) comprises zinc dialkylthiophosphate, zinc diarylthiophosphate, and/or zinc alkylaryl-dithiophosphate.

25A. The method of paragraph 1A, where the lubricating oil composition further comprises one or more friction modifiers, anti-oxidants, pour point depressants, anti-foam agents, viscosity modifiers, detergents, dispersants, corrosion inhibitors, anti-wear agents, extreme pressure additives, demulsifiers, and or seal compatibility agents.

26A. The method of paragraph 1A, where in the lubricating oil composition:

A) the base oil is present at 50 to 99 mass % based upon the weight of the lubricating composition;

B) the ACE inhibitor compound(s) is present at from 0.1 to 10 mass %, based on total weight of the lubricating composition;

C) the detergent is present at from 0.1 to 20 mass %, based on total weight of the lubricating composition;

D) one or more friction modifiers are optionally present at from 0.01 to 5 mass %, based on total weight of the lubricating composition;

E) one or more antioxidants are optionally present at from 0.01 to 5 mass %, based on total weight of the lubricating composition;

F) optionally one or more pour point depressants are present at from 0.01 to 5 mass %, based on total weight of the lubricating composition;

G) optionally, one or more anti-foaming agents are present at from 0.001 to 5 mass %, based on total weight of the lubricating composition;

H) optionally, one or more viscosity modifiers are present at from 0.001 to 10 mass %, based on total weight of the lubricating composition;

I) optionally, one or more dispersants are present at from 0.01 to 20 mass %, based on total weight of the lubricating composition;

J) optionally, one or more inhibitors and/or antirust agents are present at from 0.01 to 5 mass %, based on total weight of the lubricating composition; and K) optionally, one or more anti-wear agents, other than those of component B), are present at from 0.001 to 5 mass % based on total weight of the lubricating composition.

27A. The method of paragraph 1A, wherein the fuel is hydrogen fuel and the hydrogen fuel is supplied as compressed gas.

28A. The method of paragraph 27A wherein the hydrogen fuel is supplied as compressed gas comprising hydrogen and compressed natural gas.

29A. The method of paragraph 1A, wherein the engine has compression ratio of 8 or more and air fuel ratio of less than 1.0.

30A. The method of paragraph 1A, wherein the engine is an automotive internal combustion diesel engine.

31A. The method of paragraph 1A, wherein the engine is a spark ignited turbocharged engine.

32A. The method of paragraph 1A, wherein the engine is a high compression spark ignition engine and has a compression ratio of at least 11:1.

33A. The method of paragraph 32 wherein the high compression spark ignition engine is a super-charged engine or a turbo-charged engine.

34A. The method of paragraph 1A, wherein the fuel is a petroleum fuel having an octane number of 93 or more, the engine is a high compression spark ignition engine and the engine has a compression ratio of at least 14:1.

35A. The method of paragraph 1A, wherein the engine is a hydrogen engine.

36A. The method of paragraph 1A, wherein the fuel is an 87 octane fuel and the weighted average spark advance in an engine with an 93 octane fuel rating operating at 1700 rpm and at least 45 g/s mass airflow is at least 23% higher than the weighted average spark advance in said engine, operating under the same conditions, except that the lubricating oil contains 800 mass % or less phosphorus.

37A. The method of paragraph 1A, wherein the fuel is an 93 octane fuel and the weighted average spark advance in an engine with an 93 octane fuel rating operating at 1700 rpm and at least 47 g/s mass airflow is at least 17% higher than the weighted average spark advance in said engine, operating under the same conditions, except that the lubricating oil contains 800 mass % or less phosphorus.

38A. The method of paragraph 1A, wherein the ACE inhibitor compound(s) are present at from 0.12 to 10 mass %, based on total weight of the lubricating composition.

39A. The method of paragraph 1A, wherein the detergent provides at least 800 ppm, or at least 1200 ppm, or at least 1500 ppm, of Mg to the lubricating oil composition.

40A. The method of paragraph 1A, wherein the detergent provides 0 to 500 ppm of Ca and or Na to the lubricating oil composition.

41A. The method of paragraph 1A, wherein the lubricating oil composition comprises 500 ppm or less of Ca and 1500 ppm or more, or 1700 ppm or more, or 1740 ppm or more, of P.

42A. A lubricating oil composition comprising or resulting from the admixing of:

(i) 50 mass % or more of base oil, (ii) detergent optionally providing at least 500 ppm Mg, or at least 1500 ppm Mg, and less than 500 ppm Cato the lubricating oil composition; and (iii) abnormal combustion event inhibitor compound(s) comprising at least one phosphorus containing compound providing greater than 1200 ppm phosphorus, or greater than 1800 ppm phosphorus, to the lubricating oil composition, based upon the weight of the lubricating oil composition.

The following non-limiting examples are provided to illustrate the disclosure.

EXPERIMENTAL

All molecular weights are number average molecular weights (Mn) reported in g/mol unless otherwise noted.

Testing Procedures

Total Base Number is determined according to ASTM D2896 and reported in units of mg KOH/g.

Viscosity index is measured according to ASTM D2270.

$KV_{100}$ is Kinematic viscosity measured at 100° C. according to ASTM D 445-19a.

Sequence IX Testing

The Sequence IX Test, ASTM D8291-19, is a standard test method for evaluation of performance of automotive engine oils in the mitigation of low-speed, preignition in the Sequence IX gasoline turbocharged direct-injection, spark-ignition engine. 93 octane gasoline reference fuel (Haltermann HF-00003 EEE Lube Certification Gasoline, Haltermann Solutions, Houston, Texas) and 88 octane gasoline reference fuel (Haltermann HF-02021 EPA Tier 3 EEE Emission Certification Fuel, Regular Octane, Haltermann Solutions, Houston, Texas) were used in the Sequence IX test, along with Reference oils 220 and 224 obtained from the Test Monitoring Center (Freeport, Pennsylvania, USA, www.astmtmc.org).

Materials

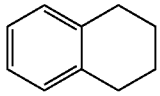

Tetralin

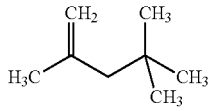

Diisobutylene (DIB)

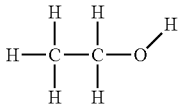

Ethanol

TABLE 1

| Lubricating Oil Blend 1 (Components) | Concentrate Wt % | Wt % in oil (9.31% treat rate) |
|---|---|---|
| PIBSA-PAM 2300 g/mol Mn | 32.23 | 3.001 |
| Si anti-foamant. | 0.03 | 0.003 |
| Magnesium sulfonate detergent TBN 400 mg KOH/g. | 20.57 | 1.915 |
| Diarylamine antioxidant | 3.22 | 0.300 |
| Phenol antioxidant | 3.22 | 0.300 |
| PIBSA 950 Mn | 2.15 | 0.200 |
| LOFI blend of diluent and dialkyl fumarate vinyl acetate copolymer. Kv100 approx 175 cSt | 0.54 | 0.050 |
| ZDDP | 31.59 | 2.941 |
| fatty acid ester friction modifier | 3.76 | 0.350 |
| octadecenyl succinic anhydride | 2.69 | 0.250 |
| PPD blend of diluent and dialkyl fumarate vinyl acetate copolymer. Kv100 approx 85 cSt | | 0.300 |
| Viscosity Modifier (hydrogenated styrene-diene copolymer/diluent) | | 5.000 |
| Diluent Oil | | 0.663 |
| Group III base oil $KV_{100}$ 4 cSt | | 63.850 |
| Group III base oil $KV_{100}$ 8 cst | | 21.540 |
| Total | 100 | 100 |

EXAMPLES

Example 1

Lubricant Oil Blend 1, Oils 220 and Oil 224 were evaluated for abnormal combustion events (such as low-speed pre-ignition) performance according to Sequence IX Testing as described above. The pass/fail parameter based on the average number of LSPI events (in four total iterations) was 0 events in 98 octane fuel and less than 2 LSPI events in 88 octane fuel. The results are reported in Table 2.

TABLE 2

| | Oil 224 | Oil 220 | Lubricating Oil Blend 1 "NK" in FIG. 1. |
|---|---|---|---|
| B (ppm) | 0 | 241 | 0 |
| m % Ca | 0.143 | 0.1125 | 0 |
| m % Mg | 0.084 | 0 | 0.174 |
| Mo (ppm) | 55 | 96 | 0 |
| m % P | 0.075 | 0.080 | 0.20 |
| m % S | 0.308 | 0.2083 | 0.4726 |
| m % Zn | 0.082 | 0.0878 | 0.220 |
| SAE Viscosity Grade | 5W-30 | 5W-30 | 5W-20 |
| Seq. IX Avg Events w/93 Octane fuel | Approx 4 | Approx 1 | 0 Test completed |
| Avg. LSPI event count | | 1-2 | 0 |

TABLE 2-continued

| | Oil 224 | Oil 220 | Lubricating Oil Blend 1 "NK" in FIG. 1. |
|---|---|---|---|
| 93 octane fuel | | (Test completed) | |
| Avg. LSPI event count 88 octane fuel | | n/a (Test terminated in first iteration due to excessive knock) | 1.67 |
| Peak Pressure only events 93 Octane | | 0 | 0 |
| Peak Pressure only events 88 Octane | | n/a (Test terminated in first iteration due to excessive knock) | 0 |

Note that Oil 220 used with the 88 octane reference fuel had such excessive knock that the test was terminated to avoid damage to the testing engine. In contrast Lubricant 1 successfully completed 1 iteration of 175,000 cycles per iteration and scored less than 2 LSPI events. This means that Lubricant Oil Blend 1 eliminated knock while using an 88 octane fuel, effectively providing an "octane lift" (i.e., allowing the fuel to perform as if it had a higher octane). It is also worth noting that the few LSPI events recorded with Lubricant 1 had very low peak pressures, i.e., they were just high enough to meet the minimum peak pressure to be assigned as LSPI. Note with lower octane fuel, the peak pressures are normally higher. For a given engine and engine control system, Lubricant 1 expands the range of fuel qualities that the engine can operate with. It effectively provides an octane lift and offers the opportunities to increase compression ratios and other operational benefits with new excursions into areas of the speed/load maps previously blocked off due to the risk of ACEs.

Example 2

The ability of Lubricant Oil Blend 1 to resist LSPI in the Sequence IX engine with a variety of fuel mixtures was evaluated. 93 octane reference fuel (Haltermann HF-00003 EEE Lube Certification Gasoline, Haltermann Solutions, Houston, Texas) was used as the baseline fuel and molecules with known propensity to impact abnormal combustion events, such as LSPI, (tetralin, diisobutylene, ethanol) were added to the base line fuel. The selected fuel additives were 2.5% and 5% tetralin, a heavy aromatic which remains longer in the combustion chamber, 15% and 30% diisobutylene and 15% and 30% ethanol, all of which increase the ignitibility of the fuel and are known to promote abnormal combustion events, such as pre-ignition). The lubricants used in this study were Oil 224, a Sequence IX borderline pass reference oil which is representative of GF-6 technology, Oil 220, a low LSPI event count oil with lower calcium (which promotes LSPI), and additional LSPI inhibitors of boron and higher levels of molybdenum compared to Oil 224, and Lubricant Oil Blend 1 ("NK" in FIG. 1). NK is formulated with no calcium detergent and instead using magnesium detergent and has 2000 ppm phosphorous (which as noted above is a strong LSPI inhibitor). Oil 224 is mixed Ca/Mg detergent system with ~750 ppm phosphorous. Oil 220 has only a low level of Ca detergent with ~800 ppm phosphorous.

Lubricant and fuel combinations were tested according to Sequence IX Test, described above, and results are shown in FIG. 1. Note that not all combinations of Oil 224, which already has a baseline event count of ~4 LSPI events with the EEE baseline fuel, and test fuels could be evaluated in order to safely minimize the potential of severe or catastrophic damage to the test engine in the case of extremely high LSPI activity. It was found that Lubricant Oil Blend 1 showed little to no LSPI activity for all fuels under investigation. In contrast, Oil 220, an oil which gives ~1 LSPI event in the Sequence IX test with EEE fuel, showed a significant increase in activity when the oil was tested with EEE+5% tetralin. In addition, the higher activity Oil 224 showed a significant increase in LSPI activity when tested with EEE+30% diisobutylene. This finding suggests that Lubricant Oil Blend 1 can effectively influence combustion dynamics to reduce or eliminate LSPI and or knock.

Example 3

To illustrate the surprising ability to use an 87 octane gasoline in an engine designed for 93 octane fuel when Lubricant Oil Blend 1 ("NK") is used as the lubricating oil, Lubricant Oil Blend 1 and a commercially available motor oil were tested in an automobile which has an engine management system (ECU) configured to run different engine management strategies depending on the fuel octane rating, (for example the ECU will advance the timing and change fuel flow rates for a 93 octane fuel as compared to an 87 octane fuel), e.g., a 2022 Ford Expedition having a 3.5 L EcoBoost V6 Engine.

Mass airflow rate (MAF) was calculated based upon the assumption that volumetric efficiency (VE)=1=100% for all conditions, the specific gas constant for dry air is 287.0528784 J/(kg*K), where J=Pa·m$^3$, and from information available from the automobile's sensors (manifold absolute pressure (MAP), revolutions per minute (RPM), and intake air temperature (IAT)). For the experiment below:

$$MAF(\text{g/s})Ve \times 0.0291333 \times (RPM \times MAP(\text{Pa}))/(IAT(^\circ K) \times 287.052874).$$

This formula was determined as follows:

$$V_r = \frac{cc}{\text{min}} = VE * \frac{3496\ cc}{2} * RPM$$

$$V_r = \frac{cc}{s} = VE * \frac{3496\ cc}{2} * RPM * \frac{1}{60\ \text{s}}$$

$$V_r = VE * \frac{3496}{120} * RPM * \frac{cc}{\text{s}}$$

-continued $$D = \frac{\text{kg}}{\text{m}^3} = \frac{MAP\ (\text{Pa})}{IAT(K) * R\left(\frac{\text{Pa} \times m^3}{kg \times K}\right)} = \frac{MAP}{IAT * R} * \frac{\text{kg}}{\text{m}^3}$$

$$D = \frac{\text{g}}{cc} = \frac{MAP}{IAT * R} * \frac{\text{kg}}{\text{m}^3} * \frac{1000\ \text{g}}{1000000\ cc} = \frac{MAP}{IAT * R * 1000} * \frac{\text{g}}{cc}$$

$$M_r = V_r * D$$

$$M_r = VE * \frac{3496}{120} * RPM * \frac{cc}{\text{s}} * \frac{MAP}{IAT * R * 1000} * \frac{\text{g}}{cc}$$

$$M_r = VE * 0.0291333 * \frac{RPM * MAP}{IAT * 287.052874} * \frac{\text{g}}{\text{s}}$$

where

Mr is mass air flow rate (g/s),

Vr is volumetric flow rate (cc/s),

D is density (g/cc),

VE is volumetric efficiency—assumed to be 1 for all conditions,

RPM is revolutions per minute,

MAP is manifold absolute pressure (g/s),

IAT is intake air temperature (K),

R is the specific gas constant for dry air (287.0528784 J/(kg*K), where J=Pa·m$^3$).

Sparking and ignition of the air-fuel mixture desirably occurs slightly before top dead center. If sparking occurs too early the air-fuel mix will combust before the piston is at top dead center causing an abnormal combustion event (spark knock) that can damage the engine. If the spark occurs at top dead center, the piston will begin to travel down the cylinder before combustion occurs causing a loss in power.

It is believed that a numerically higher spark advance (degrees moving before top dead center) allows more time for the combustion process which allows more time for a complete/more efficient burn of the air-fuel mixture. Spark advance of a drive cycle is divided into individual bins against mass airflow rate (MAF) and engine speed (RPM).

Spark advance and Spark retard (degrees moving toward or after top dead center) were obtained from automobiles sensors, based upon a sampling rate at 1 ms/1000 Hz, then combined into a weighted average by Excel™ software. The data were filtered down to cells with a minimum of 100 counts. Upper range of data not used (as it represents idling or coming off throttle). Lower range of data represents vehicle cruising state (most consistently reproducible conditions).

The weighted average spark advance at 1700 rpm is reported below at different mass airflow rates (MAF). Examples 1 to 5 were run in numerical order so that Example 3 minimized any effect of the 93 octane fuel for example 4. A higher number indicates desirable spark advance.

| Example | Fuel | Oil | Logged miles | 45 g/s MAF | 46 g/s MAF | 47 g/s MAF | 48 g/s MAF | 50 g/s MAF | 51 g/s MAF | 52 g/s MAF | 53 g/s MAF |
|---|---|---|---|---|---|---|---|---|---|---|---|
| 1 | 87 | OTC | 127.9 | 27.3 | 22.8 | 19.7 | 16.5 | 11.5 | 10 | 8.5 | 7.5 |
| 2 | 93 | OTC | 416.1 | 31.9 | 29.1 | 26.1 | 22.6 | 18.1 | 15.9 | 14.3 | 12.7 |
| 3 | 87 | OTC | 95.3 | 21.4 | 24.3 | 21.2 | 18.9 | 13.9 | 11.9 | 10.7 | 9.3 |
| 4 | 87 | NK | 601.6 | 33.6 | 33 | 31.1 | 29.1 | 23.6 | 20.1 | 17.3 | 15.8 |
| 5 | 93 | NK | 207 | 30.9 | 29.7 | 30.5 | 28.7 | 26.1 | 23.4 | 22.1 | 20.2 |
| Inc. Ex 4 vs. Ex 1 | | | — | 23% | 45% | 58% | 76% | 105% | 101% | 104% | 111% |
| Inc. Ex 5 vs. Ex 2 | | | — | — | — | 17% | 27% | 44% | 47% | 54% | 59% |

OTC is a commercially available Motorcraft™ motor oil.

| | OTC | Lubricating Oil Blend 1 "NK" |
|---|---|---|
| m % B | 0.0105 | 0 |
| m % Ca | 0.1332 | 0 |
| m % Mg | 0.0395 | 0.174 |
| m % Mo | 0.0149 | 0 |
| m % P | 0.0722 | 0.2000 |
| m % S | 0.2702 | 0.4726 |
| m % Zn | 0.0816 | 0.2200 |
| m % Si | 0.0145 | 0.0006 |
| SAE Viscosity Grade | 5W-30 | 5W-20 |

When comparing Example 1 to Example 4 (87 octane fuel) at the different mass airflow rates we can see that as the mass airflow rate increases the benefit of the NK lubricating oil also increases. Note that at 50 to 53 MAF more than a 100% increase in weighted average spark advance is obtained indicating a significant decrease in abnormal combustion events.

When comparing Example 2 to Example 5 (93 octane fuel) at the different mass airflow rates we can see that as the mass airflow rate increases the benefit of the NK lubricating oil also increases. Note that at 50 to 53 MAF more than a 40% increase in weighted average spark advance is obtained indicating a significant decrease in abnormal combustion events.

All documents described herein are incorporated by reference herein, including any priority documents and/or testing procedures, to the extent they are not inconsistent with this text. As is apparent from the foregoing general description and the specific embodiments, while forms of the invention have been illustrated and described, various modifications can be made without departing from the spirit and scope of the invention. Accordingly, it is not intended that the invention be limited thereby. The term "comprising" is considered synonymous with the term "including." Likewise, whenever a composition, an element, or a group of elements is preceded with the transitional phrase "comprising," it is understood that we also contemplate the same composition or group of elements with transitional phrases "consisting essentially of," "consisting of," "selected from the group of consisting of," or "is" preceding the recitation of the composition, element, or elements and vice versa.

What is claimed is:

1. A method to reduce abnormal combustion events in the operation of a spark ignited internal combustion engine comprising:

(i) providing a lubricating oil composition to the crankcase of a spark ignited internal combustion engine;

(ii) providing fuel to the spark ignited internal combustion engine; and (iii) combusting the fuel in the spark ignited internal combustion engine;

wherein:

1) The lubricating oil composition comprises or results from the admixing of:

(i) 50 mass % or more of base oil, (ii) one or more abnormal combustion event promotors selected from the group consisting of magnesium containing compounds, calcium containing compounds and combinations thereof;

(iii) one or more abnormal combustion event inhibitors comprising a phosphorus containing compound providing at least 1200 ppm phosphorus to the lubricating oil composition;

2) said lubricating oil composition is identified by the viscometric descriptor SAE 10W-X, SAE 5W-X or SAE OW-X, where X is 8, 12, 16, 20, or 30;

wherein the fuel comprises an e-fuel, a hydrogen fuel, a co-blended fuel, or a combination thereof including one or more abnormal combustion event promotors selected from the group consisting of hydrogen, ethanol, tetralin, di-isobutylene, dimethyl furan, methyl furan, a combination of dimethyl furan and methyl furan, cyclopentanone, ethanol, methanol, prenol, isobutanol, n-propanol, isopropanol, and a combination of ethanol, isobutanol, 2-methyl-1-butanol, ethanol benzene, and 3-methyl-1-butanol;

wherein the fuel has an octane number that is at least 2 less than the internal combustion engine's minimum fuel octane rating; and wherein the average LSPI event count upon combusting the fuel in the spark ignited internal combustion engine is less than 2.

2. The method of claim 1, wherein abnormal combustion event inhibitors in the lubricating oil composition further comprise one or more of boron containing compounds, silicon containing compounds, and molybdenum containing compounds.

3. A method to reduce abnormal combustion events in the operation of a spark ignited internal combustion engine comprising:

(i) providing a lubricating oil composition to the crankcase of a spark ignited internal combustion engine;

(ii) providing fuel to the spark ignited internal combustion engine; and (iii) combusting the fuel in the spark ignited internal combustion engine;

wherein:

1) The lubricating oil composition comprises or results from the admixing of:

(i) 50 mass % or more of base oil, (ii) detergent providing at least 800 ppm Mg, and less than 500 ppm Ca; and (iii) abnormal combustion event inhibitor compound(s) comprising at least one phosphorus containing compound providing greater than 0.12 mass % phosphorus, based upon the weight of the lubricating oil composition;

2) said lubricating oil composition is identified by the viscometric descriptor SAE OW-X, SAE 5W-X, or SAE 10W-X, where X is 8, 12, 16, 20, or 30; and wherein the fuel comprises an e-fuel, a hydrogen fuel, a co-blended fuel, or a combination thereof including one or more abnormal combustion event promotors selected from the group consisting of hydrogen, ethanol, tetralin, di-isobutylene, dimethyl furan, methyl furan, a combination of dimethyl furan and methyl furan, cyclopentanone, ethanol, methanol, prenol, isobutanol, n-propanol, isopropanol, and a combination of ethanol, isobutanol, 2-methyl-1-butanol, ethanol benzene, and 3-methyl-1-butanol;

wherein the fuel has an octane number that is at least 2 less than the internal combustion engine's minimum fuel octane rating; and 3) when said lubricating oil composition is used with fuel having an octane number that is at least 2 less than the internal combustion engine's minimum fuel octane rating, the combination completes at least 1 iteration of 175,000 cycles per iteration, as determined by Sequence IX Test, ASTM D829.

4. A method to reduce abnormal combustion events in the operation of a spark ignited internal combustion engine comprising:

(i) providing a lubricating oil composition to the crankcase of a spark ignited internal combustion engine;

(ii) providing fuel to the spark ignited internal combustion engine; and (iii) combusting the fuel in the spark ignited internal combustion engine;

wherein:

1) The lubricating oil composition comprises or results from the admixing of:

(i) 50 mass % or more of base oil, (ii) detergent providing at least 800 ppm Mg;

(iii) one or more abnormal combustion event inhibitors comprising a phosphorus containing compound, one or more of B, Si, and or Mo containing compounds, where abnormal combustion event inhibitors provide at least 1200 ppm P;

2) said lubricating oil composition is identified by the viscometric descriptor SAE 10W-X, SAE 5W-X or SAE OW-X, where X is 8, 12, 16, 20, or 30;

3) the fuel comprises co-blended fuel comprising hydrocarbon or hydrogen fuel blended with one or more of ethanol, methanol, isopropanol, isobutanol, n-propanol, prenol, dimethyl furan, methyl furan, cyclopentanone, 2-methyl-1-butanol, ethanol benzene, and 3-methyl-1-butanol;

wherein the fuel has an octane number that is at least 2 less than the internal combustion engine's minimum fuel octane rating; and wherein the average LSPI event count upon combusting the fuel in the spark ignited internal combustion engine is less than 2.

5. The method of claim 1, wherein the fuel is a co-blended fuel containing petroleum fuel and at least 10 wt % of fuel blending product (based upon the weight of the petroleum fuel and the fuel blending product based), and said fuel has an octane number of 84.

6. The method of claim 1, wherein the magnesium containing compounds are one or more detergents that provide at least 800 ppm Mg, and are absent Ca and Na compounds.

7. The method of claim 1, wherein at least 80% of the phosphorus comes from metal alkylthiophosphate(s).

8. The method of claim 1, wherein the lubricating oil composition has an average of less than 2 peak pressure events and less than 3 LSPI events as determined by Sequence IX Test, ASTM D829, using 88 octane reference fuel.

9. The method of claim 1, wherein the fuel comprises petroleum fuel having an octane number of 84 or more and the fuel is absent tetraethyl lead.

10. The method of claim 1, wherein the lubricating oil composition has a phosphorus retention of 80% or more.

11. The method of claim 1, wherein the fuel comprises hydrogen fuel.

12. The method of claim 6, wherein the detergent comprises one or more of oil-soluble neutral and overbased sulfonates, phenates, sulfurized phenates, thiophosphonates, salicylates, naphthenates and other oil-soluble carboxylates of a Group 1 and 2 metals.

13. The method claim 6, wherein the detergent comprises magnesium carboxylate, magnesium sulfonate, or magnesium phenate detergent.

14. The method claim 1, further comprising dispersant comprising polyisobutylene succinimide and or polyisobutylene succinic acid.

15. The method claim 1, wherein the abnormal combustion event inhibitor compound(s) comprise metal dihydrocarbylthiophosphate, where the hydrocarbyl group may be alkyl and or aryl, the alkyl group comprises one or more $C_6$ to $C_{12}$ alkyl groups, and the aryl group comprises one or more $C_6$ to $C_{22}$ aryl groups.

16. The method of claim 1, wherein the abnormal combustion event inhibitor compound(s) comprises zinc dialkylthiophosphate, zinc diarylthiophosphate, and/or zinc alkylaryl-dithiophosphate.

17. The method of claim 1, where the lubricating oil composition further comprises one or more friction modifiers, anti-oxidants, pour point depressants, anti-foam agents, viscosity modifiers, detergents, dispersants, corrosion inhibitors, anti-wear agents, extreme pressure additives, demulsifiers, and or seal compatibility agents.

18. The method of claim 6, where in the lubricating oil composition:

A) the base oil is present at 50 to 99 mass % based upon the weight of the lubricating composition;

B) the ACE inhibitor compound(s) is present at from 0.1 to 10 mass %, based on total weight of the lubricating composition;

C) the one or more detergent are present at from 0.1 to 20 mass %, based on total weight of the lubricating composition;

D) one or more friction modifiers are optionally present at from 0.01 to 5 mass %, based on total weight of the lubricating composition;

E) one or more antioxidants are optionally present at from 0.01 to 5 mass %, based on total weight of the lubricating composition;

F) optionally one or more pour point depressants are present at from 0.01 to 5 mass %, based on total weight of the lubricating composition;

G) optionally, one or more anti-foaming agents are present at from 0.001 to 5 mass %, based on total weight of the lubricating composition;

H) optionally, one or more viscosity modifiers are present at from 0.001 to 10 mass %, based on total weight of the lubricating composition;

I) optionally, one or more dispersants are present at from 0.01 to 20 mass %, based on total weight of the lubricating composition;

J) optionally, one or more inhibitors and/or antirust agents are present at from 0.01 to 5 mass %, based on total weight of the lubricating composition; and K) optionally, one or more anti-wear agents, other than those of component B), are present at from 0.001 to 5 mass % based on total weight of the lubricating composition.

19. The method of claim 1, wherein the fuel is hydrogen fuel and the hydrogen fuel is supplied as compressed gas.

20. The method of claim 19 wherein the hydrogen fuel is supplied as compressed gas comprising hydrogen and compressed natural gas.

21. The method of claim 1, wherein the engine has compression ratio of 8 or more and air fuel ratio of less than 1.0.

22. The method of claim 1, wherein the engine is an automotive spark ignited internal combustion diesel engine.

23. The method of claim 1, wherein the engine is a spark ignited turbocharged engine.

24. The method of claim 1, wherein the engine is a high compression spark ignition engine and has a compression ratio of at least 11:1.

25. The method of claim 24 wherein the high compression spark ignition engine is a super-charged engine or a turbo-charged engine.

26. The method of claim 1, wherein the fuel is a petroleum fuel having an octane number of 93 or more, the engine is a high compression spark ignition engine and the engine has a compression ratio of at least 14:1.

27. The method of claim 1, wherein the engine is a hydrogen engine.

28. The method of claim 1, wherein the fuel is an 87 octane fuel and the weighted average spark advance in an engine with an 93 octane fuel rating operating at 1700 rpm and at least 45 g/s mass airflow is at least 23% higher than the weighted average spark advance in said engine, operating under the same conditions, except that the lubricating oil contains 800 mass % or less phosphorus.

29. The method of claim 1, wherein the fuel is an 93 octane fuel and the weighted average spark advance in an engine with an 93 octane fuel rating operating at 1700 rpm and at least 47 g/s mass airflow is at least 17% higher than the weighted average spark advance in said engine, operating under the same conditions, except that the lubricating oil contains 800 mass % or less phosphorus.

30. The method of claim 1, wherein the ACE inhibitor compound(s) are present at from 0.12 to 10 mass %, based on total weight of the lubricating composition.

31. The method of claim 1, wherein the detergent provides at least 800 ppm, of Mg to the lubricating oil composition.

32. The method of claim 1, wherein the one or more abnormal combustion event promotors provide 0 to 500 ppm of Ca and or Na to the lubricating oil composition.

33. The method of claim 1, wherein the lubricating oil composition comprises 500 ppm or less of Ca and 1740 ppm or more, of P.

34. A lubricating oil composition comprising or resulting from the admixing of:

(i) 50 mass % or more of base oil, (ii) detergent providing at least 500 ppm Mg, and less than 500 ppm Ca to the lubricating oil composition; and (iii) abnormal combustion event inhibitor compound(s) comprising at least one phosphorus containing compound providing greater than 1200 ppm phosphorus, to the lubricating oil composition, based upon the weight of the lubricating oil composition;

wherein the average LSPI event count upon combusting a fuel comprising an e-fuel, a hydrogen fuel, a co-blended fuel, or a combination thereof in a spark ignited internal combustion engine is less than 2;

wherein the fuel includes one or more abnormal combustion event promotors selected from the group consisting of hydrogen, ethanol, tetralin, di-isobutylene, dimethyl furan, methyl furan, a combination of dimethyl furan and methyl furan, cyclopentanone, ethanol, methanol, prenol, isobutanol, n-propanol, isopropanol, and a combination of ethanol, isobutanol, 2-methyl-1-butanol, ethanol benzene, and 3-methyl-1-butanol; and wherein the fuel has an octane number that is at least 2 less than the internal combustion engine's minimum fuel octane rating.

35. The method of claim 1, wherein the phosphorus containing compound provides at least 2400 ppm phosphorus to the lubricating oil composition.

36. The method of claim 3, wherein the at least one phosphorus containing compound provides at least 2400 ppm phosphorus to the lubricating oil composition.

37. The method of claim 4, wherein the abnormal combustion event inhibitors provide at least 2400 ppm phosphorus to the lubricating oil composition.

38. The lubricating oil composition of claim 34, wherein the at least one phosphorus containing compound provides at least 2400 ppm phosphorus to the lubricating oil composition.

* * * * *